US011291883B2

(12) United States Patent
Anderson et al.

(10) Patent No.: US 11,291,883 B2
(45) Date of Patent: Apr. 5, 2022

(54) TILT-ENABLED BIKE WITH TILT-DISABLING MECHANISM

(71) Applicant: Nautilus, Inc., Vancouver, WA (US)

(72) Inventors: Todd D. Anderson, Vancouver, WA (US); Brian Venturella, Vancouver, WA (US); Jeffrey A. Gettle, Portland, OR (US); Edana French, Portland, OR (US); Marcus Marjama, Vancouver, WA (US); Edward L. Flick, Brush Prairie, WA (US); Dan Consiglio, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 17/122,861

(22) Filed: Dec. 15, 2020

(65) Prior Publication Data

US 2021/0197015 A1 Jul. 1, 2021

Related U.S. Application Data

(60) Provisional application No. 63/038,482, filed on Jun. 12, 2020, provisional application No. 62/953,688, filed on Dec. 26, 2019.

(51) Int. Cl.
*A63B 22/06* (2006.01)
*A63B 23/04* (2006.01)

(52) U.S. Cl.
CPC ..... *A63B 22/0605* (2013.01); *A63B 23/0476* (2013.01); *A63B 2022/0641* (2013.01)

(58) Field of Classification Search
None
See application file for complete search history.

(56) References Cited

U.S. PATENT DOCUMENTS 4,602,890 A * 7/1986 Duda ..... F16B 7/105 403/105
4,957,282 A * 9/1990 Wakefield ..... A63B 26/003 472/21
5,035,418 A 7/1991 Harabayashi
(Continued)

FOREIGN PATENT DOCUMENTS

KR 20190141571 A 12/2019
WO WO-2012146230 A1 * 11/2012 ..... A63B 22/001
WO 2019022331 A1 1/2019

OTHER PUBLICATIONS

International Search Report and Written Opinion for PCT Application No. PCT/US2020/066226, dated Jul. 1, 2021.

*Primary Examiner* — Sundhara M Ganesan
*Assistant Examiner* — Shila Jalalzadeh Abyaneh
(74) *Attorney, Agent, or Firm* — Dorsey & Whitney LLP

(57) ABSTRACT

A stationary bike capable of leaning of tilting side to side during use is described. The stationary bike has a fixed frame portion and moving frame portion which is pivotally mounted on the fixed frame portion, at two spaced apart pivot locations, to allow the moving frame to pivot about a pivot axis defined by the two spaced apart pivot locations. The pivotal action of the bike may be resisted, such as by a damper. The tilt-enabled bike is equipped with a tilt disabling mechanism, e.g., a locking mechanism configured to selectively and operatively engage the moving and the fixed frame to disable the relative movement (i.e. the pivoting) of the moving frame.

16 Claims, 32 Drawing Sheets

(56) References Cited

U.S. PATENT DOCUMENTS 5,265,969 A * 11/1993 Chuang ..... A45B 17/00 16/329
6,126,577 A * 10/2000 Chang ..... A63B 26/003 434/61
6,398,445 B1 * 6/2002 Matali Badia ..... F16B 7/105 403/109.6
7,364,533 B2 * 4/2008 Baker ..... A63B 22/0605 248/408
7,494,181 B2 * 2/2009 Tucker ..... B62J 1/005 248/298.1
7,682,286 B2 3/2010 Badarneh et al.
7,927,258 B2 4/2011 Irving et al.
7,963,889 B2 6/2011 Badarneh et al.
8,092,352 B2 1/2012 Irving et al.
8,104,987 B2 * 1/2012 Johnson ..... A63B 22/0605 403/104
8,985,888 B2 * 3/2015 Kawasaki ..... F16B 21/082 403/361
9,598,131 B2 * 3/2017 Zusy ..... B62K 3/06
10,238,913 B1 * 3/2019 Tung ..... A63B 22/0605
10,843,038 B1 * 11/2020 Gajewski ..... A63B 21/4033
2008/0238160 A1 * 10/2008 Huyck ..... A63B 22/0605 297/195.11
2008/0269025 A1 * 10/2008 Badarneh ..... A63B 21/4049 482/57
2009/0048076 A1 2/2009 Irving et al.
2009/0170667 A1 * 7/2009 Irving ..... A63B 23/0405 482/57
2010/0080650 A1 * 4/2010 Gorza ..... B62J 1/08 403/374.5
2011/0281694 A1 * 11/2011 Vujicic ..... A63B 22/0015 482/63
2012/0071301 A1 * 3/2012 Kaylor ..... A63B 22/0605 482/57
2012/0302403 A1 * 11/2012 Touret ..... A63B 22/0017 482/4
2013/0149029 A1 * 6/2013 Changsrivong ..... H01R 13/187 403/361
2016/0263430 A1 * 9/2016 Grochowina ..... A63B 22/02
2018/0104535 A1 * 4/2018 Zeng ..... A63B 22/0046

* cited by examiner

515

| | ROTATIONAL POSITION 513 | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| SWITCH 1 | 0 | 1 | 0 | 1 | 0 | 1 | 0 | 1 | 0 | 1 | 0 | 1 | 0 | 1 | 0 | 1 |
| SWITCH 2 | 0 | 0 | 1 | 1 | 0 | 0 | 1 | 1 | 0 | 0 | 1 | 1 | 0 | 0 | 1 | 1 |
| SWITCH 3 | 0 | 0 | 0 | 0 | 1 | 1 | 1 | 1 | 0 | 0 | 0 | 0 | 1 | 1 | 1 | 1 |
| SWITCH 4 | 0 | 0 | 0 | 0 | 0 | 0 | 0 | 0 | 1 | 1 | 1 | 1 | 1 | 1 | 1 | 1 |

TILT-ENABLED BIKE WITH TILT-DISABLING MECHANISM

CROSS-REFERENCE TO RELATED APPLICATION(S)

This application claims priority to U.S. Provisional Application Ser. No. 62/953,688, filed Dec. 26, 2019 and U.S. Provisional Application Ser. No. 63/038,482, filed Jun. 12, 2020, which provisional applications are incorporated herein by reference in their entirety for any purposes.

FIELD

The present disclosure relates generally to a stationary exercise machine and more specifically to a stationary bike which is selectively reconfigurable between a tilt-enabled stationary bike to a non-tiltable (or fixed) stationary bike.

BACKGROUND

A stationary exercise machine designed to simulate cycling is often referred to as stationary bike or spin bike. Such stationary bikes typically have a driven assembly including a crank wheel, a pair of cranks fixed to the crank wheel to drive rotation of the crank wheel and each terminating in respective pedal. The crank wheel is typically connected, via any suitable transmission member such as a belt or a chain, to a resistance mechanism, for example a magnetically or frictionally resisted flywheel. As such a stationary bike is able to simulate much of the physical exertion applied when a riding a bike, and thus provides a reasonably good cardiovascular exercise. However, because a stationary bike is more stable when used (due in part to being fixed to one or more non-moving frame(s)) than a real bicycle, a stationary bike may not be able to allow the user to engage certain muscle groups (e.g., the user's abdominal core and/or upper body) at all or to a same or similar extent as when riding a real bicycle. Therefore designers and manufacturers of exercise equipment continue to seek improvements in the field of stationary bikes.

SUMMARY

In various embodiments, a stationary bike is disclosed, which is selectively reconfigurable between a tilt-enabled stationary bike to a non-tiltable (or fixed) stationary bike.

Embodiments of a tilt-enabled exercise bike with a tilt disabling mechanism are described. In some embodiments, the exercise bike includes a first frame that remains substantially stationary with respect to a support surface, a second frame pivotally joined to the first frame and configured to support a user, the second frame pivoting relative to the first frame about a pivot axis in response to a force applied to the second frame by the user. The exercise bike further includes a locking mechanism operatively associated with the first and second frames and actuatable to an engaged state that prevents pivotal movement of the second frame relative to the first frame. In some embodiments, the locking mechanism comprises a pin coupled to one of the first and second frames and a corresponding hole that receives the pin, the hole being coupled to the other one of the first and second frames. In some embodiments, the pin may be coupled to the first or second frames such that it extends in a direction that intersects with the pivot axis and is selectively movable toward and away from the pivot axis. In some embodiments, the second frame is pivotally supported on the fixed frame by at least one pivot shaft that defines the pivot axis. In some embodiments, the pivot axis extends in substantially the same direction as the longitudinal axis of the exercise bike. In some embodiments, the second frame is pivotally supported on the fixed frame via a front pivot shaft and a rear pivot shaft axially aligned to define the pivot axis. In some embodiments, the locking mechanism selectively engages at least one of the one or more pivot shafts that pivotally couple the moving frame to the fixed frame (e.g. the front pivot shaft and/or the rear pivot shaft) to resist the rotation of the front pivot shaft or the rear pivot shaft. In some embodiments, the locking mechanism includes a friction brake operatively associated with the front pivot shaft or the rear pivot shaft. In some embodiments, the locking mechanism includes a magnetic brake operatively associated with the front pivot shaft or the rear pivot shaft. In some embodiments, the locking mechanism includes a block coupled to one of the first frame and the second frame and a wedge coupled to the other one of the first frame and the second frame, at least one of the block and the wedge being movably coupled to the respective frame to cause the at least a portion of the wedge to be received in a groove of the block when the block and the wedge are brought closer together for at least one position of the second frame relative to the first frame. In some embodiments, the block pivotally is coupled to the second frame and the wedge fixed to the first frame. In some embodiments, the block is pivotally coupled to one of the first frame and the second frame and the wedge is fixed to the other one of the first frame and the second frame, the locking mechanism being operatively associated with an actuator configured to pivot or slide the block toward and away from the wedge. In some embodiments, the actuator includes a spring connecting the actuator to the block for transmitting actuation force to the block. In some embodiments, the actuator is positioned on the bike such that it is accessible to the user while riding the bike. In some embodiments, the exercise bike further comprises a drive assembly including a crankshaft operatively associated with a pair of pedals configured to be driven by the user, the second frame being pivotally coupled to the first frame at a first pivot joint located forward of the cranks of and a second pivot joint located aft of the crankshaft. In some embodiments, the first frame includes a base having a front and rear stabilizers. In some embodiments, the pivot axis of the bike is inclined at an angle no greater than 45 degrees relative to a base plane passing through the front and rear stabilizers. In some embodiments, the exercise bike further include a damper that resists the pivotal movement of the second frame relative to the first frame. In some embodiments, the damper includes at least one spring operatively positioned to resist the pivotal movement of the second frame relative to the first frame. In some embodiments, the damper includes a first spring positioned vertically above the pivot axis and a second spring positioned vertically below the pivot axis. In some embodiments, each of the first and second springs are fixed to the second frame. In some embodiments, the bike further includes a display that remains stationary with respect to the first frame while the second frame pivots relative to the first frame. In some embodiments, the display is mounted on a mast fixed to and extends from the first frame. In some embodiments, the display is pivotally mounted to the mast, whereby pivoting of the display adjusts a viewing angle of the display. In some embodiments, the locking mechanism is operatively associated with an actuator configured for remote actuation.

An exercise bike according to some embodiments of the present disclosure includes a first frame that remains substantially stationary with respect to a support surface, a second frame pivotally joined to the first frame and configured to support a user, the second frame pivoting relative to the first frame about a pivot axis in response to a fierce applied to the second frame by the user, and a display mounted on a structural member fixed to and extending from the first frame. In some embodiments, the display is pivotally mounted on the structural member. In some embodiments, the exercise bike further includes an arm having a first end pivotally coupled to the mast and wherein the display is coupled to a second end of the arm opposite the first end. In some embodiments, the arm is curved along at least a portion of the arm between the first end and the second end, and the arm may be slidably or pivotally coupled to the structural member. In some embodiments, the structural member may be a mast. In some embodiments, the exercise bike may further include a locking mechanism operatively associated with the first and second frames and actuatable to an engaged state that prevents pivotal movement of the second frame relative to the first frame. In some embodiments, the locking mechanism includes a pin coupled to one of the first and second frames and a corresponding hole that receives the pin, the hole being provided by a structure coupled to the other one of the first and second frames. In some embodiments, the second frame is pivotally supported on the fixed frame by at least one pivot shaft that defines the pivot axis. In some embodiments, the locking mechanism is operatively associated with the at least one pivot shaft to substantially prevent rotation about the pivot axis in at least one state of the locking mechanism. In some embodiments, the locking mechanism includes a block coupled to one of the first and second frames and a wedge coupled to the other one of the first and second frames, at least one of the block and the wedge being movable toward the other one of the block and the wedge to provide the locking mechanism in an engaged position in which the block interferes with the wedge.

An exercise bike system according to some embodiments includes a first bike frame that remains substantially stationary with respect to a support surface, a second bike frame pivotally joined to the first frame and configured to support a user, the second frame pivoting relative to the first frame about a pivot axis in response to a force applied to the second frame by the user, and at least one sensor attached to either the first or second bike frame. The exercise bike system further includes a transceiver attached to either the first or second bike frame and in communication with the sensor, a stand unattached to either of the first and second bike frames, and a display supported by the stand and in communication with the transceiver, the display remaining stationary with respect to the first bike frame while the second bike frame pivots relative to the first bike frame. In some embodiments, the at least one sensor includes a cadence sensor, a power sensor, a position sensor, or a tilt sensor, in some embodiment, the sensor is operatively associated with pivot axis to measure an amount of rotation of the second bike frame relative to the first bike frame. In some embodiment, the exercise bike system further includes a locking mechanism operatively associated with the first and second bike frames and actuatable to an engaged state that prevents pivotal movement of the second bike frame relative to the first bike frame.

An exercise bike according to some embodiments includes a first frame that remains substantially stationary with respect to a support surface, a second frame pivotally joined to the first frame and configured to support a user, wherein the second frame pivots relative to the first frame about a pivot axis in response to a force applied to the second frame by the user, and a display mounted on a structural member fixed to and extending from the first frame. In some embodiments, the display is pivotally mounted on the structural member. In some embodiments, the structural member comprises a mast. In some embodiments, the exercise bike further comprises an arm having a first end pivotally coupled to the structural member and wherein the display is coupled to a second end of the arm opposite the first end. In some embodiments, the arm is curved along at least a portion of the arm between the first end and the second end, and wherein the arm is slidably or pivotally coupled to the structural member. In some embodiments, the exercise bike further comprises a locking mechanism operatively associated with the first and second frames and actuatable to an engaged state that prevents pivotal movement of the second frame relative to the first frame. In some embodiments, the locking mechanism comprises a pin coupled to one of the first and second frames and a corresponding hole that receives the pin, wherein the hole is coupled to the other one of the first and second frames. In some embodiments, the second frame is pivotally supported on the first frame by at least one pivot shaft that defines the pivot axis. In some embodiments, the locking mechanism is operatively associated with the at least one pivot shaft to substantially prevent rotation about the pivot axis in at least one state of the locking mechanism. In some embodiments, the locking mechanism comprises a block coupled to one of the first and second frames and a wedge coupled to the other one of the first and second frames, wherein at least one of the block and the wedge is movable toward the other one of the block and the wedge to provide the locking mechanism in an engaged position in which the block interferes with the wedge A tilt-enabled exercise bike according to further embodiments includes a drive assembly including a crankshaft and a pair of pedals, each coupled to an opposite side of the crankshaft, for rotation of the crankshaft by a user, and a frame rotatably supporting the crankshaft. The frame includes a base that supports the exercise bike on a support surface, the base having first and second lateral ends disposed on opposite sides of the frame that move relative to the supports surface when the user is rotating the crankshaft, and the tilt-enabled exercise bike further includes a tilt-disabling mechanism operatively associated with the base to disable the movement of the first and second lateral ends relative to the support surface. In some embodiments, the base includes at least one curved member having a convex side that contacts the support surface whereby the opposite lateral ends of the curved member are spaced from the support surface, and the tilt-disabling mechanism includes at least one adjustable member movably coupled to each of the opposite lateral ends and adjustable to contact the support surface. In some embodiments, the at least one adjustable member comprises a spring element fixedly coupled to a midpoint of the curved member and extending lengthwise along the curved member to at least one of the lateral ends of the curved member, the spring element being movable relative to the lateral end for adjusting a distance between the spring element and the lateral end. In some embodiments, the at least one adjustable member includes an adjustable foot coupled to one of the lateral ends of the curved member. In some embodiments, the adjustable foot is movable along a length of the curved member. In some embodiment, the tilt-disabling mechanism includes at least one compressible foot coupled to each of the first and second lateral ends. In some embodiments, the one or more compressible feet may be implemented using a reversibly compressible (e.g., compliant or resilient) element such as a spring.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

The drawings are not necessarily to scale. In certain instances, details unnecessary for understanding the disclosure or rendering other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The claimed subject matter is not necessarily limited to the particular examples or arrangements illustrated herein.

DETAILED DESCRIPTION

The present disclosure pertains to a stationary bike which is adapted to operate in a tilt-enabled (or tilting) mode in which a portion of the bike frame moves (e.g., tilts) relative to another, fixed portion of the frame. As such, a bike according to the present disclosure may be referred to as a tilt-enabled bike or simply tilting bike. The tilt-enabled bike is equipped with a locking mechanism that re-configures the tilt-enabled stationary bike to a non-tilting (or fixed) bike. In some embodiments, the locking mechanism may include a movable locking member supported on either the moving frame or the fixed frame(s) and selectively operable (e.g., movable) to a position in which the movable locking member engages a cooperating structure on the other one of the moving frame or the fixed frame(s) to interfere with the pivoting (or tilting) of the moving frame thus reconfiguring the bike into a fixed stationary bike.

Figure 1:
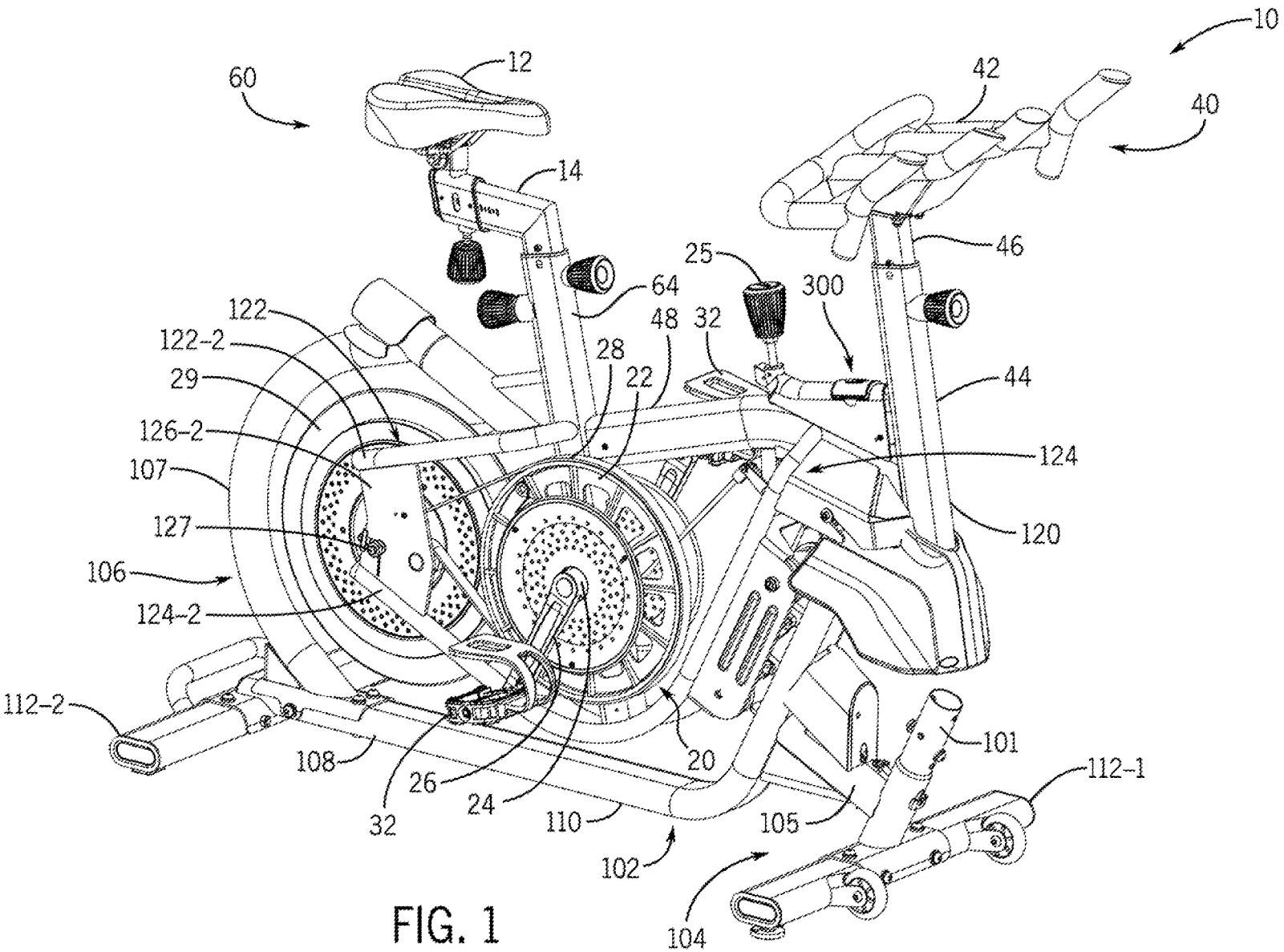
FIG. 1 is an isometric view of a stationary bike according to the present disclosure.
Figure 2:
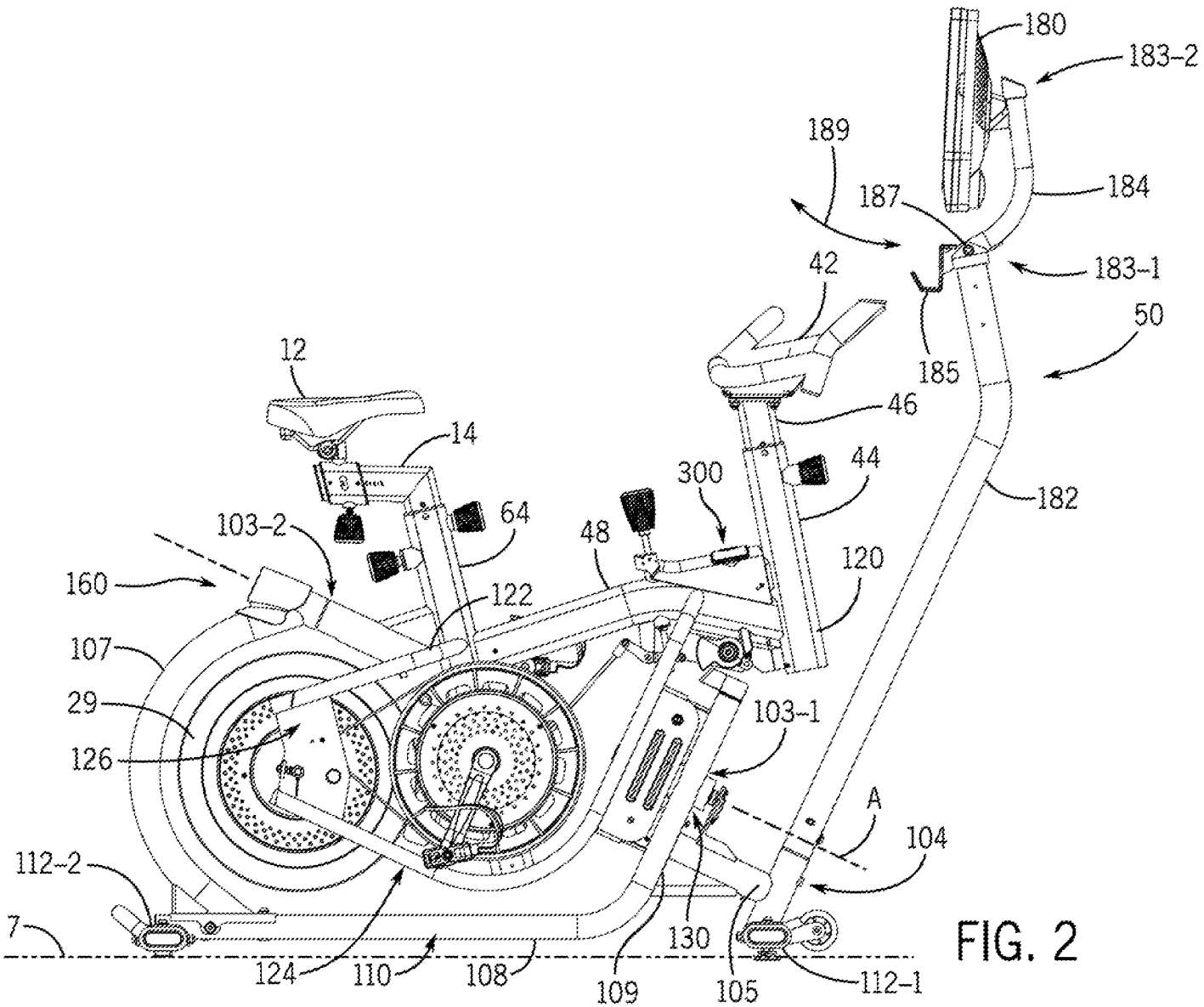
FIG. 2 is a side view of the bike of FIG. 1 shown here with a console mounted to the fixed frame.
Figure 3:
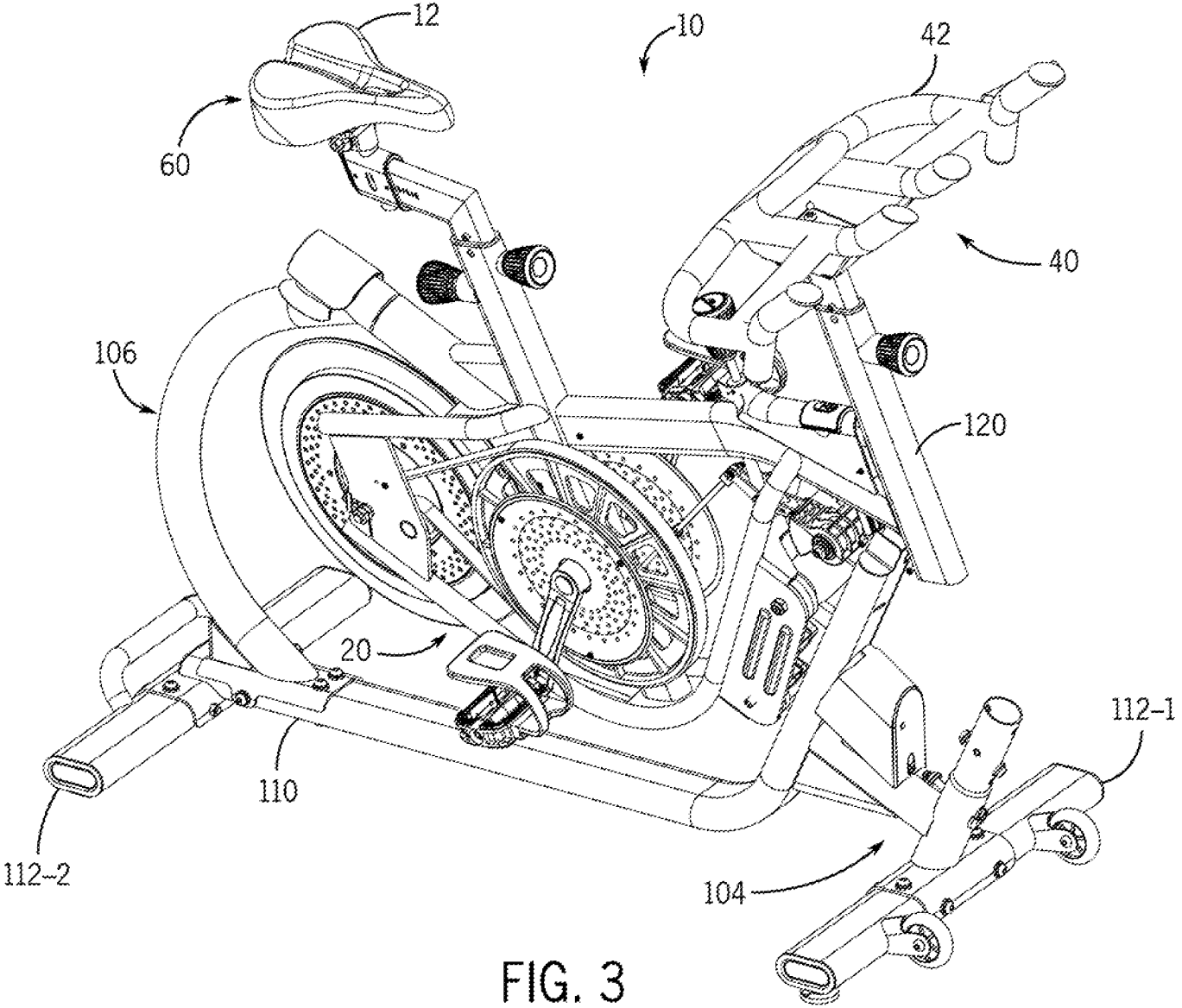
FIG. 3 is another isometric view of the bike in FIG. 1 shown here with the bike in a tilted position.

With reference to FIGS. 1 and 2, a stationary (exercise) bike 10 according to the present disclosure may include one or more frame(s) 102 which operatively support the various moving components of the bike 10. The one or more frame(s) 102 may include one or more first frame portion(s) 110, also referred to as stationary or fixed frame(s) 110, configured to remain substantially stationary during use of the bike 10, whether the bike is in tilt-enabled or tilt-disabled mode. In some embodiments, stationary frame(s) 110 may be configured to be placed, and thus to support the bike 10, on a support surface (e.g., on the ground). The one or more frame(s) 102 may also include a second frame portion 120, interchangeably referred to as a moving, pivoting, or tilting frame 120. The moving frame 120 is movably (e.g., pivotally) coupled to the one or more fixed frame portions 110 at one or more (e.g., two) pivot locations to enable the moving frame 120 and any components of the stationary bike that are carried on the moving frame, such as the seat 12, crank wheel 22, flywheel 29, and pedals 32, to move (e.g., pivot, tilt, or roll) with the moving frame 120 about a pivot or tilt axis A.

The stationary frame 110 may define two mourning locations, a front mounting location 103-1 and a rear mounting location 103-2, at which the moving frame 120 is movably mounted (or suspended) on the stationary frame 110. The mounting locations may define the tilt axis A. In other embodiments, the moving frame 120 may be pivotally mounted on the stationary frame 110 using a different number of mounting locations, for example a single mounting location (e.g., on a single pivot axis), which may define the pivot axis A of the bike. Any suitable pivotal joint that allows the moving frame 120 to pivot, with or without resistance, relative to the fixed frame 110 may be used to pivotally mount the moving frame 120 to the stationary frame 110, e.g., at the mounting locations 103-1 and 103-2.

The stationary frame 110 may include a front stabilizer 112-1 and rear stabilizer 112-2, such as a pair of spaced apart transverse beams. The front and rear stabilizers may be implemented using a generally straight transversely extending beams or may any have other suitable geometry that provides a stable base for the bike 10. The front stabilizer 112-1 and the rear stabilizer 112-2 support upwardly extending frame members (e.g., a front frame section 104 and a rear frame section 106) that pivotally support the moving frame 120 at respective front and rear mounting locations 103-1 and 103-2. The front frame section 104 may define the front mounting location 103-1 at a vertical position below the rear mounting location 103-2 defined by the rear frame section 106, such that the tilt axis A is inclined to the horizontal (e.g., ground 7) with the front end of the tilt axis A located closer to the ground 7. In other examples, the front and rear frame sections may be differently configured, for example to define a tilt axis that is substantially parallel to the horizontal or inclined in the opposite direction (i.e., with the rear end of the tilt axis closer to the ground). In yet other examples, the fixed frame 110 may include a plurality of fixed frame portions, such as a front fixed frame and a rear fixed frame that may not be connected to one another. In some embodiments, the fixed frame 110 may be arranged at the front or the rear end of the bike and be configured to support and suspend the moving frame 120 via only a single pivot (e.g., a front pivot or a rear pivot). Other arrangements may be used in other embodiments.

Referring to the example in FIGS. 1 and 2, the front frame section 104 may include one or more frame members (e.g., tube 105), extending upward and/or rearward of the front stabilizer 112-1. The front frame section 104 may include an upright mount 101 fixed and extending upward from the front stabilizer 112-1 and a tube 105 fixed to and extending rearward from the mount 101. The terms "fixed" or "fixedly mounted" imply a connection between components that is intended to be non-movable when the bike 10 is in use. The front frame section 104 pivotally supports the front end 121-1 of the moving frame 120 as will be further described. The rear frame section 106 may include one or more frame members (e.g., curved tube 107), extending upward and/or forward of the rear stabilizer 112-2. Additionally and optionally, the fixed frame 110 may include one or more longitudinal frame members (e.g., longitudinal beam 108) that extend between the front and rear stabilizers and/or the front and rear frame sections to connect the front frame section 104 to the rear frame section 106, shown here as a curved tube 107. While one or more of the frame members of the bike 10 are described as tubes or tubular members, any type of structural member that can carry the relevant loads (e.g., tension, compression, bending, and shear loads) may be used for implementing the frame of the bike 10. For example, any of the tubular members of the frame may be replaced with a beam having a different cross section, which may not be an enclosed section, such as a U-shaped, T-shaped, I-shaped or differently shaped beam. Moreover, the term tube or tubular member does not necessarily imply a cylindrical tube but may include tubes having other transverse cross-sections such as rectangular, oval, triangular or other regular or irregular cross-sectional geometries.

To enable a user to perform exercise which simulates cycling, the bike 10 may include a seat 12 to support the user in a seated position, a handlebar to support a portion of the user's upper body (e.g., the user's hands and/or forearms), and a drive assembly 20 including a pair of pedals 32 configured to support and guide the user's feet in a cyclical motion. The moving frame 120 may include a front post or tube 44 that supports the handlebar 42. In some examples, the handlebar 42 may be adjustably coupled to the front post or tube 44. For example, the handlebar 42 may be coupled to a handlebar post 46 selectively movably received in the front tube 44 for adjusting the vertical position of the handlebar 42. In other examples, the handlebar 43 may, alternatively or additionally, be adjustable in a different direction (e.g., horizontally). In yet other examples, the position of the handlebar 42 on the moving frame 120 may be fixed, such as by being rigidly coupled to the front post or tube 44. Regardless of whether the handlebar 42 is fixed or adjustably coupled to the front tube 44, the handlebar 42 may remain stationary with respect to the moving frame 120 when the moving frame 120 pivots in relation to the fixed frame 110. In some embodiments, the handlebar 42 may be coupled to the moving frame 120 such that it is movable (e.g., pivotable about the axial direction of the tube 44) independently of or dependently upon movement of the moving frame 120).

The moving frame 120 may also include a rear post or tube 64, which supports the seat 12 and may thus also be referred to as seat tube 64. In some embodiments, the seat 12 is adjustable relative to the rear post or tube 64. For example, the seat 12 may be coupled, in some cases adjustably, to a seat post 14, which is coupled, in some cases also adjustably, to the rear post or tube 64. The front post 44 and the rear post 44 may be suitably spaced apart (e.g., by center or top tube 48) to accommodate a human user in a seated position. In the illustrated example, the center tube 48 extends between the front tube 14 and the rear tube 64, with the front and rear tubes 44 and 64, respectively, being fixed to opposite ends of the center tube 48. The handlebar 42 and/or the seat 12 may be adjustable relative to other components of the moving frame 120 (e.g., relative to the center tube 48) so as to further tailor the seated position provided on the moving frame to a particular user.

The drive assembly 20 may include a crankshaft 24 rotatably supported on the moving frame 120. Left and right crank arms 26 may be fixed to opposite ends of the crankshaft 24. The crank arms 26 may extending generally transverse to, and in radially opposite directions from, the crankshaft 24. A pedal 32 is pivotally coupled at the terminal end of each crank arm 26 and configured for engagement by a user's foot. In some embodiments, the crank wheel 22 may be fixed to the crankshaft 24 such that the crank wheel 22 rotates synchronously with the crankshaft 24. The rotation of the crankshaft 24 may be resisted by a resistance mechanism 30, such as a frictionally-resisted or magnetically resisted flywheel 29. The resistance mechanism 30 may be operatively associated with the crankshaft 24, for example by one or more transmission elements 28 (e.g., a belt or chain), operatively connecting the crank wheel 22 to the rotation axis of the flywheel 29 such that the resistance to rotation of the flywheel is transmitted to the crank wheel 22 and thus to the crankshaft 34 and pedals 32. Like other stationary bikes, the resistance to rotation of the pedals 32 may be adjustable, for example via resistance knob 25 operatively engaged with the brake mechanism (e.g., a magnetic brake, such as an eddy current brake, or a friction brake) associated with the flywheel 29 to enable the user to increase or decrease the resistance to rotation applied to the flywheel 29.

Figure 4B:
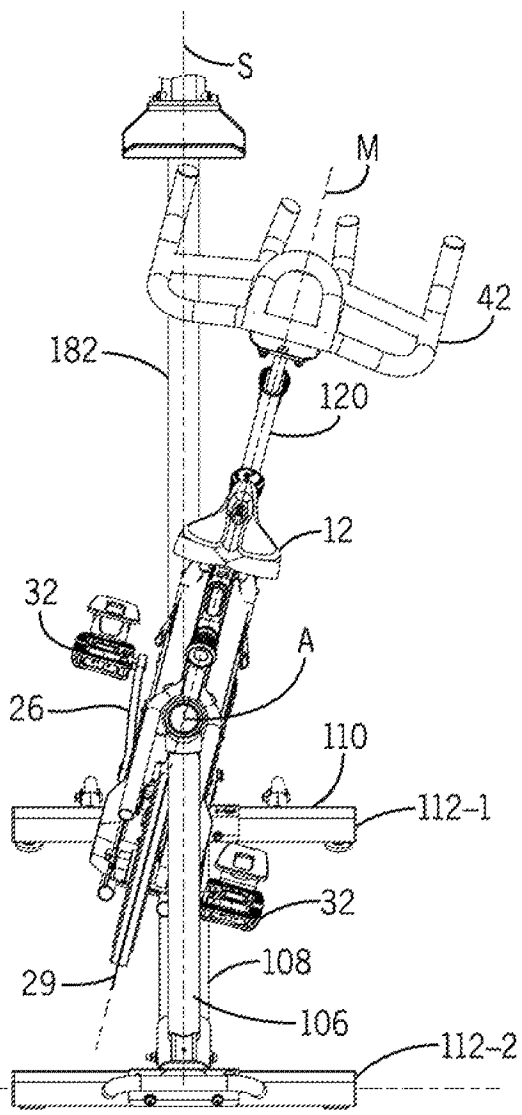
FIGS. 4A and 4B show rear downward views of the bike in FIG. 1, showing the bike in an un-tilted (nominal) position and a tilted position, respectively.
Figure 4A:
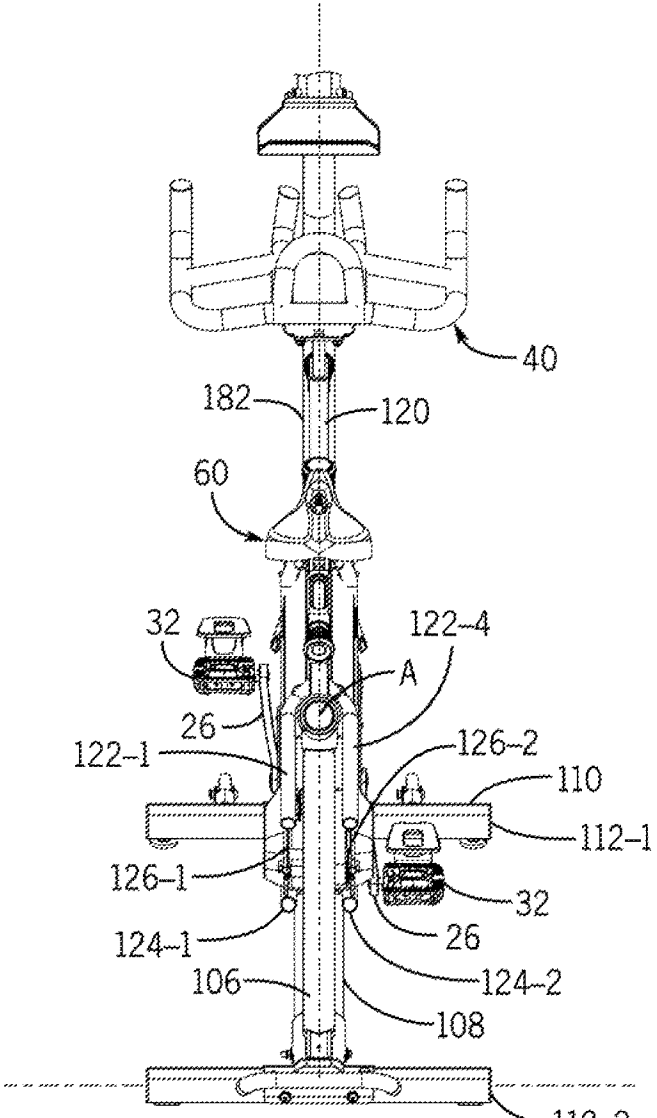

The moving frame 120 may be implemented using any suitable combination of structural members that can carry the loads applied thereto, such as by the user and the movable components of the bike 10. For example as shown in FIGS. 1, 2 and 4A, the moving frame 120 may include a rearwardly extending frame member, shown here as a rear fork 122 that extends generally rearward of the rear tube 64. The rear fork 122 may include first (e.g., left) and second (e.g., right) rear fork members 122-1 and 122-2, each of which extends from the rear tube 64 toward the rear end of the bike along an opposite side of the flywheel 29, such that the rear fork 122 straddles the flywheel 29. A front fork 124 may be fixed to and extend generally downward from the top tube 48. The front fork 124 may similarly have a first (e.g., left) front fork member 124-1 and second (e.g., right) front fork members 124-2 that extend on opposite sides of the bike 10. The front fork 124 extends to and is fixed to the lower end of the rear tube 64, thereafter curving upward and extending rearward towards the rear end of the rear fork 122. The respective sides of the front and rear forks may be connected to provide a support (e.g., a mount) for the flywheel 29, which in this example is also carried on the moving frame 120. In other examples, the moving frame may be differently configured. For example, a rearwardly extending frame member of the moving frame 120, which supports the flywheel, may extend only along one side of the mid-plane of the bike (e.g., along the right side or the left side), and the flywheel 29 may be supported on a cantilevered shaft off the rearwardly extending frame member. Similarly, a front portion of the moving frame 120 may include one or more downwardly and/or forwardly extending frame members that is substantially centrally located (e.g., along the mid-plane) or which extend along only one side of the mid-plane of the bike. In the illustrated example, the free ends of the left front fork member 124-1 and the left rear fork member 122-1 are connected via a left flywheel mount, shown here as left plate 126-1, and the free ends of the right front fork member 124-4 and the right rear fork member 122-2 are connected via a right flywheel mount, shown here as right plate 126-2. A flywheel shaft 127 may extend between the left and right flywheel mounts (e.g., between the left and right plates 126-1 and 126-2, respectively) to rotatably support the flywheel 29. The flywheel shaft 127 may be rotatably coupled to the frame 120 via one or more one-way bearings 129 to transmit the rotation of the pedals in only one direction. Rotation of the flywheel thus remains unaffected when the pedals are rotated in the opposite direction and/or not rotated at all.

The tilting portion of the bike (e.g., moving frame 120 and components carried on the moving frame 120), may be mounted on the fixed frame 110 via a pair of spaced-apart pivot joints. Focusing on FIGS. 2 and 5, a first (or front) pivot joint 130 may be located at the front mounting location 103-1 and a second (or rear) pivot joint 160 may be located at the rear mounting location 103-2, which suspends the moving portion of the bike 10 onto the fixed frame 110 allowing it to pivot (or tilt or roll) about the tilt axis A. Referring also to FIG. 6A, the rear pivot joint 160 may be implemented using a rear pivot shaft 162, which is joined to a rear portion 163 of the moving frame 120 and rotatably coupled (e.g., using one or more bearings 165) to a tubular housing 164 fixed to the rear frame section 106. In other examples, this arrangement may be reversed. In other words, the rear pivot shaft 162 may be fixed to the fixed frame 110 (e.g., to the rear frame section 106) and may be rotatably received in a tubular housing of the moving frame 120.

Figure 5:
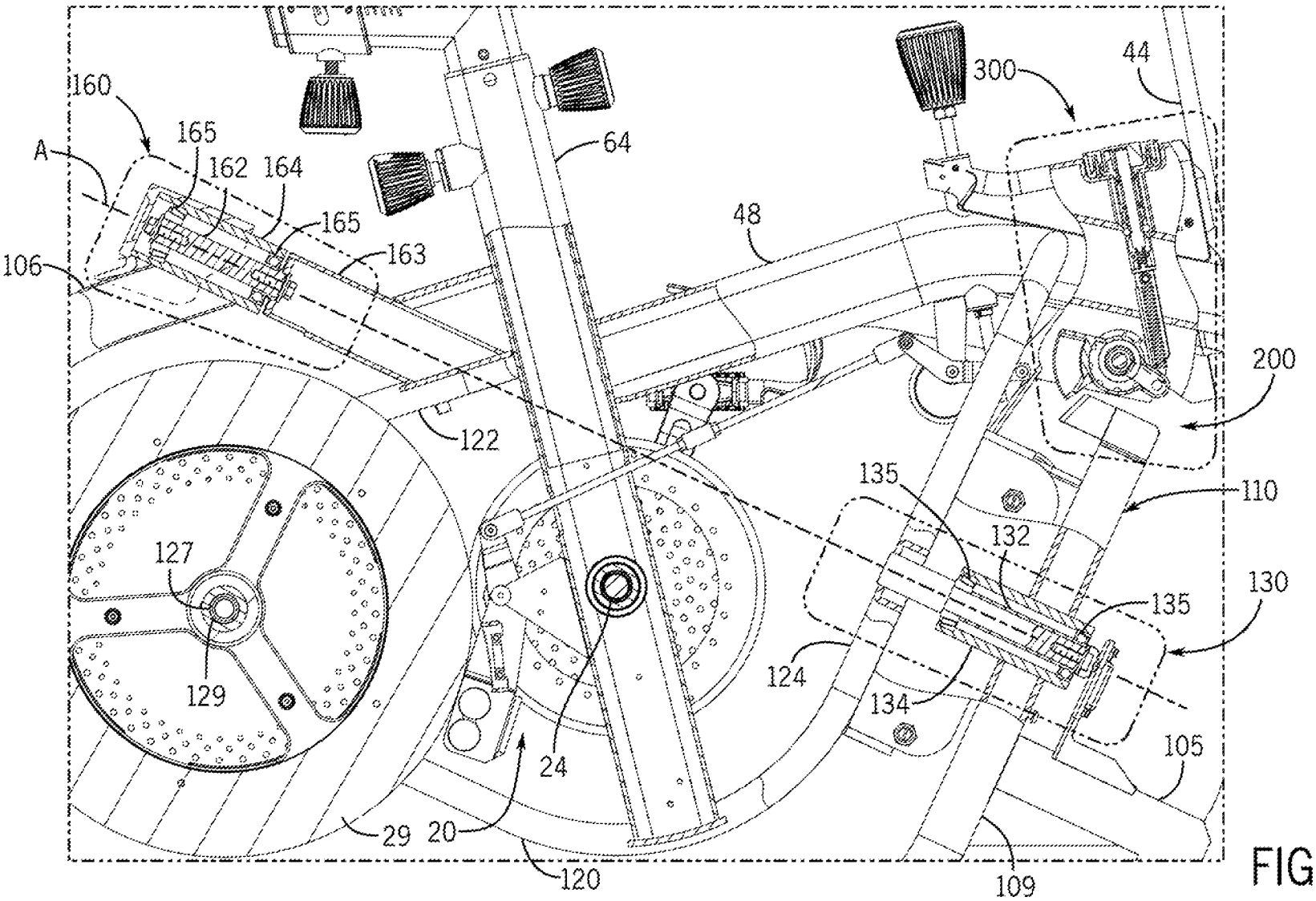
FIG. 5 is a partial cross-sectional view taken at line 5-5 in FIG. 1, illustrating the front and rear pivot joints and the tilt axis of the moving frame.
Figure 6A:
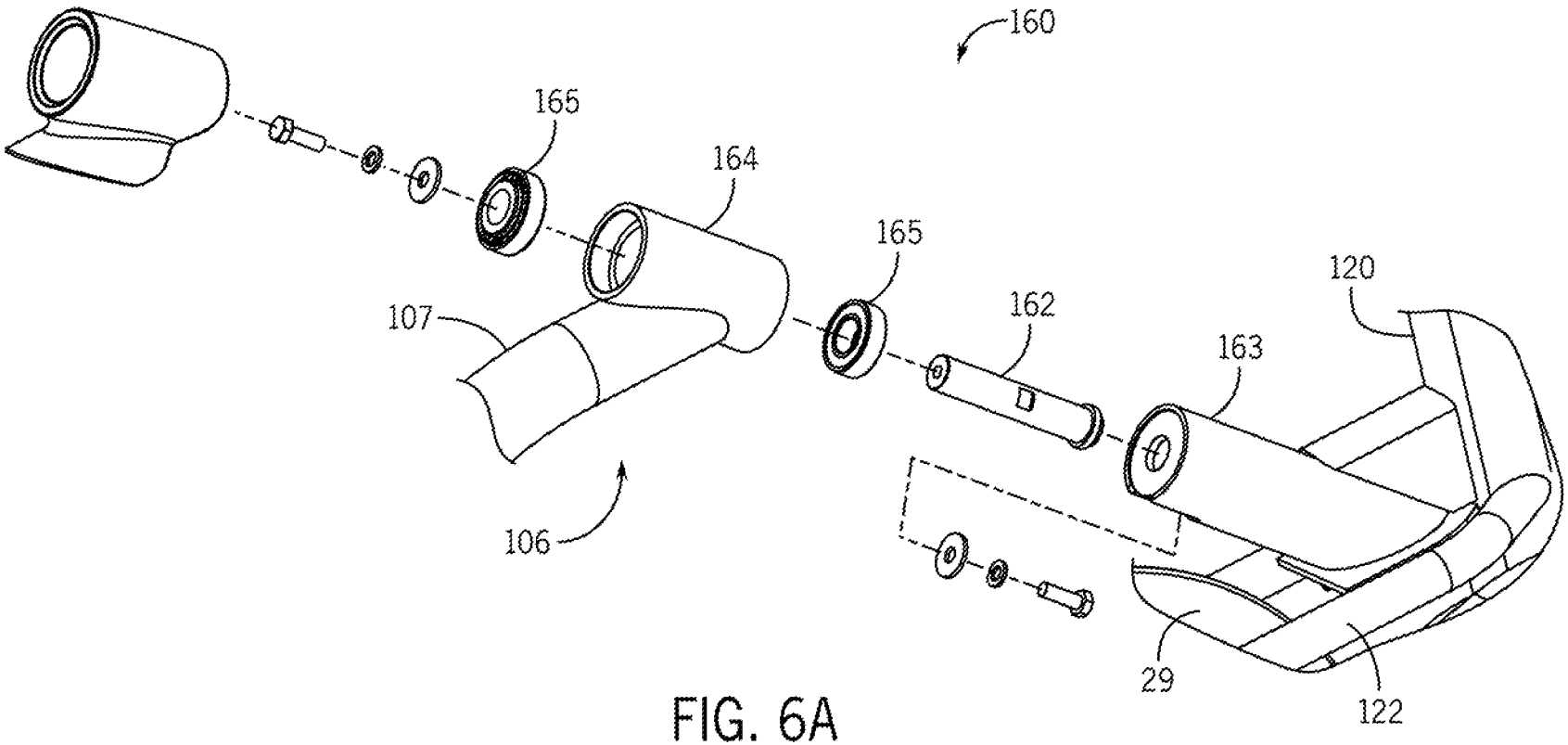
FIG. 6A shows an exploded view of the rear pivot joint of the bike in FIG. 1, as indicated by detail line 6A-6A in FIG. 5.
Figure 6B:
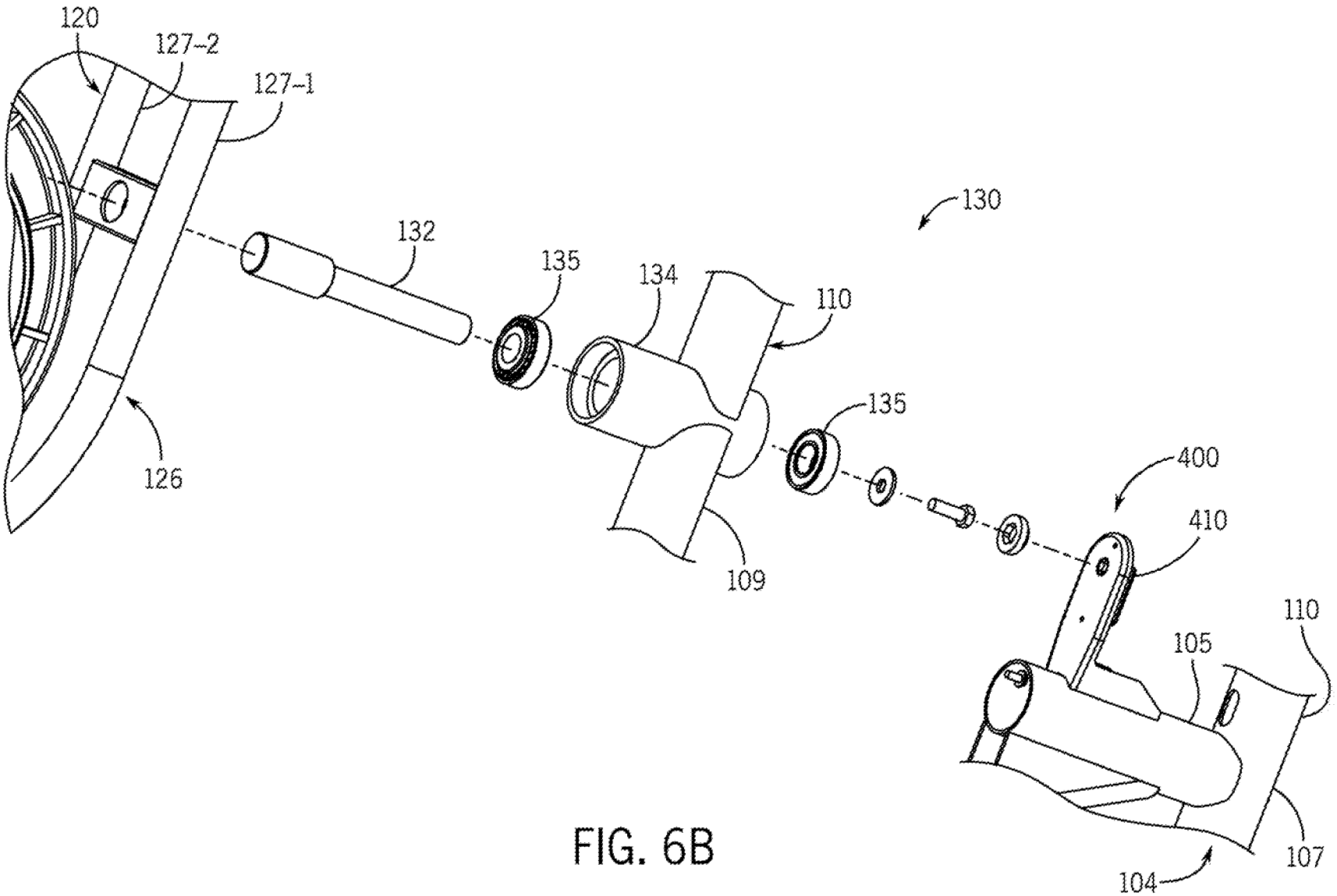
FIG. 6B shows an exploded view of the front pivot joint of the bike in FIG. 1, as indicated by detail line 6B-6B in FIG. 5.

With reference to FIGS. 5 and 6B, the front pivot joint 130 may be implemented using a front pivot shaft 132 fixed to the moving frame 120 and long-ably received (e.g., via one or more bearings 135) within a tubular housing 134 fixed to the stationary frame 110. Similar to the rear pivot, the location of the front pivot shaft and housing that rotatably receives the front pivot shaft may be reversed as between the moving and stationary frames. Any other suitable pivot joint may be used to pivotally couple the front and rear portions of the moving frame to respective front and rear portions of the fixed frame to suspend the bike in space allowing it to pivot, with or without resistance, about a tilt axis connecting the two mounting locations.

In the specific illustrated example, the tubular housing 134 associated with the front pivot joint 130 is fixed to an upward extension 109 of the longitudinal beam 108 that connects the front and rear frame sections 104, 106, respectively. The upward extension 109 is inclined to horizontal (e.g., to the horizontal plane defined by the front and rear stabilizers) at an angle that substantially matches the incline of the from fork 124 such that the upward extension 109 and the front portion of the front fork 124 are substantially parallel to one another. The front pivot shaft 132 may be joined to and extend from (e.g., substantially perpendicularly to) the front fork 124 toward the upward extension 109. In other examples, this may be reversed and the front pivot shaft 134 may instead be fixed to the fixed frame 110 and rotatably coupled to a component on the moving frame 120.

In some embodiments, the bike 10 may include a tilt measurement apparatus 400. The tilt measurement apparatus 400 may include a sensor 410 operatively engaged with the moving frame 120 to measure the amount of tilt (e.g., a tilt angle, which corresponds to the angle between the plane M of the moving frame (also referred to as moving plane M) when the moving frame is in any given tilted position and the plane S of the fixed frame (also referred to a fixed plane)). In some examples, the sensor 410 may be a magnetic rotary position sensor, which may be fixed to the fixed frame 110 (e.g., carried on a sensor board mounted to the fixed frame 110). A magnet (not shown) may be fixed to the moving frame 120, for example to the front pivot shaft 132, e.g., at a location in front of the upward extension 109 such as at a forward most end of the front pivot shaft 132. The magnet, which is fixed in a predetermined orientation with respect to the moving frame, for example in an orientation that aligns its N-S direction to lie within or perpendicular to the moving plane M, would thereby rotate in synchrony with the shaft 132. As the moving frame 120 tilts out of the fixed plane S, the change in the magnetic field orientation generated by the magnet is measured by the sensor 410 to determine the tilt angle, i.e. the angle between the moving plane M and the fixed plane S. Other types of sensors may be used in other examples, such as, and without limitation, a coded wheel, an optical interrupt sensor, a rotary potentiometer (non-magnetic), accelerometer, gyro, a linear potentiometer, or combinations thereof.

Figure 33A:
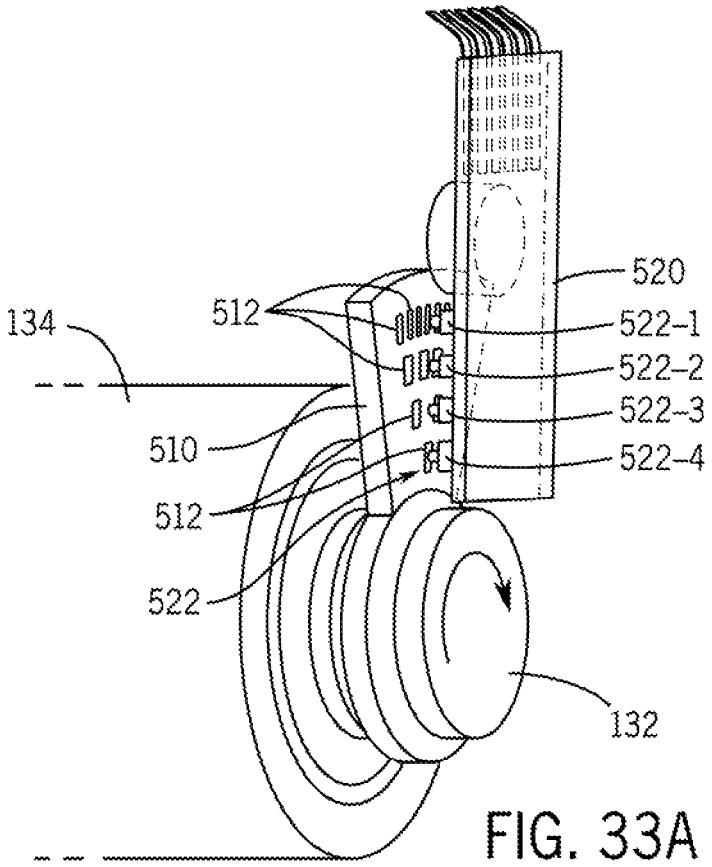
FIGS. 33A and 33B show illustrations of a coded wheel tilt sensor for a tilt-enabled bike according to the present disclosure.
Figure 33B:
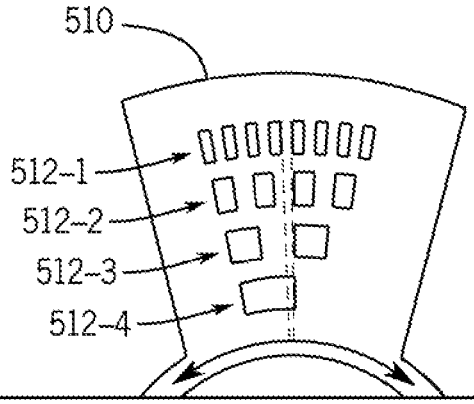

In other embodiments, the tilt sensor 410 may be implemented using a coded wheel sensor arrangement, as shown for example in FIGS. 33A and 33B. The sensor arrangement 500 includes a wheel 510 mounted to one of the fixed frame or the moving frame, and a sensor board 520 mounted to the other one of the fixed frame and the moving frame. In this example, the sensor board 520 is mounted on the fixed frame and the wheel 510 is mounted to the moving frame, and more specifically to front pivot shaft 132. In other examples, the wheel 510 may be associated with another one of the pivot shafts (e.g., rear pivot shaft 162), or may instead be mounted to the fixed frame while the board 520 is mounted to the moving frame.

The wheel 510 defines a plurality of coded positions 512 arranged at different radial locations along the wheel, each of the coded positions operable to activate or deactivate a switch when aligned therewith. The wheel 510 is shown here as relatively rigid plate that spans only that portion of a full wheel or circle that encompasses the tilt range of the bike. In other embodiments, the wheel 510 may be differently configured (e.g., having a different shape and/or positioning with respect to the pivot shaft 132 such as by extending in a different radial direction therefrom. The sensor board 520 includes a plurality of switches 522 which can interact with the coded positions on the wheel 510 to be switched between an ON state and an OFF state. In some examples, the switches 522 may be contact switches, which turn ON or OFF upon contact with a respective one of the coded positions 512. In other examples, the coded wheel 540 may define a plurality of windows which activate or deactivate photo interrupt switches. Various other types of switches may be used. The plurality of switches 522 may be arranged in a line that extends radially from the pivot axis A. For example, the switches 522 may be arranged to lie in the plane with respect to which rotational displacement (or tilt) is being measured, in this case the switches lie in the fixed plane S. The coded positions 512 on the wheel 510 may be arranged along the surface of the wheel 510 that faces the switches 522 in an array that results in an unique combination of switches 522 being activated at any given rotational position, and thus at any given tilt angle, of the front pivot shaft 132 with respect to the fixed frame. As such, the wheel 510 is configured to a unique angular position switch code at any given angular position of the wheel 510 with respect to the line of switches 522.

Figure 34:
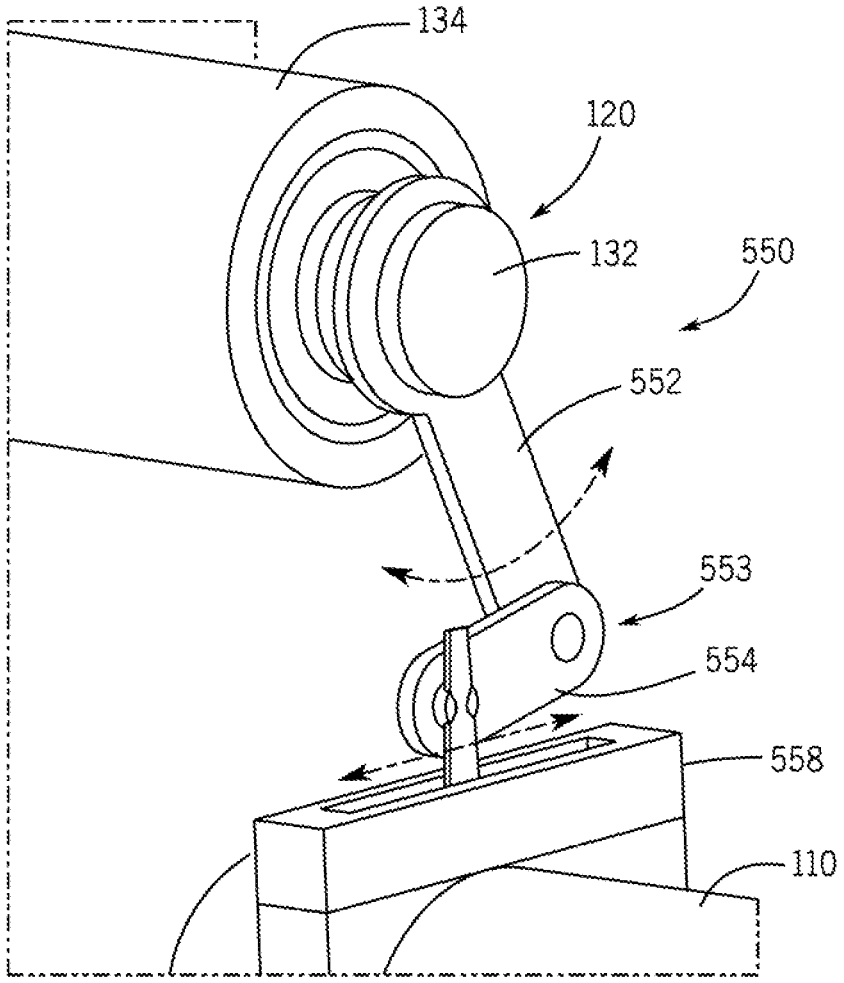
FIG. 34 shows a linear potentiometer tilt sensor for a tilt-enabled bike according to the present disclosure.

As an example, and referring also to FIG. 33B, the wheel 510 may include 4 rows of coded positions 512, referred to for the purposes of this explanation as switch windows but not necessarily to imply a through passage. The first row of coded positions includes 8 coded positions or windows 512-1 equally, spaced from one another by a first distance, which may be substantially equal to the width of each window 512-1. The second row has 4 coded positions or windows 512-2, which are wider than the first windows 512-1. Each of the second windows 512-2 is about twice the width of a first window, the second windows being spaced from one another by a second distance greater than the first distance (e.g., a distance substantially equal to the width of the second windows 512-2). The third row has two coded positions or windows 512-3, each of which is about twice the width of a second window 512-2 and which are spaced apart by a third distance greater than the second distance (e.g., a spacing distance equal to about twice the width of the third window 512-3). The fourth row includes a single coded position or window 512-4 having a width of about twice the width of a third window 512-3. The first coded position in each row are aligned in the radial direction, with the rest of the coded positions being arranged, based upon the above described relationships, in a manner that defines at least 16 unique combinations of active/inactive switches and thus 16 uniquely discernable rotational positions 513, as shown in the switch code table 515. As such, one of 16 unique rotational of tilt angle values may be determined based upon the unique switch combination output by the coded wheel sensor. In the specific example in FIG. 33B, the coded wheel 510 is oriented in relation to the line of switches (e.g., switches 522-1 through 522-4) such that the first, second, and third switches (522-1 through 522-3) do not align with a coded position and thus, in this example, register as inactive (or OFF state with a switch value of 0), while the fourth switch 522-4 is aligned with a coded position, shown here as overlapping a portion of the fourth window 512-4, and thus registering as active (or ON state with a switch value of 1). This coded position may be used to designate the nominal (or un-tilted) state of the bike. The number and arrangement of coded positions on the wheel 510 in this example is provided for illustration only and any other suitable combination, including a different (e.g., greater or fewer) number of coded positions in different arrangements along the face of the wheel 510 may be used to achieve any desired number of unique switch combinations In another embodiment, the tilt sensor 410 may be implemented using a linear potentiometer type sensor, an example of which is shown in FIG. 34. In this example, the linear potentiometer is implemented using a rotating arm linkage 550 operatively coupled to the moving frame 120. The rotating arm linkage 550 includes a first link 552 fixed to and extending radially from the pivot shaft 132 such that the radial end of the link 552 pivots about the axis of the shaft 132 in synchrony with the shaft 132. A second link 554 optionally connects the radial end of the first link to a linear potentiometer type sensor 558 (e.g., a slide pot). For example, a second link 554 may be connected to the radial end of the first link 552 such that the second link 554 swings along an arc defined by the radial end of the first link 552 as the first link 532 pivots with rotation of the shaft 132. The free end of the second link 554 is operatively engaged with a linear potentiometer type sensor 558 (e.g., a slide pot). In other embodiments, the radial end 553 may be operatively engaged with the linear potentiometer 558 in a different manner, e.g., by directly and/or compliantly coupling the radial end 553 to the linear potentiometer 558.

Referring back to FIGS. 4A, 4B, and 5, the tilt-enabled bike 10 may be equipped with a locking mechanism 200 operatively arranged to convert the bike 10 from a tilting stationary bike to a non-tilting (or fixed) stationary bike, and vice versa. The locking mechanism 200 may be operatively associated with an actuator 300, such as the actuator 301 shown for example in FIGS. 7A, 7B, and 8A, the actuator 321 shown for example in FIGS. 7C, 7D and 8B, or another suitable actuator. The actuator 300 may be configured for local or remote actuation or activation to engage and disengage the locking mechanism 200. In use, when the locking mechanism 200 is disengaged, the bike 10 is operable to tilt or lean from side to side. FIG. 4A shows the bike 10 in neutral (or non-tilted) state or position, in which the mid-plane M of the moving portion of the bike 10 (e.g., moving frame 120) is substantially aligned with the mid-plane S of the fixed frame 110. In a tilted state or position, e.g., as shown in FIG. 5B, the mid-plane M of the moving portion of the bike 10 is at an angle to the mid-plane S of the fixed frame 110. The angle between the two planes M and S may be referred to as the lean or tilt angle.

The maximum tilt or lean angle of the bike 10 may be limited by any suitable mechanism, such as a hard-stop and/or a damper. The damper may be implemented using any suitable mechanism that can provide resistance, and in some cases providing variable resistance, to the rotation of the moving frame relative to the fixed frame. In some examples, the damper may be implemented using one or more springs or other suitable resistance mechanisms (e.g., a shock tube) that can resist the movement of the moving frame.

When the locking mechanism 200 is engaged, pivoting of the moving frame 120 relative to the fixed frame 110 may be substantially prevented, allowing the user to operate the bike in a more conventional manner (without lean). Conventional, non-leaning/tilting bikes, may experience some nominal amount of lateral (side to side) movement of the frame, which naturally occurs due to the forces applied by the user on the frame when performing strenuous exercise. In such conventional stationary bikes, however, there isn't a distinct portion of the frame that is intended to move relative to other portions of the frame but instead the frame members are intended to remain generally fixed in relation to one another during use of the bike. As such, nominal side to side movement of a conventional bike frame is not what is being described here as the tilting or relative movement of a moving frame 120 to a fixed fame 110 of a tilt-enabled bike 10. When operated in the tilt-disabled or fixed mode, the bike 10 is essentially locked into the nominal (or substantially vertical) position shown in FIG. 4A.

Figure 23:
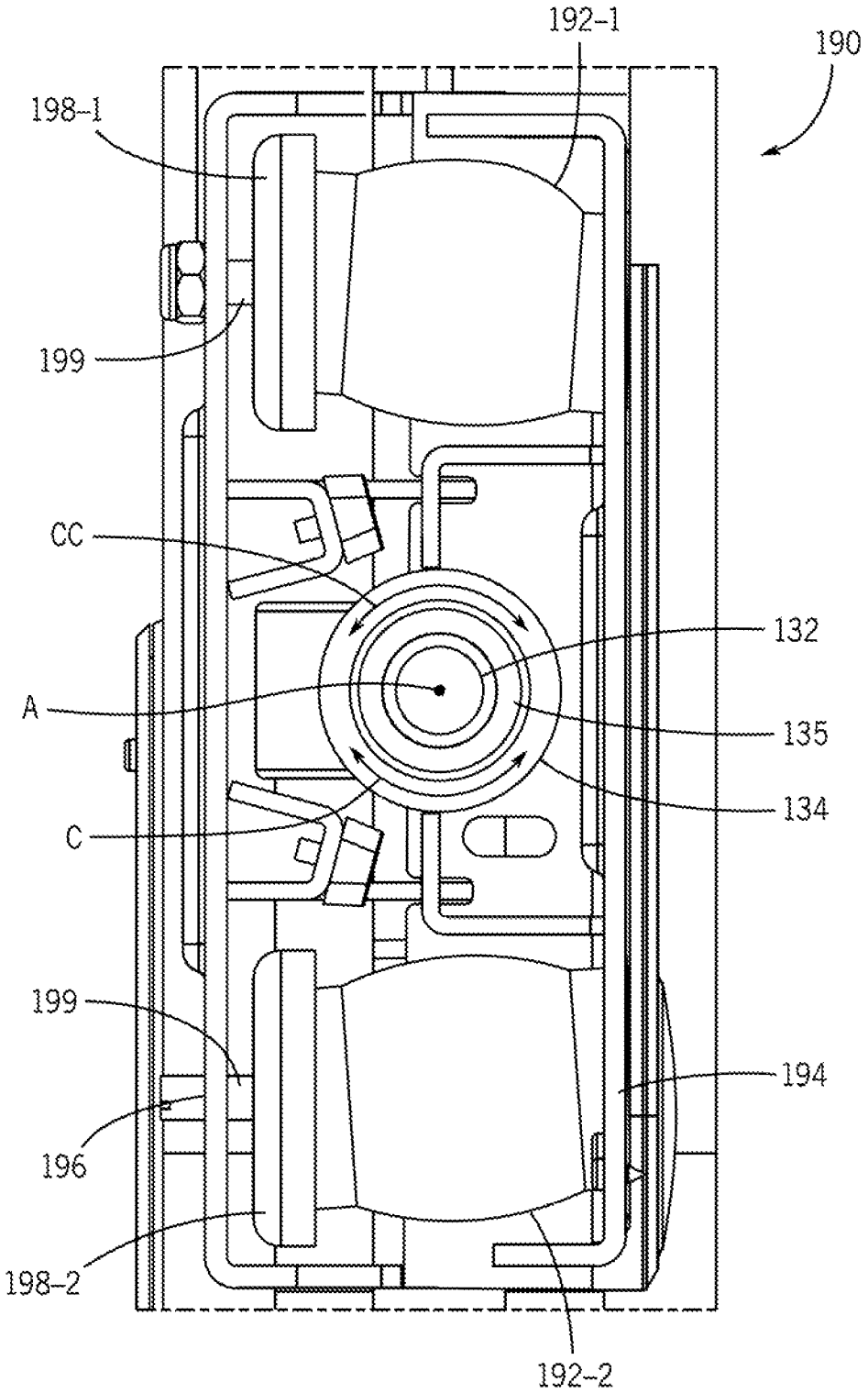
FIG. 23 shows a damper for resisting the tilting movement of the bike in FIG. 1.

In some embodiments, the pivoting (or tilting) movement of the bike 10 about the tilt axis A may be resisted by a damper 190 operatively engaged with the front pivot, the rear pivot or both. The damper 190 may include one or more resilient members arranged to be increasingly loaded as the tilt angle of the bike increases. In the present example, and referring also to FIG. 23, the damper 190 includes a pair of resilient members (or springs) 192-1 and 192-2, each disposed on opposite side of the front pivot shaft 132. The first spring 192-1 may be positioned proximate to a first side (e.g., a top side) of the front pivot shaft 132 and is thus above the tilt axis A, while a second spring 192-2 is positioned proximate a second opposite side (e.g., a bottom side) of the front pivot shaft 132, such that the second spring 192-2 is below the tilt axis A, Each of the resilient members or spring 192-1 and 192-2 may be an elastomeric (e.g., rubber) tube. However, in other examples, the resilient members or springs 192-1 and 192-2 may be implemented using any suitable type of resilient member or spring, such as an elastomeric (e.g., rubber) cylinder, a helical spring, a leaf spring or the like.

In an arrangement of two springs on opposite sides of the pivot shaft, each spring acts to resist the rotation of the front pivot shaft 132 in one of the two rotational directions (i.e., clockwise as shown by arrow C or counterclockwise as shown by arrow CC). In other examples, two springs may be positioned on substantially the same side of the shaft, one of the springs acting in compression to resist rotation about one of the two rotational directions and the other spring acting in tension to resist rotation about the other one of the two rotational directions. In some examples a single spring may be configured to provide the resistance to rotation in both directions. Other suitable arrangements may be used for the damper. For example, in some embodiments, the resistance to tilt or lean of the bike may be provided by the locking mechanism 200, which may be selectively operable to provide variable resistance to pivoting of the moving frame when not in a fully locked-out state and which may substantially prevent any tilt or lean when in the fully locked-out (or max resistance) state. In some embodiments, resistance to rotation of the pivot shaft may be applied by one or more resilient members positioned between the pivot shaft and the housing that rotatably received the shaft. The one or more resilient members may be positioned in one or more cavities or pockets between the pivot shaft and the housing such that the one or more resilient members are compressed during the rotation of the pivot shaft thereby resisting the rotation of the pivot shaft.

Figure 21A:
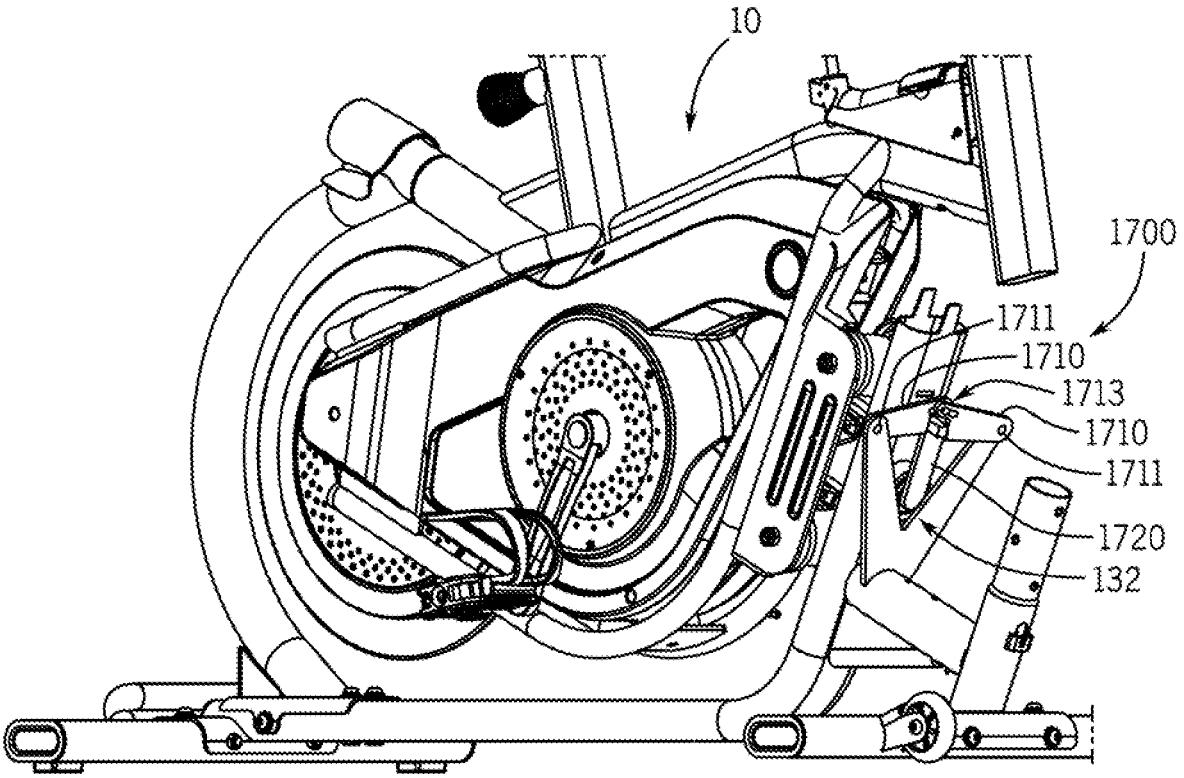
FIG. 21A shows yet another tilt-disabling mechanism on a tilt-enabled bike in accordance with the present disclosure.
Figure 21B:
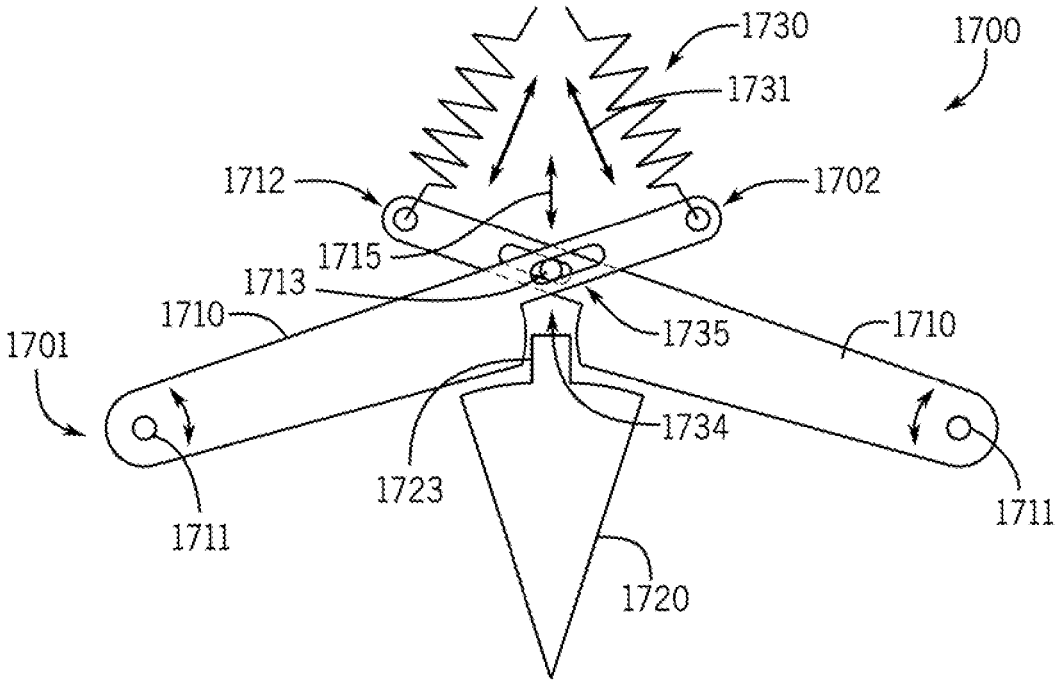
FIG. 21B shows a simplified illustration of the tilt-disabling mechanism of FIG. 21A.

With continued reference to FIG. 21, each spring 192-1 and 192-2 is joined to either the fixed frame 110 or the moving frame 120, and arranged to engage with, in this case in compression, the other one of the fixed or moving frame 110, 120 to provide resistance to pivoting of the moving frame 120 about the tilt axis A. The springs 192-1 and 192-2 are arranged between a pair of opposing and substantially parallel plates 194 and 196, one of which (e.g., plate 194) is fixed to the fixed frame 110 and the other (e.g., plate 196) to the moving frame 120. In the present example, both springs 192-1 and 192-2 are fixed to the fixed frame 110 by being fixed to a first plate 194 (also referred to as fixed plate 194). The fixed plate 194 is rigidly coupled to the upward extension 109 and is oriented with its major surfaces substantially parallel to the tilt axis A. The second plate 196 is fixed to the moving frame (and thus also referred to as moving plate 196). More specifically, the second plate 196 here is rigidly coupled to the front kirk 124 of the moving frame 120. The second plate 196 is similarly oriented with its major surfaces substantially parallel to the tilt axis A. As the bike tilts in one direction (e.g., clockwise), the moving plate 196 engages (e.g., compresses) one of the springs (e.g., first spring 192-1) and as the bike tilts in the opposite direction (e.g., counter-clockwise, the moving plate 196 engages (e.g., compresses) the other one (e.g., the second spring 192-2).

In other examples, a different arrangement and/or operation of the springs may be used. For example one of the springs ma be fixed to the fixed plate, while the other may be fixed to the moving plate. In some examples, such as the one illustrated in FIG. 23, each of the springs may have one of its ends fixed to a plate, while the opposite end of each spring is not fixed to a plate. In this manner, each spring may act only in one direction (e.g., in compression). In other examples, both ends of a spring may be fixed to a respective one of the fixed and moving plates, such that the spring may both compress when the bike is tilting in one direction and extend when the bike is tilting in another direction. In some such embodiments, one of the directions (when compressing or when extending) may be consider a primary or active direction and the other may not significantly impact the damping performance of the damper 190. In some cases, the springs may be configured such that both directions are considered active and contribute to the damping provided by damper 190.

In some embodiments, the resistance to pivoting may be adjustable, for example by varying the stiffness of the spring, which can be achieved by increasing a pre-load on the spring in the nominal (un-tilted) position. In some embodiments the resistance to pivoting may be adjusted by engaging a select number of a plurality of different resistance elements (e.g., springs). In the example illustrated in FIG. 23, variable resistance is achieved by selectively adjusting the engagement surface that engages the free end of each of the springs. In this case, respective cups 198-1 and 198-2 are adjustably (e.g., via a respective screw 199) coupled to the engagement side of the moving plate 196 at a location to engage the free end of the respective spring 192-1 and 192-2. Each cup receives the free-end of the spring during engagement. Each cup can be selectively positioned (by loosening and tightening of the respective screw) closer to the moving plate 196 and thus farther from the respective spring to decrease the spring's preload or farther away from the moving plate 196 and thus closer to the respective spring to increase the spring's preload.

Other variations and combinations of elements may be used to effectively implement a damper that resists the rotation of the pivot shaft 132. Also, while described here with reference to the front pivot, a similar or other suitable damper may be provided at the rear pivot instead or in combination with resistance at the front pivot.

Returning back to FIG. 5 and referring now also to FIGS. 7A, 7B, 7C, 7D, 8A, and 8B, the tilt-enabled bike 10 may be equipped with a locking mechanism 200 operatively arranged to convert the bike 10 from a tilting bike mode to a non-tilting (or fixed) bike mode, and vice versa. The locking mechanism 200 may be operatively associated with an actuator 300, which may be configured for local or remote actuation (or activation) to engage and disengage the locking mechanism 200. For example, the actuator 300 may be implemented by actuator 301, actuator 321 or another suitable actuator. The locking mechanism 200 may be implemented using any suitable mechanism capable of substantially eliminating (or locking out) the relative movement between the moving frame 120 and the fixed frame 110, thereby converting the tilting bike 10 into a non-tilting (or fixed) bike.

Any suitable locking mechanism that disables the tilting function of the bike 10 may be used. The various locking mechanisms may generally be characterized as falling in one of two categories, e.g., mechanisms that act on and interfere with the rotation of the pivot shaft of the at least one pivot joint that pivotally couples the moving frame 120 to the fixed frame 110, and mechanisms that mechanically interfere with the relative movement between the moving and the fixed frames. In the former category, exemplary tilt-disabling mechanisms may include various types of friction brakes that engage the pivot shaft to resist and/or prevent its rotation. Some of these mechanisms may provide variable resistance, which may be used to resist the pivoting movement of the moving frame (e.g., in place of a damper) and the resistance may be increasable up to a setting in which the rotation of the pivot shaft is substantially fully constrained, thus locking out the tilt function of the bike. The latter category of mechanisms may include various arrangements of pins or blocks that are movable between two positions including a position, in which the pin or block does not interfere with the movement of the moving frame, and another position, in which the pin or block interferes with the movement of the moving frame.

Figure 7B:
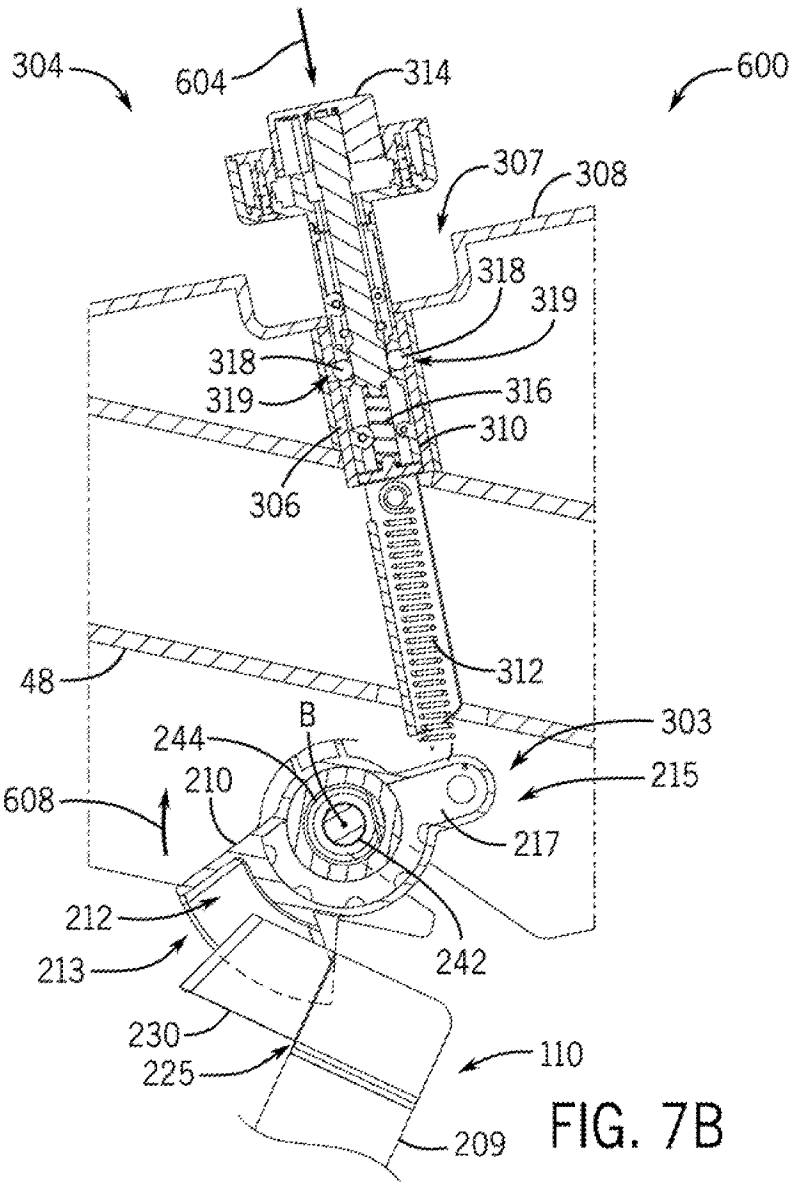
FIGS. 7A and 7B show cross-sectional views, in a disengaged position and an engaged position, respectively, of a tilt-lock assembly for use with the bike in FIG. 1 according to some examples of the present disclosure.
Figure 7A:
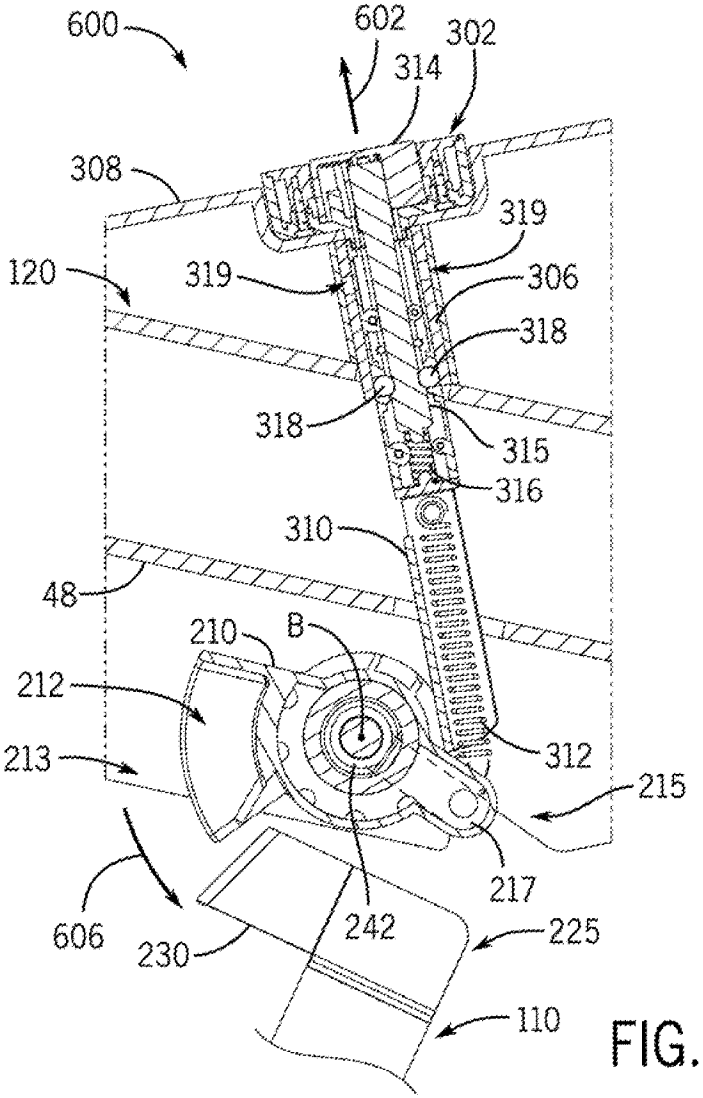
Figure 7D:
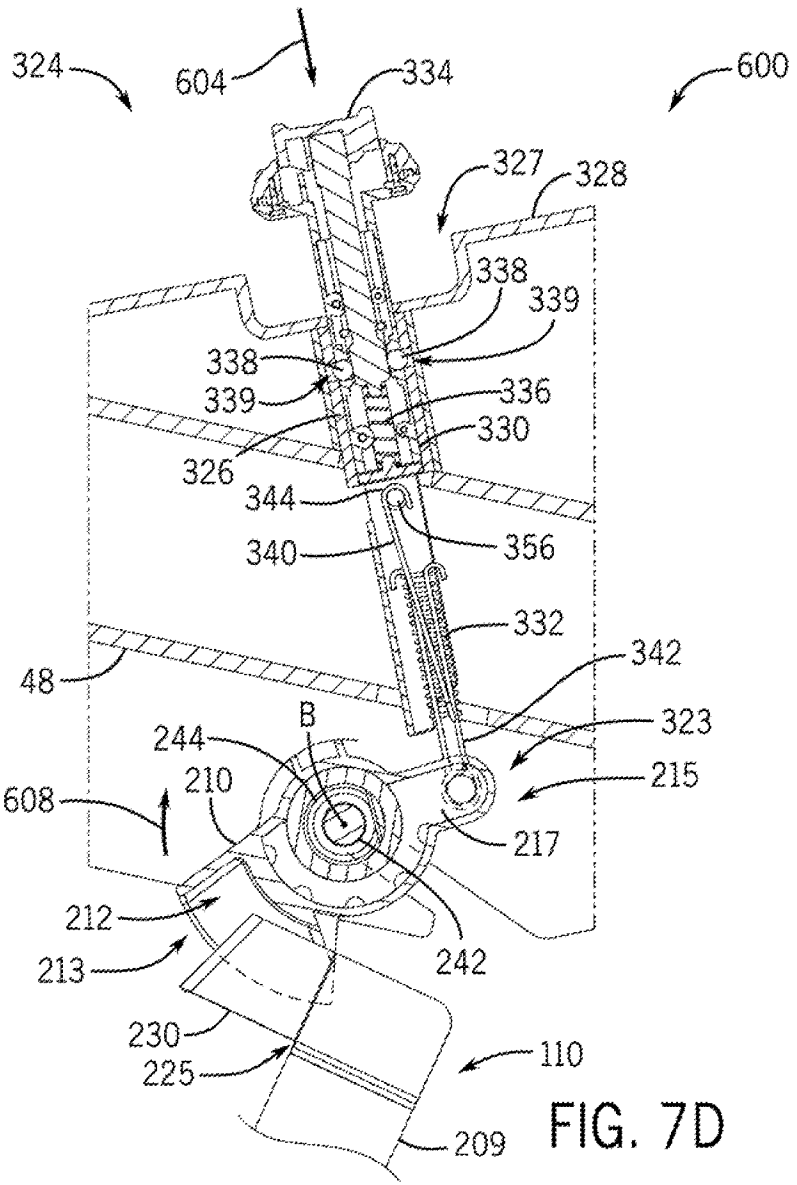
FIGS. 7C and 7D show cross-sectional views, in a disengaged position and an engaged position, respectively, of a tilt-lock assembly for use with the bike in FIG. 1 according to further examples of the present disclosure.

Examples of a locking, mechanism 200 are illustrated in FIGS. 7A-7D, which show a tilt-lock assembly 600 of the bike 10 in a disengaged (unlocked) state (in FIGS. 7A and 7C) and an engaged (locked) state (in FIGS. 7B and 7D). The tilt-lock assembly 600 may include a locking mechanism 200 and an actuator (e.g., actuator 301 in FIGS. 7A and 7B, and actuator 321 in FIGS. 7C and 7D). In these examples, the tilt-lock assembly 600 is configured for manual, and thus local, actuation. The terms local and remote, when describing the actuation of the locking mechanism, refer to actuation controlled by a device co-located with the locking mechanism (e.g., on the bike itself), and actuation controlled by a device removable or disconnected from the bike (e.g., an electronic device such as a smart phone or tablet), respectively. The locking mechanism 200 in the present examples includes a lock block 210 movably (in this case pivotally) mounted to the moving frame 120, and configured to mechanically engage a locking feature 225, which may be a portion of the fixed frame 110. In the present example, the locking feature 255 may be a protrusion 230 fixed to the frame 110. Mechanical engagement of the lock block 210 with the locking feature 225 prevents the relative movement of the moving frame 120 with respect to the fixed frame 110. The term mechanically engage implies physical contact between the specified components when they are said to be mechanically engaged.

Referring to FIGS. 7A, 7B, 7C, 7D, 8A and 8B, the lock block 210 is pivotally mounted to the moving frame 120, e.g., via a pin 242 and one or more bearings 244. In this example, the pin 242 is coupled to the moving frame 120, extending generally transverse to the top tube 48. Two bearings 244 are positioned at the opposite ends of the pin 242 and support opposite sides of the lock block 210. The one or more bearings 244 rotatably couple the lock block 210 to the pin 242 such that the lock block 210 pivots about a lock block pivot axis B, which is also the axis of the pin 242. The lock block 210 has a length L, which is the distance defined between its opposite side walls 211-1 and 211-2, and is arranged such that the length Lis oriented substantially along the axis B. The lock block 210 has an engagement portion 213 and an actuation portion 215 provided generally on opposite sides of the axis B. The engagement portion 213 includes a peripheral wall 214, which extends between the opposing side walls 211-1 and 211-2 and defines an engagement groove 212. The engagement groove 212 extends from the peripheral wall 214 radially inward toward the axis B. The actuation portion 215 includes a substantially rigid lever 217 extending from a peripheral location of the actuation portion 215 radially inward toward the axis B. The peripheral end of the lever 217 is coupled to the actuator of the tilt-lock assembly 600 (e.g., actuator 301 in FIGS. 7A and 7B or actuator 321 in FIGS. 7C and 7D) such that an actuation force may be applied on the lever 217 to pivot the lock block 210 about axis B.

Figure 8A:
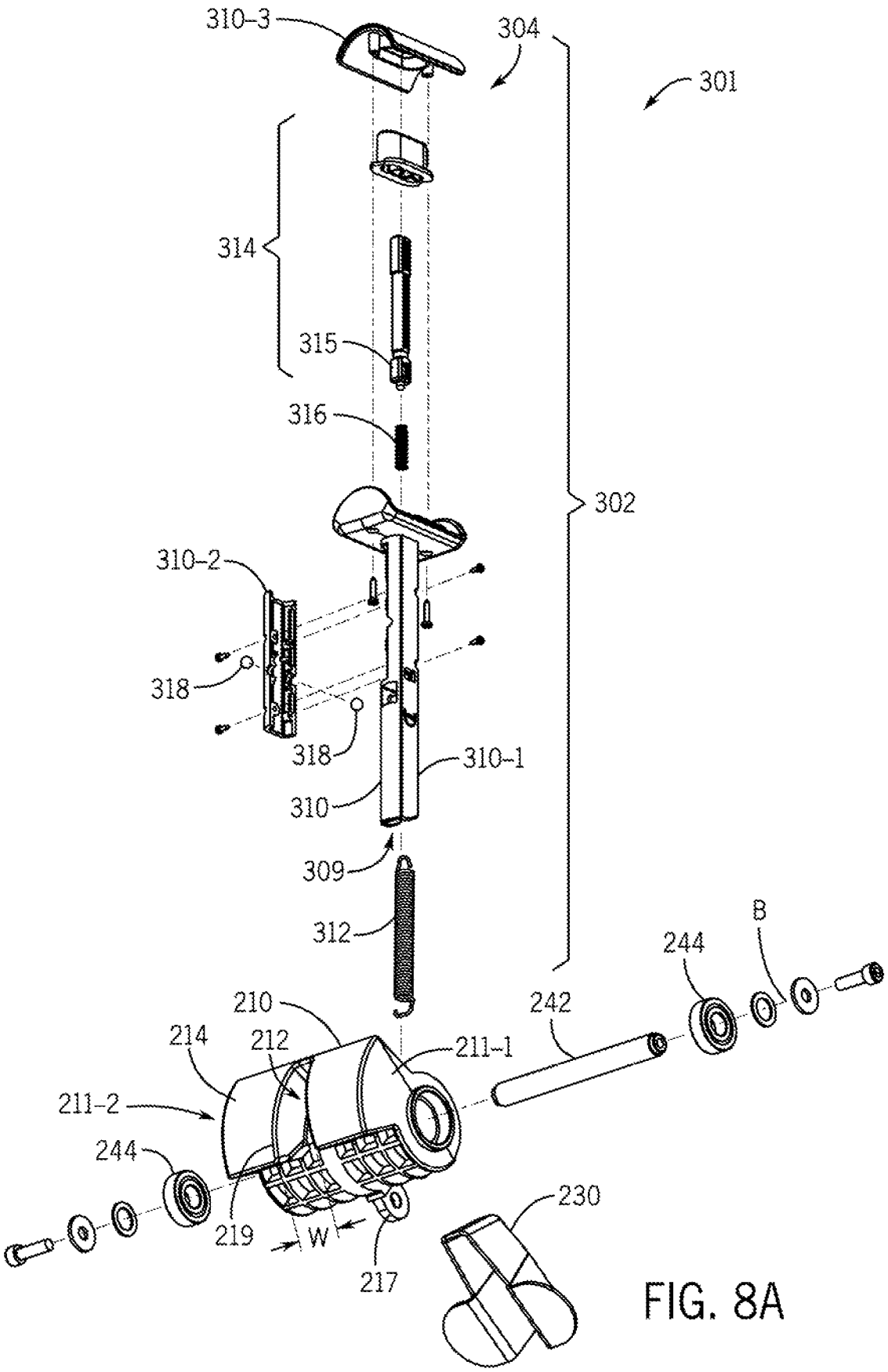
FIG. 8A shows an exploded view of the tilt-lock assembly shown in FIGS. 7A and 7B.
Figure 8B:
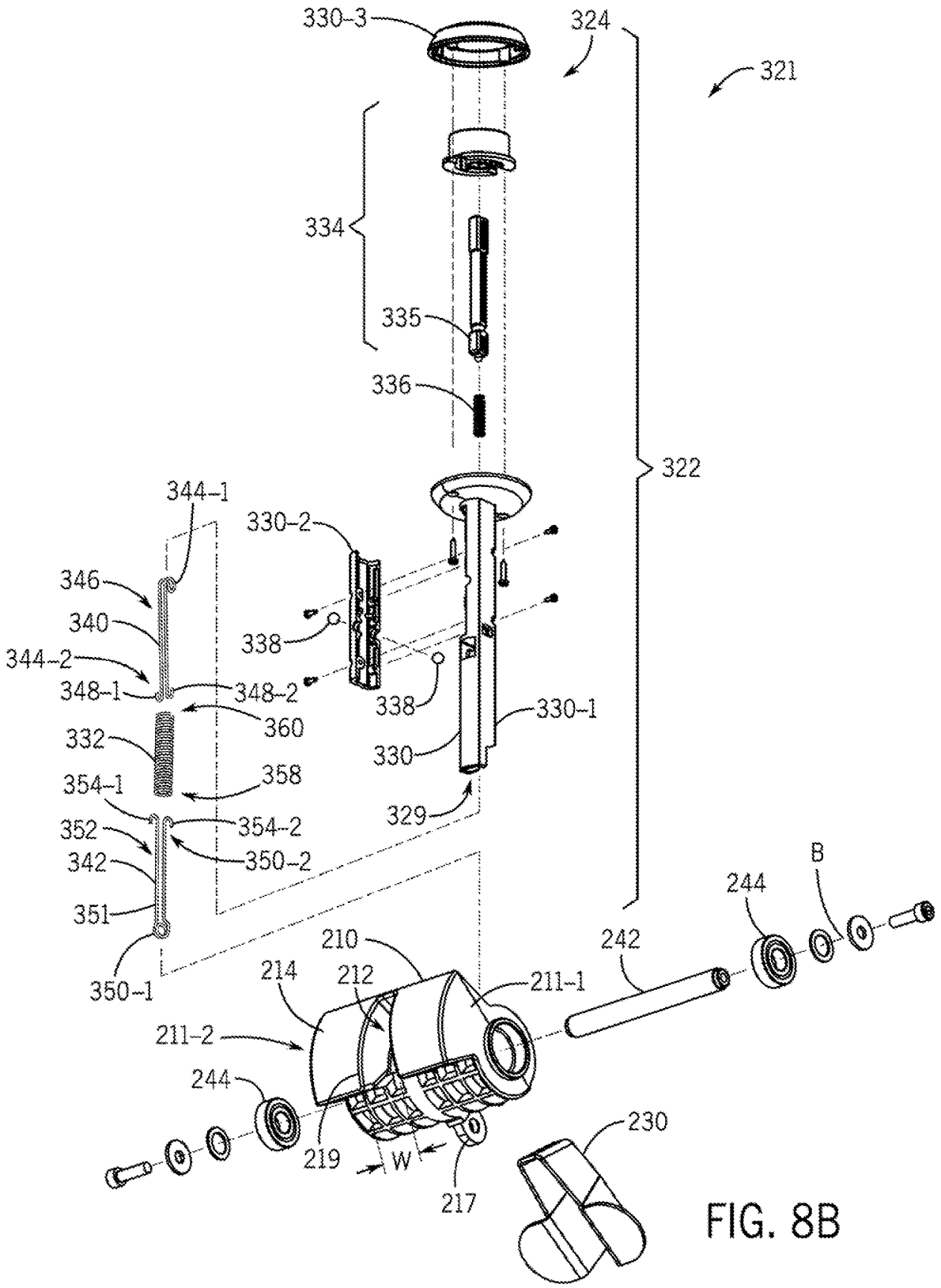
FIG. 8B shows an exploded view of the tilt-lock assembly shown in FIGS. 7C and 7D.
Figure 9A:
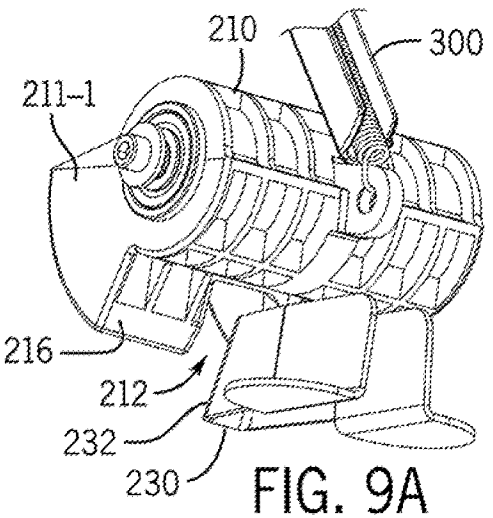
FIG. 9A is an isometric view of a portion of the tilt-lock assembly in FIG. 7A, shown in a disengaged position.
Figure 9B:
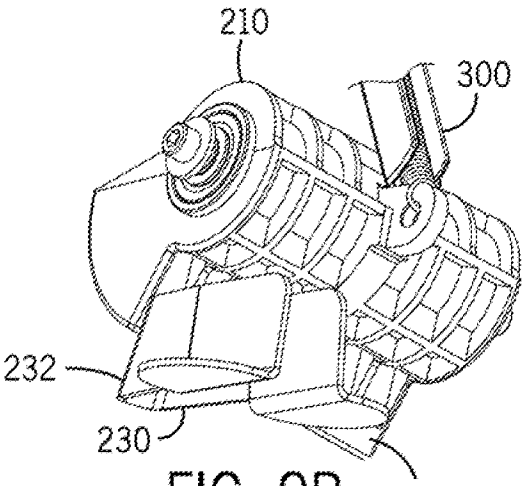
FIG. 9B is another isometric view of the portion of the tilt-lock assembly shown in 9B, with the lock block actuated to the locked position while the bike is in a tilted (or off-center) position.
Figure 9C:
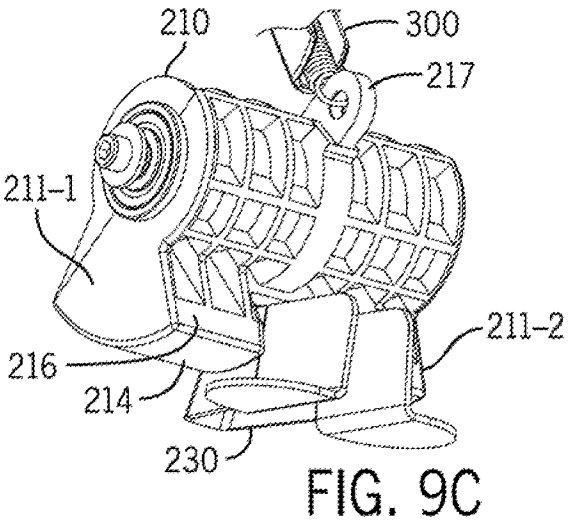
FIG. 9C is yet another isometric view of the portion of the tilt-lock assembly shown in 9A, with the locking mechanism engaged.
Figure 10A:
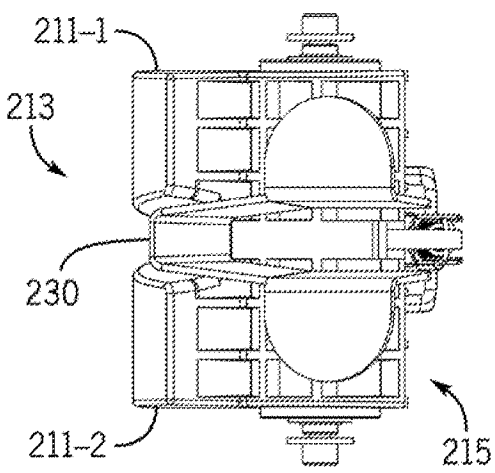
FIG. 10A shows a bottom view of the portion of the tilt-lock assembly in FIG. 9A.
Figure 10B:
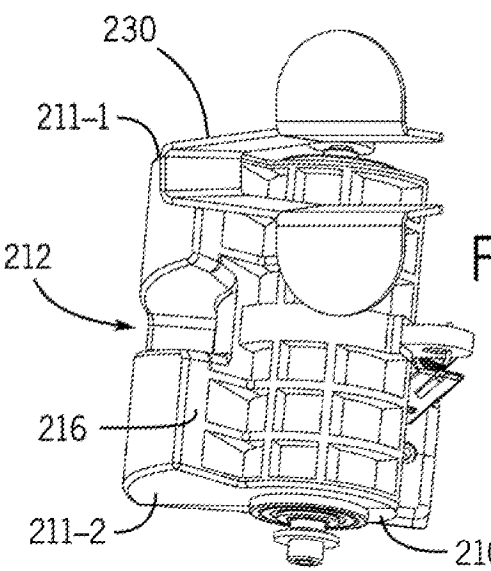
FIG. 10B shows a bottom view of the portion of the tilt-lock assembly in FIG. 9B.

The engagement groove 212 is configured to receive at least a portion of the lock feature 225, such as a protrusion 230 or the like, that is rigidly mounted on the fixed frame 110. The groove 212 may be tapered such that its width reduces farther away from the protrusion. The protrusion 230 may be correspondingly tapered. For example, the upper portion of the protrusion 230, which is closer to the block 210 and thus to the groove 212, may be narrower than portions of the protrusion 230 farther away from the block 210 and thus the groove 212. Stated differently, the opening of the groove 212, which is the part of the groove 212 that is closest to the protrusion 230, has a generally larger size (e.g., is wider) than the size of the groove 212 farther away from the protrusion 230. Similarly, the protrusion 230 is narrower at its free end than at its base. Referring also to FIGS. 9A-C and FIGS. 10A-C, which show the lock block and protrusion at three different states including a disengaged state (FIGS. 9A and 10A), an engaged state (9C and 10C), and a partially engaged state (9B and 10B), the tapering of the groove 212 and protrusion 230 may facilitate engagement between the groove 212 and protrusion 230 without precise alignment of the two. The tapering may provide a self-centering function as the user operates the locking mechanism into engagement with the groove. For example, as shown in FIGS. 9B and 10B, as the moving frame and thus the block 210 tilts off center (i.e., out of the stationary plane S), the size of the groove's opening 219 being larger than the upper portion of the protrusion may facilitated insertion of the protrusion into the groove as the bike tilts back to center. In some examples, the groove 212 may be tapered in one direction (e.g., its depth direction) or in two directions (e.g., along its depth and length directions). In the illustrated example, the groove 212 is tapered along its length in that the shape of the aperture in the peripheral wall 214 that defines the opening 219 of the groove has a substantially trapezoidal shape (e.g., as seen in FIGS. 8A and 8B). In addition, the groove 212 is tapered along its depth, the width W of the groove 212 narrowing from the opening 219 in the radially inward direction (i.e. toward the axis B). The shape of the protrusion 230 may correspond to that of the groove 212 and thus the protrusion 230 may also be tapered in one or multiple directions. Such a tapered protrusion 230 may thus also be referred to as a tapered pin or a wedge 230.

In some embodiments, the groove 212 and the wedge 230 may be sized for a transition fit, implying only negligible, if any, clearance between the interfacing surfaces of the groove 212 and wedge 230 so as to provide a tight fit without substantially any free play. In some embodiments, the lock block 210 or at least the engagement portion 213 thereof, may be made from a durable rubber material (e.g., rubber having Shore A hardness of 80, 85, 90 or greater), while the wedge 230 may be made from a substantially rigid material, such as metal, plastic, or rigid composite, which in combination with the taper of the two components may facilitate a tightly fitting mechanical engagement between the two. In other embodiments, the wedge 230 (e.g., at least the portion thereof that engages the lock block) may instead be made from durable rubber, while the lock block 210, or at least the engagement portion thereof, is substantially rigid (e.g., metal, plastic, or a rigid composite). In some examples, the groove 212 and protrusion 230 may be differently shaped, e.g. non-tapered or tapered to a higher degree, such as up to a taper angle of about 140 degrees (see e.g., FIG. 10C), in one direction such as the length direction, or in some cases in both directions.

The length L of the lock block 210 may be sufficiently large to ensure that as the bike leans from side to side, at least a portion of the block 210 remains over the protrusion 230, as shown for example in FIGS. 9B and 10B, in which the moving frame is tilted and thus the block 210 is off center with respect to the fixed frame and the protrusion 230. However, the block 210 is sized so that even at the maximum lean of the bike, the side wall of the block in this case the first wall 211-1, does not clear the protrusion 230. In such embodiments, the length L of the block 210 may be about half of the length of the tilt arc through which the moving frame 120 may be configured to pivot.

The tilt-lock assembly 500 may include an actuator 300 to pivot the lock block 210, some examples of which are illustrated in FIGS. 7A-D and 8A and 8B. Referring to FIGS. 7A, 7B and 8A, the actuator 301 may be implemented as a rod assembly, or rod, 302, which is arranged such that the length of the rod 302 is substantially perpendicular to the axis a One end 303 of the rod assembly 302 is coupled to the lever 217 of the lock block 210 and the opposite end 304 of the rod assembly 302, which may be referred to as the manipulation end 304, is provided at an accessible location on the bike (e.g., a location which is not hidden behind protective shrouding). In some embodiments, the manipulation end 304 may be provided at a location which is accessible to the user while riding the bike 10, such as proximate to the resistance knob 25.

The rod assembly 302 includes a housing 310 and a plunger 314 at least partially and movably received in the housing 310. In some embodiments, for the ease of assembly/installation of internal components of the rod assembly 302 the housing 310 may be manufactured as a multi-part component including a first (or main) housing portion 310-1, a second (or intermediate) housing portion 310-2 and a third (or top) housing portion 310-3, which are assembled together to provide the housing 310 of the rod assembly 302. For example, the lower portion of the housing 310 may be manufactured in two parts to enable installation of one or more latching balls 318. The upper portion of the housing 310 may be manufactured as yet another separate part (e.g., the top housing portion 310-3) to enable installation of the plunger 314, within the passage 309 defined by the housing 310. The plunger 314 may be sized to be received within the passage 309 and may be biasingly connected (e.g., via a spring 316) to the housing 310. In some embodiments, the rod assembly 302 may be compliantly coupled to the lock block 210 to facilitate locking of the actuator in the engaged position even when the bike is off-center. In the illustrated example, the rod assembly 302 is compliantly coupled to the lock block 210 via a spring 312, which connects the housing 310 of the rod assembly 302 to the lever 217 of the lock block 10. The spring 312 may be a coil spring, a resilient member (e.g., a rubber rod or other suitable elastic elongate member) or any other suitable elastically deformable body.

To operate the tilt-lock assembly 600, the user pulls the manipulation end 304 of the rod assembly 302, and more specifically the plunger 314, upward in the direction 602 in FIG. 7A, which by virtue of the connection between the plunger 314 and the housing 310 causes the housing 310 to displace upward (in the direction 602) as well. In some embodiments, in the which the rod assembly 302 is installed to sit substantially flush with the shroud 308 when disengaged, a pull loop or other feature may be operatively installed at the manipulation end 304 of the rod 302 to enable the user to pull on the rod 302. As the plunger 314 and housing 310 move upward, the latching balls 318 move upward as well until they become devotionally aligned with the detent holes 319 in the sleeve 306. The sleeve 306 may be provided by a downward extension of the shroud 308 that defines a passage sized to accommodate the rod assembly 302. When so aligned, the balls 318 displace outward into the detent holes 319 in part due to the widened lower portion 315 of the plunger 314. The latching balls 318, and consequently the rest of the rod assembly 302, are held in this upward extended position (shown in FIG. 7B), which corresponds to the engaged (or locked) position of the tilt-lock assembly, until the user operates the actuator 301 in reverse. When the plunger 314 and housing 310 are thus moved upward, the lock block 210 rotates in a first direction, shown by arrow 606, to pivot the engagement portion 213 downward toward the fixed frame 110 to engage the locking feature of the fixed frame, in this case the wedge 230. In other embodiments, the plunger 314 may be differently latched to the housing 310, for example using one or more resilient members or other structures (e.g., tabs) that are biased outward by the plunger to prevent relative movement of the plunger and the whole rod assembly thereby locking the rod into position.

To deactivate or disengage the locking mechanism, the user simply pushes down on the rod assembly 302, which causes the rod assembly 302 to move in the opposite, downward direction, as indicated by arrow 604 in FIG. 7B. In response, the plunger 314, and thus its widened portion 315, moves down allowing the latching balls 318 to displace out of the detent holes 319 inward toward the centerline of the rod assembly 302, de-latching the actuator 301 from the engaged position. The rod assembly 302 returns to its dis-engaged position, in this case seated against the recess 307 of the shroud 308. The rod assembly 302 may return to its retracted position in part due to the downward user force and/or gravity, and in some case, when compliantly coupled (e.g. via a spring 312), in part also due to the spring force of spring 312. When the rod assembly 302 is pushed down, the lock block 210 rotates in the opposite direction, indicated by arrow 608 causing the engagement portion 213 to rotate upward (as indicated by arrow 608) and away from the fixed frame 110 thereby disengaging from the locking feature 225 of the fixed frame 110 and unlocking the tilt-lock assembly 600 to enable the tilt mode of the bike 10.

Figure 7C:
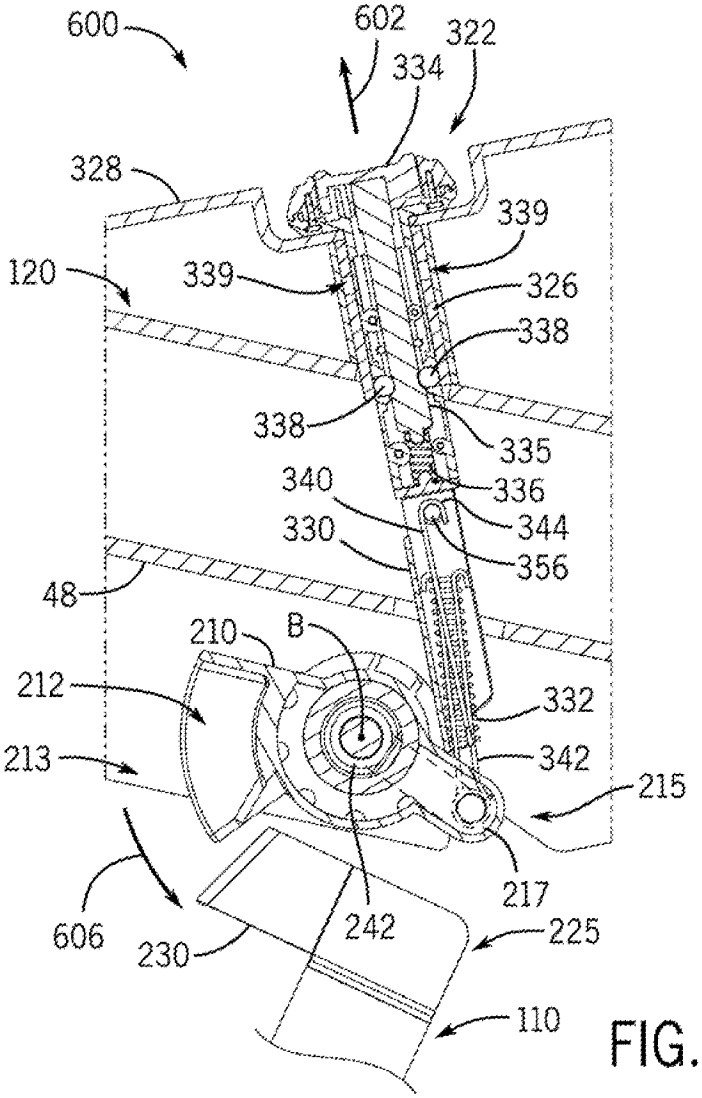

FIGS. 7C, 7D, and 8B show actuator 321 in accordance with further examples herein. The actuator 321 may be implemented using a rod assembly, or rod, 322. The rod assembly 322 may be arranged similarly to the rod assembly 302. One end 323 of the rod assembly 322 is coupled to the lever 217 of the lock block 210. An opposite, manipulation end 324 is provided in a location accessible to the user, similarly to the manipulation end 304 of rod assembly 302, to allow the user to operate the actuator 321 tier engaging and dis-engaging the tilt-lock assembly 600.

The rod assembly 22 includes a housing 330 and a plunger 334. The plunger 334 may be sized to be received within a passage 329 in the housing 330. The plunger 334 interacts with a spring 336 and includes a widened lower portion 335 that interacts with latching balls 338 in a similar manner to rod assembly 302. The rod assembly 322 may interact with a sleeve 326, recess 327, shroud 328, and detent holes 339 in the sleeve 326. Elements of the rod assembly 322 such as the manipulation end 324, sleeve 326, recess 327, shroud 328, passage 329, housing 330, plunger 334, widened lower portion 335 of the plunger 334, spring 336, and latching balls 338 may be similar in features, manufacture, operation, and arrangement to analogous components of the actuator 301, and their description, therefore, will not be repeated here.

Like the rod assembly 302, the rod assembly 322 includes a spring 332, which may be a coil spring or other elastically deformable member. In the rod assembly 322, the spring 332 is configured as a compression spring, in that the spring 322 is compressed when the actuator 321 is in the engaged position. The spring 332 may be operatively associated with the housing 330 such that the spring 332 is loaded in compression when the actuator 321 is in the engaged position. For example, the rod assembly 322 may include a first elongated element 340 and a second elongated element 342 each of which engage an opposite side of the spring 332 to compress the spring 332 when the actuator 321 is in the engaged position. The first elongated element 340 is coupled to the housing using any suitable first coupling feature 344-1 (e.g., one or more hooks or loops). The first coupling feature 344-1 is provided at one end of an elongated body section 346 of the elongate element 340, and a second coupling feature 344-2 (e.g., one or more hooks or loops) is provided at the opposite end of the elongated body section 346. The housing 330 may include an axle or post 356 that couples the first coupling feature 344-1 to the housing, such as by being received in the hook or loop. The first coupling feature 344-1 may be configured to allow the elongated body section 346 to pivot about the axle 356. The second coupling feature 344-2 are configured to engage a lower end 358 of the spring 332. For example, hooks 348-1 and 348-2 may wrap under the lower end 358 of the spring 332.

The second elongated element 342 is coupled to the lever 217. For example, the second elongated element 342 may have a suitable coupling features 350-1 (e.g. a hook or loop) at one end of an elongated body section 352 of the elongate element 342. Another coupling feature 350-2 (e.g., one or more hooks of loops) are provided on the opposite end of the elongated body section 352. The coupling feature 350-1, in the illustrated examples includes a loop, engaged with the lever to move the lock block 210 between the engaged and disengaged positions, in a manner similar to that of the operation of spring 312. The coupling feature 350-2 on the opposite end of the elongate element 342 is configured to engage an upper end 360 of the spring 332 to apply compressive force to the spring when the actuator 321 is provided to the engaged position. For example, one or more hooks 354-1 and 354-2 may wrap over the upper end 360 of the spring 332. The spring 332 is held between the first elongated element 340 and the second elongated element 342.

The first and second elongated elements 340, 342 may be formed from any suitable material, for example suitably shaped wire(s), cable(s) (single or multi-strand), or a combination thereof. In some embodiments, the first and second elongated elements 340, 342 may be rigid links. In other embodiments, the first and second elongate elements 340 may be implemented using non-rigid members that can carry a load in tension, such as chain(s), strap(s), cords, or combinations thereof, which are operatively coupled to engage the spring loading it in compression. The first and second elongated elements 340, 342 may be made of any material of sufficient strength to compress the spring 332. For example, the first and second elongated elements 340, 342 may be made of steel, plastics, or reinforced composites. The first and second elongated elements 340, 342 may be formed by extrusion (such as in the example of wires, that may be subsequently shaped to the desired final shape), they may be stamped, molded (such as in the example of a rigid link), or additively manufactured.

To engage the locking mechanism, via the rod assembly 322, the user pulls up on the manipulation end 324 in the direction 602 as shown in FIG. 7C. The rod assembly 322 differs from the rod assembly 302, at least, in that the spring 332 is configured to be loaded in compression when the locking mechanism is engaged, rather than in tension as is the case in rod assembly 302. As the housing 330 moves up, the axle 356 pulls up on the hook 344 of the first elongated element 340, moving the elongated element 340 generally in the same direction as the housing 330. This motion imparts a force to the lower end 358 of the spring 332 via the coupling feature 344-2. This force is translated through the spring 332, which compresses in the process, to the coupling feature 354 of the second elongated element 342 via the upper end 360 of the spring. The force is transferred via the elongated body section 351 to the lever 217 causing the lever 217 to rotate the lock block 210 to the locked position, as previously described. Due to the pivotal movement of the lock block 210 and lever 217, the assembly of the first and second elongate members 340 and 342, respectively and the spring, may pivot slightly within the housing 330 about axle 356, as can be seen in FIGS. 7C and 7D. In some embodiments, the housing 330 may be sized sufficiently large to accommodate this pivoting movement. In other embodiments, a length-wise slot may be formed in the lower portion of the housing g330, as can be seen in FIG. 8B. To disengage the locking mechanism, the user pushes down on the rod assembly 322, as previously described with respect to the rod assembly 302.

By loading the spring 332 of the rod assembly 322 in compression in the engaged position, a more sturdy engagement of the lock block 210 with the opposing fixed feature of the bike frame may be achieved, which may reduce the risk of inadvertently (i.e., unintentionally) disengaging the locking mechanism while a user is riding the bike. Other solutions that may reduce the risk of accidentally disengaging the locking mechanism such as when using a spring loaded in tension, may including using a spring of sufficient stiffness to substantially resist the torque that may be caused on the lock block due to side to side (or leaning) movement of the bike when the locking mechanism is engaged. Other suitable variations may be used.

The tilt-lock assemblies 600, 600' may provide certain technical advantages. For example, when a user rides the bike 10, a torque may be imparted on the lock block 210 in the direction 608 shown in FIG. 7D (toward an unlocked position) which may increase the risk of the lock block 210 inadvertently disengaging. By increasing the stiffness of an extension spring (but not exceeding a stiffness at which a normal user can actuate the rod assembly) or by loading the spring in compression, the risk of unintentionally disengaging the locking mechanism may be reduced or eliminated.

Figure 10C:
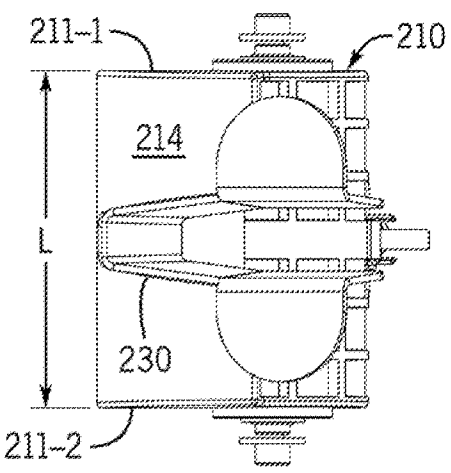
FIG. 10C shows a bottom view of the portion of the assembly in FIG. 9C.

The locking mechanism may be configured to be provided in a partially engaged state, as shown in FIGS. 9B and 10B. In this state, the actuator may be engaged (or locked into the engaged position), shown in FIGS. 7B and 7D, while the lock block 210 may not be fully engaged with the protrusion 230, for example because the lock block 210 is off center and thus the groove and protrusion are misaligned. In this state, as the user operates the actuator and locks it into engagement, the lock block 210 may be rotated downward in the direction 606 but instead of receiving the protrusion 230 within its groove 212, a radially extending surface 216 of the lock block 210 may be brought into contact to rest against the interfacing side 232 of the protrusion 230, which is similarly inclined to match the incline of the interfacing side 232 in this position. The actuator 300 is coupled at its lower end to the lock block 210 such that there is some amount of laterally compliance (e.g., due to the coupling via the spring 312 of actuator 301 or the spring assembly of actuator 321) and thus, as the moving frame and the block 210 return to center and the groove 212 begins to aligned with the protrusion, the spring force acting on the lever 217 pulls the lock block 210 info full engagement, as shown in FIGS. 9C and 10C, in which the protrusion 230 is received at least partially within the groove 212 to constrain further tilting of the moving frame.

Features of the lock block 210 and cooperating protrusion 230 may be differently configured in other embodiments. For example, the taper of the lock block 210 may be greater than (e.g., up to a taper angle of about 140 degrees) or smaller (e.g., up to a taper of 0 degrees, or no taper, in which case the walls of the groove would be substantially parallel). When a narrower groove 212, and especially when the groove 212 is substantially untapered, a more precise centering of the bike 10 may be needed by the user prior to engaging the locking mechanism. In contrast, the taper of the groove 212 may provide a centering function obviating the need for the user to precisely align the bike to center before engaging the tilt-lock assembly. The coupling between the actuator 300 and the lock block may provide lateral compliance or flexibility to allow locking of the actuator without centering of the bike, while reducing compliance or flexibility in the longitudinal direction while in the engaged position (e.g., by compression loading of the spring) to reduce unintentional disengaged of the locking mechanism. In other embodiments, the actuator 300 may not be compliantly coupled and may instead have a rigid link for its lower portion that is pivotally connected to the lever 217 of the lock block.

Figure 11B:
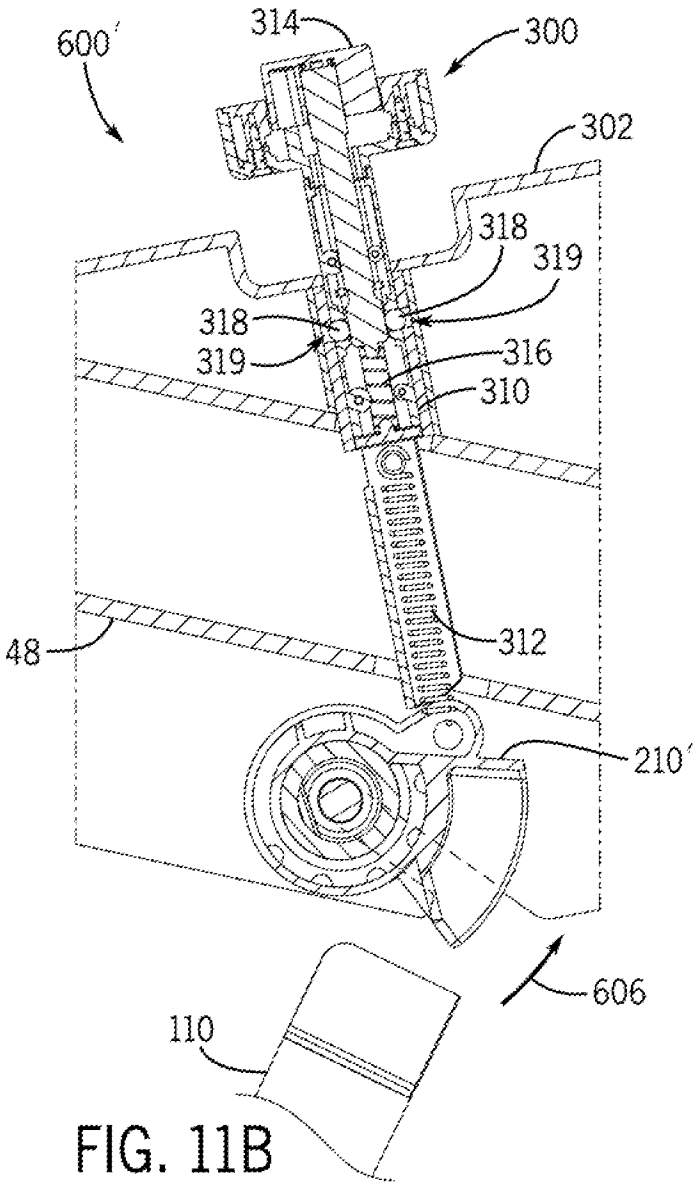
FIGS. 11A and 11B are views of another example of a tilt-lock assembly for the bike in FIG. 1, shown in an engaged position and a disengaged position, respectively.
Figure 11A:
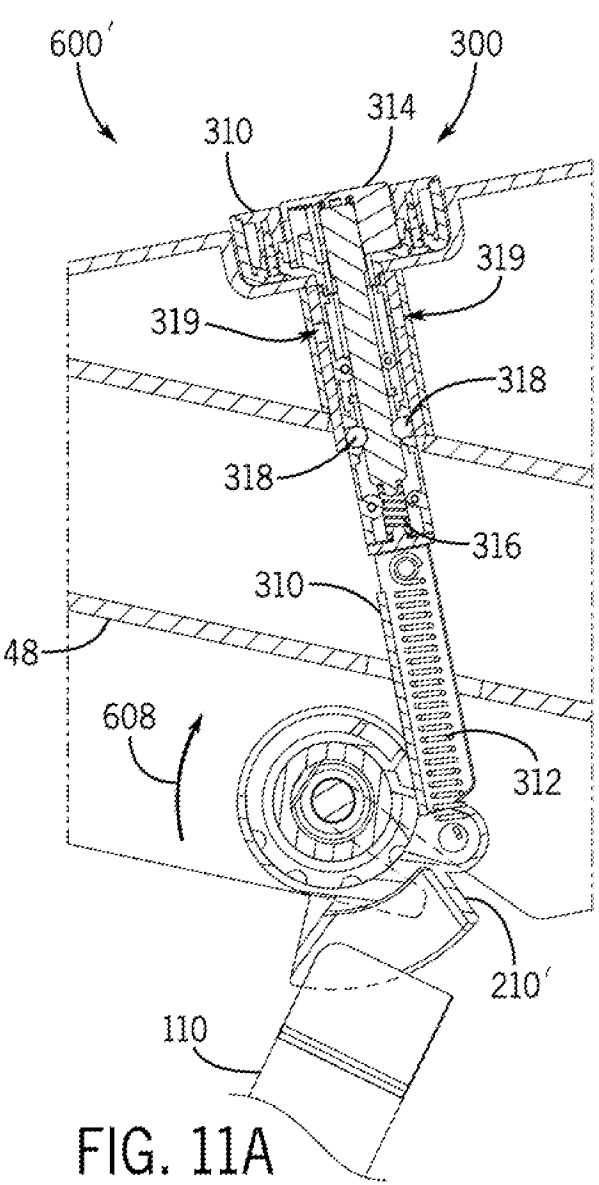

In some embodiments, the operation of the tilt-lock assembly may be reversed. For example, FIGS. 11A and 11B show a tilt-lock assembly 600' which has similar components to those of tilt-lock assembly 600. Specifically, the tilt-lock assembly 600' includes an actuator 300, which may be implemented using the actuator 301 and the rod assembly 302 described with reference to FIGS. 7A, 7B, and FIG. 8A, the actuator 321 and the rod assembly 322 described with reference to FIGS. 7C, 7D, and 8B or any other suitable actuator. The assembly 600' may also include a lock block 210' similar to the lock block 210 but with the engagement and actuation of the block 210 located on the same side. As illustrated the engagement portion 213 may be substantially the same as that of block 210, and may include a shaped (cam) surface having substantially the same features as the peripheral wall 214 that defines and includes the groove 212. In this example though, the rod 302 or 322 may be coupled to the engagement portion 213 to pivot the engagement portion toward and away from the fixed frame 110. As such, the tilt-lock assembly 600' operates to lock out tilt (or engage the locking mechanism) upon pushing on the rod assembly 302 or 322, which causes the downward rotation of the lock block toward the fixed frame, and unlocking (or disengagement) of the tilt-lock assembly occurs responsive to pulling on the rod assembly 302 or 322, which rotates the lock block upward and away from the fixed frame.

Figure 12:
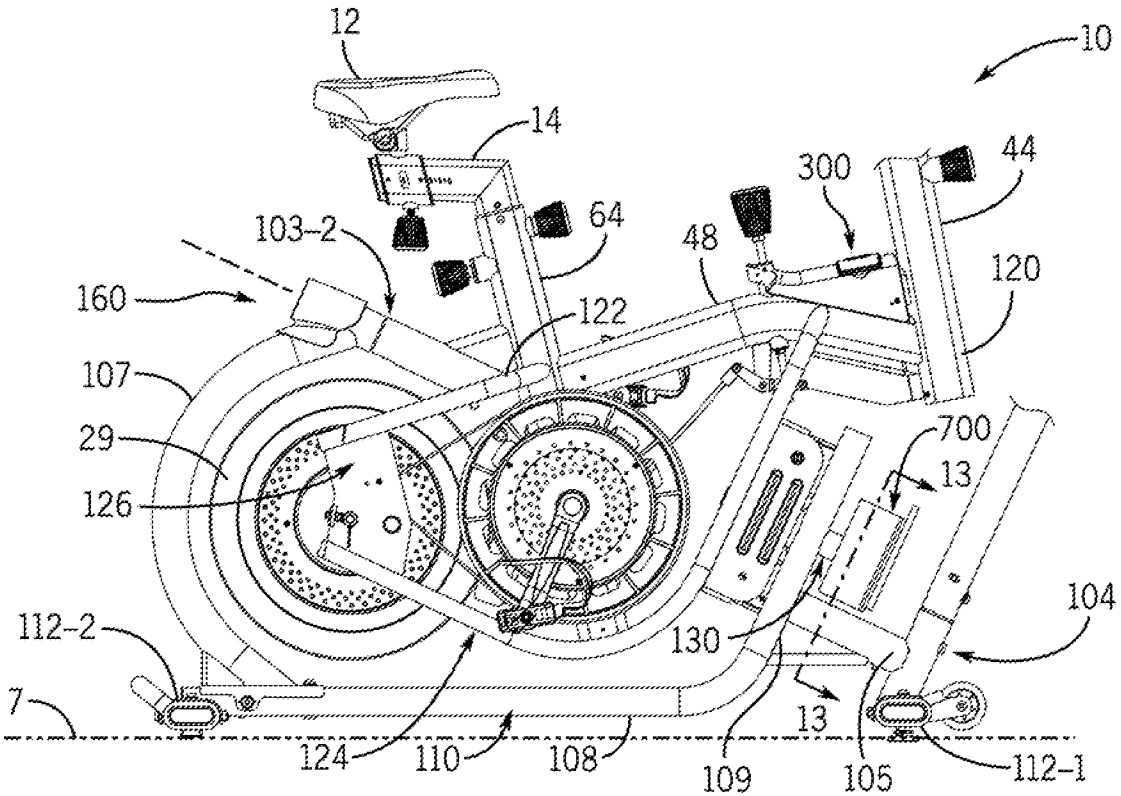
FIG. 12 show a side view of the tilt-enabled bike of FIG. 1 with a tilt-disabling mechanism according to the present disclosure.

In other embodiments, the tilt-disabling, mechanism may be implemented using any suitable brake mechanism, such as a friction brake, that is operatively associated with at least one of the pivot shafts of the bike 10. FIG. 12 shows an example of a brake 700 operatively associated with one of the pivot shafts of the bike 10, shown here as arranged to engage the front pivot shaft. The brake 700 may be configured to provide resistance, in some cases adjustably, to the rotation of one of the pivot shafts (e.g., front pivot shaft 132) and be actuatable to a position in which the brake 700 effectively prevents (or locks out) the rotation of the pivot shaft (e.g., front pivot shaft 132). In some embodiments, some forms of a tilt-disabling mechanism, such as brake 700, may be provided at each of the pivot shafts (i.e. the front pivot shaft 132 and the rear pivot shaft 162). The brake 700 may use friction as the resistive force, or it may use a different form of resistance such as magnetic resistance.

Figure 13:
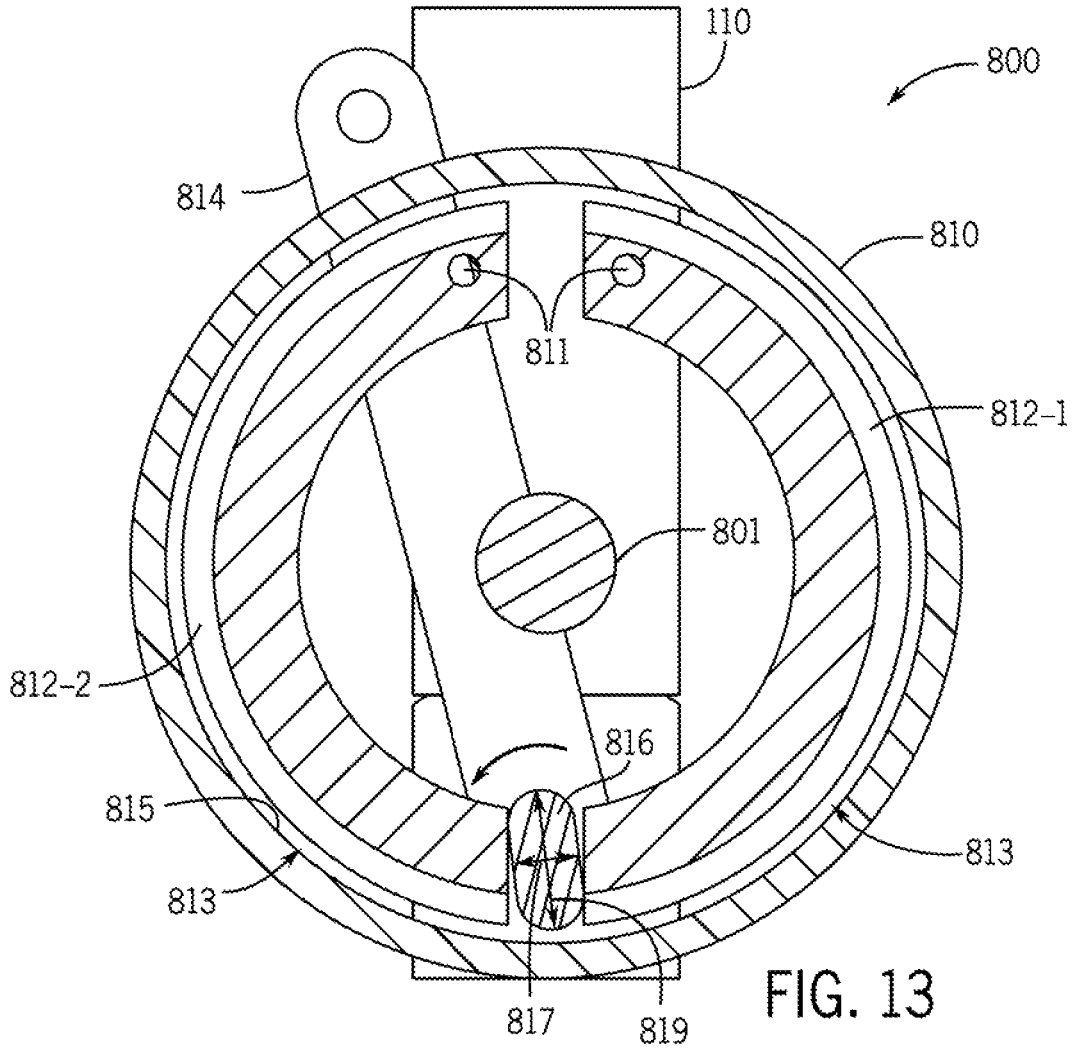
FIG. 13 shows a simplified cross-sectional view of the tilt-disabling mechanism in FIG. 12.

One embodiment of the brake 700 is shown in the illustration in FIG. 13. The drum brake 800 shown in cross-section in FIG. 13 may be used to implement the brake 700. The drum brake 800 includes a drum 810 which is shown here as a substantially cylindrical member coaxially positioned with and fixed to the pivot shaft 801 (e.g., the front pivot shaft 132 or the rear pivot shaft 162 of the bike 10). As such, the drum 810 rotates or pivots in synchrony with the pivot shaft 801 as the bike pivots or tilts from side to side. The drum brake 800 includes a pair of shoes 812-1 and 812-2, each shown here as an arcuate brake pad, which may be configured to engage substantially half of the circumference of the drum. Each of the shoes 812-1 and 812-2 is pivoted about a respective shoe pivot axis 811 such that the braking surface 813 of each shoe can be selectively positioned closer to or farther away from the interior (or braking) surface 815 of the drum 810. The shoes may be actuated between the disengaged and engaged positions using a cam 816. The cam 816 may be implemented using a non-circular (i.e. cammed) shaft or pin. In this example, the cam 816 is implemented using a pin having an oval or elliptical shape with one of its dimensions, minor diameter 817, being smaller than the other dimension, major diameter 819. In the disengaged position, the cam 816 is oriented with its narrow dimension in the arcuate (or circumferential) direction. As the cam 816 is rotated to orient its wider dimension in the arcuate (or circumferential) direction, the free ends of the shoes 812-1 and 812-2 are pushed outward toward the drum 810, causing each of the shoes to contact the interior surface 815 of the dram 810 thereby applying frictional force to the drum 810 and thus to the pivot shaft 801. The cam 816 may be actuated mechanically, such as via a lever 814, which may be fixed to the cam 816. Actuation of the shoes 812-1 and 812-2 may be achieved using any other type of local (e.g., mechanical) actuation device or remotely (e.g., via an electronic signal being transmitted to a solenoid or motor that drives the rotation of the cam 816). In other embodiments the mounting locations of the drum and the shoes may be reversed with the drum being mounted to the fixed frame and the shoes mounted to the moving frame.

Figure 14:
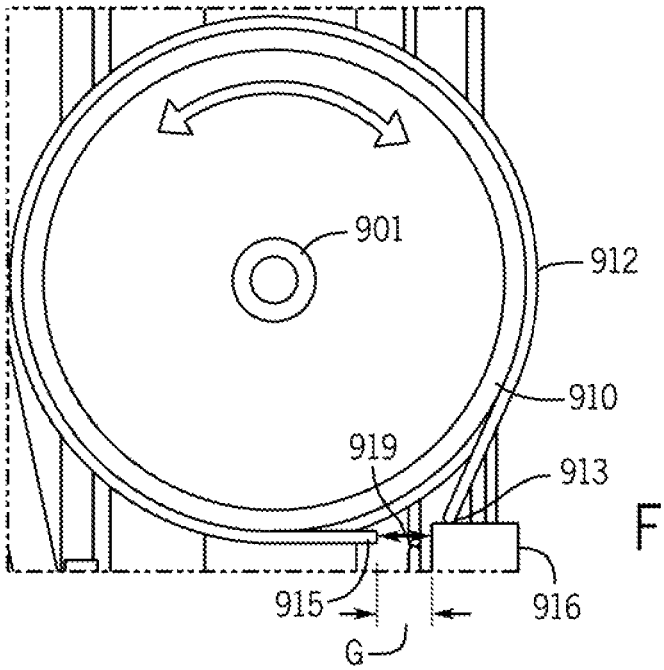
FIG. 14 shows another example of a tilt-disabling mechanism for the bike in FIG. 12

FIG. 14 shows another example of a friction brake 900 which may be used to implement the brake 700. The friction brake 900 includes a drum 910 fixed to the pivot shaft 901 (e.g., the front pivot shaft 132 or the rear pivot shaft 162 of bike 10) such that the drum 910 pivots in synchrony with the pivot shaft 901. The brake 900 also includes a flexible or bendable friction pad 912, shown here as a friction band or belt, which is wrapped, circumferentially, around the drum 910. A first end 913 of the friction pad 912 is anchored to the fixed frame, at anchor 916, which may be fixed to the fixed frame of the bike. The other end 915 of the friction pad is movable and operatively associated with an actuator (not shown) configured to move the end 915 toward and away from the first end 913, as shown by arrow 919, thereby decreasing or increasing the gap G between the two ends 913 and 915, which results in increasing or decreasing, respectively, the friction force applied by the friction pad 912 on the drum 910. In other embodiments, the mounting locations or the drum 910 and the friction pad 910 may be reversed, such as by mounting the drum 910 to the fixed frame and anchoring the friction pad 912 off the moving frame.

Figure 15:
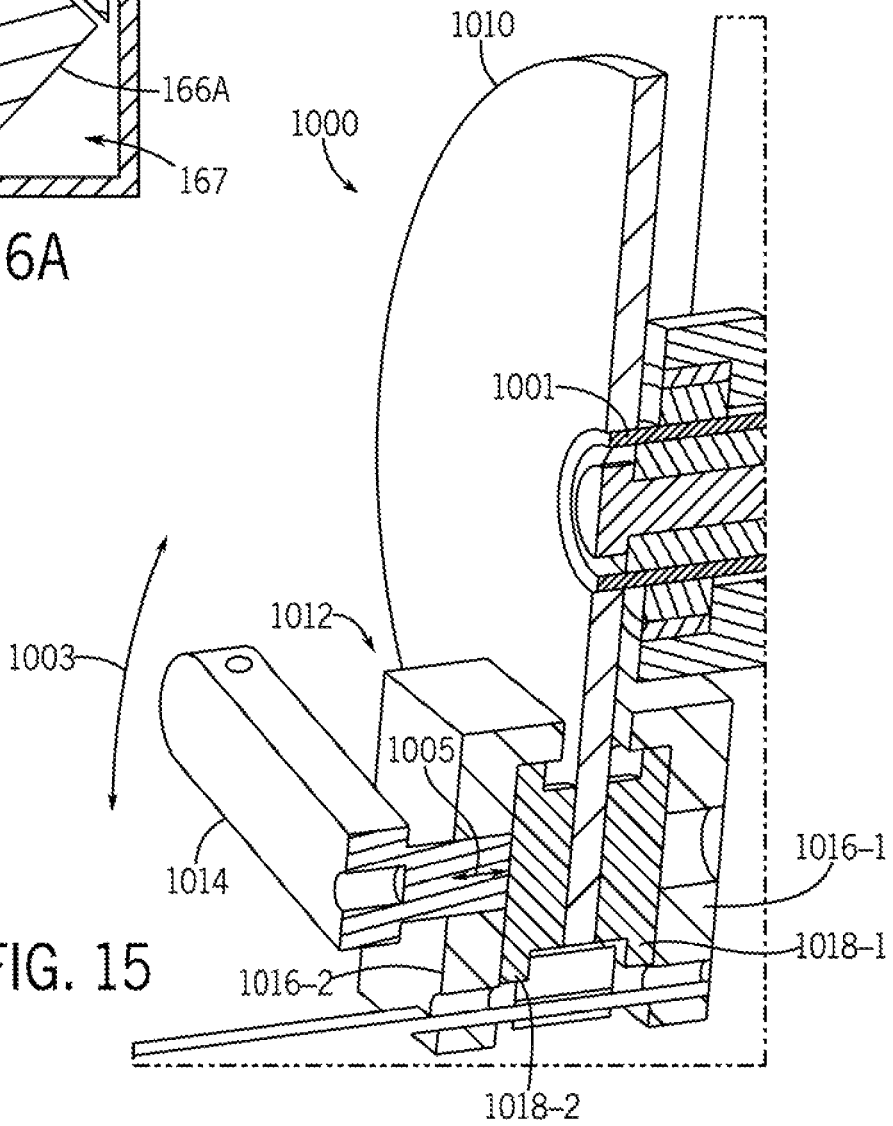
FIG. 15 shows yet another example of a tilt-disabling mechanism for the bike in FIG. 12.

FIG. 15 shows yet another example of a brake 1000 operatively engaged to resist the rotation of a pivot shaft (e.g., front pivot shaft 132 of rear pivot shaft 162) of the bike. The brake 1000 is implemented as a disk brake operatively engaged with the pivot shaft 1001 (e.g., either one of the front or rear pivot shafts 132 or 162, or an individual brake provided at each of the front or rear pivot shafts 132 and 162). The brake 1000 includes a disk 1010 fixed to the pivoting shaft 1001, and a caliper 1012 assembly operatively positioned to apply friction to the disk 1010. The caliper assembly 1012 may include a first caliper 1016-1 with a first friction pad 1018-1 fixed to the first caliper 1016-1, and a second caliper 1016-2 provided with a second friction pad 1018-2. An actuator, shown here as lever 1014, is operatively associated with one of both of the calipers 1016-1 and 1016-2 to move one or both of the calipers toward and away from the disk 1010 to increase and decrease the frictional force on the disk 1010. In this example, the lever 1014, which is actuated by pivoting it about the pivot axis, as shown by arrow 1003, is engaged, e.g., via a threaded stud 1015, to the second friction pad 1018-2 to move the second friction pad 1018-2 toward and away from the disk 1010, as indicated by arrow 1005. In other embodiments, the mounting locations of the disk 1010 and the caliper assembly 1012 may be reversed, such as by operatively mounting the disk 1010 to the fixed frame and caliper assembly 1012 to the moving frame.

Figure 16B:
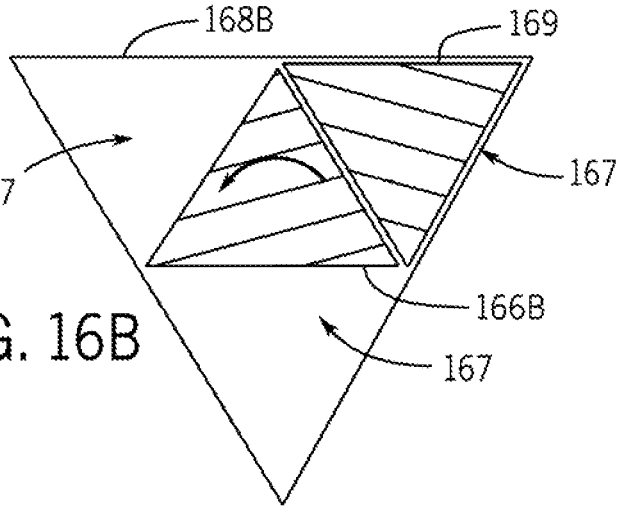
FIGS. 16A and 16B are schematic illustrations of further tilt-disabling mechanisms in accordance with the present disclosure.
Figure 16A:
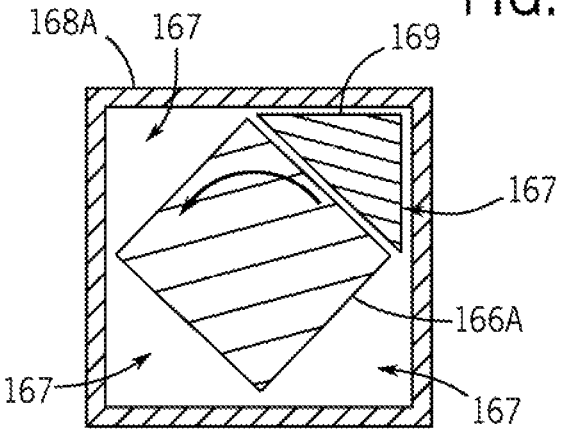
Figure 17A:
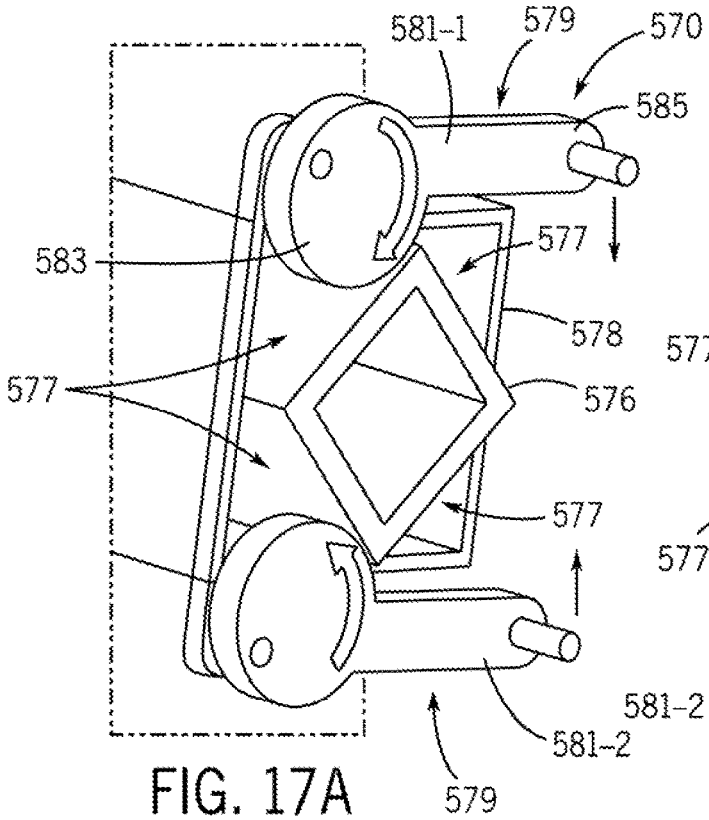
FIGS. 17A and 17B show a simplified illustration of a tilt-disabling mechanism in an engaged and disengaged state, respectively, in accordance with further examples of the present disclosure.
Figure 17B:
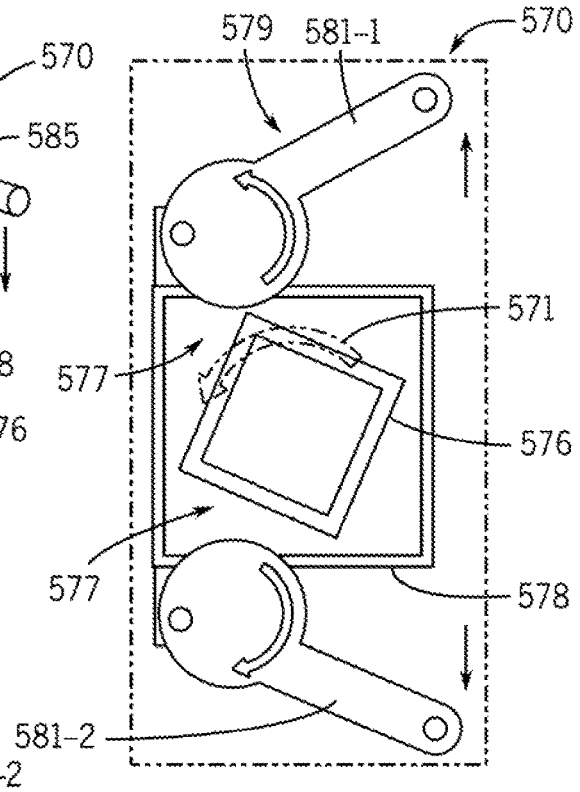

In some embodiments, at least one or both of the pivot shafts (e.g. front pivot shaft 132 and/or rear pivot shaft 162) or a portion thereof, may not be cylindrical. For example, a portion of the shaft (e.g. front pivot shaft 132 and/or rear pivot shaft 162) may have a different cross-sectional geometry (e.g., square as shown in FIGS. 16A, 17A and 17B, or triangular, as shown in FIG. 16B). The pivot shaft, shown in cross-section and indicated as 166A and 166B in FIGS. 16A and 16B, respectively, may be received in a housing 168A and 168B, which may also be non-circular. Whether circular or non-circular, the housing is large enough and or suitably shaped to accommodate rotation of the non-cylindrical shaft 166A or 166B therein. When so received within the housing, one or more pockets or cavities 167 are defined between the shaft (e.g., 166A or 166B) and the housing (e.g., 168A or 168B, respectively) when the bike is in the nominal (non-tilted) position. For example, the shaft 166A in FIG. 16A has a square transverse geometry and is rotatably received within a larger square housing 166A defining four pockets 167 in each corner of the square housing 168A when the bike is in the nominal (non-tilted) position. In the example in FIG. 16B, the shaft 166B has a triangular transverse geometry and is rotatably received within a larger triangular housing 168A defining three pockets 167 in each corner of the square housing 168A when the bike is in the nominal (non-tilted) position. In each case, the housing is sufficiently large to accommodate rotation of the smaller square or triangular shaft therein. While not shown, the square shaft 166A or the triangular shaft 166B may in other examples be rotatably received in a circular housing sufficiently large to accommodate the rotation of the non-circular shaft. The rotation of the shaft, and thus disabling of the tilting or pivoting movement of the bike may be achieved by the selective insertion of a blocking wedge 169 within one or more of the pockets 167. The blocking wedge 169 may have substantially the same shape as that of the cavity 167 within which it is to be inserted. The blocking wedge 169 may be sized and shaped to substantially fill the cavity 167 within which it is to be inserted, such that when so inserted, the rotational degree of freedom of the shaft (e.g., shaft 166A or 166B) is effectively constrained. The blocking wedge 169 may be made for a substantially rigid material or a durable rubber material with sufficient hardness to substantially prevent the rotation of the non-circular shaft (e.g., shaft 166A or 166B) relative to the housing (e.g., 168A or 168B, respectively).

FIGS. 17A and 17B show an example of a tilt-disabling mechanism 570 operatively associated with a non-circular pivot shaft, shown here as a square pivot shaft 576. The pivot shaft 576 is rotatably received within a housing 578, which is sufficiently large and/or so shaped as to accommodate the pivoting of the pivot shaft 576, shown in this example as also being square. The dimension of the square shaft 576 along the diagonal of the square is less than a dimension of the square housing 578 measured along the length of the square so as to accommodate rotation of the shaft 576 therein (as indicated by arrow 571). When the bike is in the nominal (un-tilted) position, the shaft 576 is oriented relative to the housing 578 such that the corners of the square shaft 576 point towards the wall of the square housing 578, e.g., to a position midway between the corners of the square housing 578, such as to define pockets 577 between the shaft 576 and the housing 578.

The tilt-disabling mechanism 570 includes one or more locking members 579, shown here as first and second pivoting levers 581-1 and 581-2, respectively. Each locking member 579 (e.g., each of the levers 581-1 and 581-2) is movable between an engaged position in which a locking member 579 interferes with rotation of the pivot shaft 576 (as shown in FIG. 17A), and a disengaged position in which the locking member 579 does not interfere with rotation of the pivot shaft 576 (as shown in FIG. 17B). In the present example, each of the locking members is pivotally coupled to the fixed frame (e.g., to the housing 178) and includes a cam 583, at least a portion of which is positioned in a respective pocket 577 when the locking member is pivoted to the engaged position. In some embodiments, the cam 583 may be located opposite an actuation end 585 of the pivoting lever, such as at near the pivot axis of the lever. In other embodiments, the locking members 579 may be differently implemented, such as by using one or more movable wedges, e.g., insertable into a respective pocket along the axial direction of the shaft 176.

In other embodiments, the tilt-disabling mechanism (e.g., locking mechanism 200) may be implemented using a pin-and-hole locking mechanism. A protruding structure or pin may be coupled to one of the fixed frame and the moving frame, and a receiving feature or hole may be provided on the other one of the fixed frame or the moving frame. The pin and hole may be operatively associated with the respective frame to enable insertion of the pin into the hole, such that when so engaged, relative movement between the moving and fixed frames is substantially prevented. The pin and hole may be arranged such that insertion of the pin into the hole occurs in a direction that lies in a plane parallel to the fixed plane 5, which includes the fixed plane itself. Thus, when so inserted into the hole, the pin may in effect create a rigid link between the moving frame and the fixed frame which lies in a plane parallel to the fixed plane S.

Figure 18:
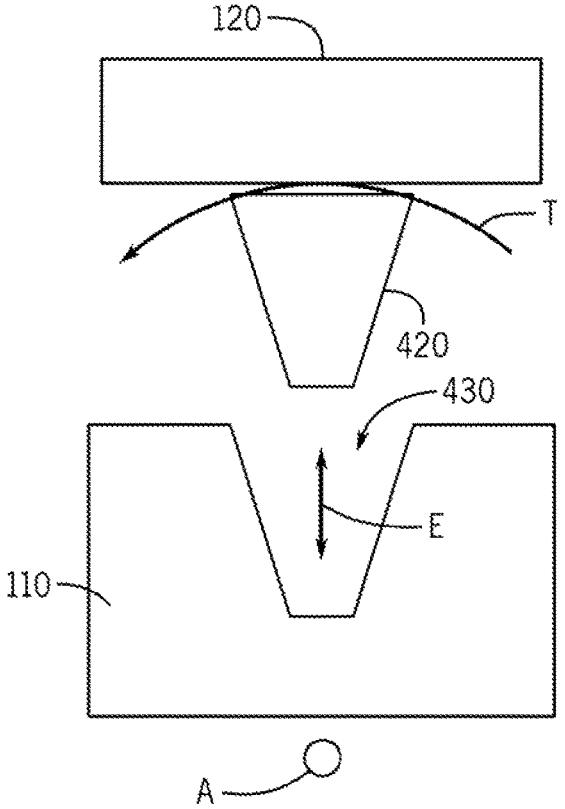
FIG. 18 is a schematic illustration of a pin-in-hole tilt-disabling mechanism in accordance with the present disclosure.

As shown, for example in FIG. 18, a protruding structure or simply protrusion 420, shown here as a tapered pin may be coupled to the moving frame 120. An aperture or recess, which acts as the receiving feature or hole 430, may be located on the fixed frame 110. In some embodiments, the protrusion 420 may extend from the moving frame 120 in a direction toward the tilt axis A. The protrusion 420 and the receiving features 430 may be coupled to the moving frame 120 and the fixed frame 110, respectively, in a manner that allows repositioning the protrusion 420 and/or the receiving feature 430 between an engaged position and a disengaged position. The engaged position is a position in which the protrusion 420 is engaged (i.e. is at least partially within) the receiving feature 430 and the disengaged position, as shown in FIG. 18, is a position in which the protrusion 420 is not engaged with (i.e. is not in) the receiving feature 430. In some examples, the protrusion may be fixed to the moving frame 120 such that it tilts from side to side, as shown by arrow T, when the moving frame pivots or tilts about the axis A. In some such examples, the receiving feature 430 may be formed on or otherwise provided in a component (e.g., a rigid member) of the fixed frame 110, and the component that includes the receiving feature 430 may be movably coupled to the fixed frame 110 such that it is selectively movable along direction E for repositioning it between the engaged and disengaged positions. In other examples, the receiving features 430 may remain fixed, while the protrusion 420 instead is movable (along direction E) to selectively move it between the engaged and disengaged positions.

Figure 19A:
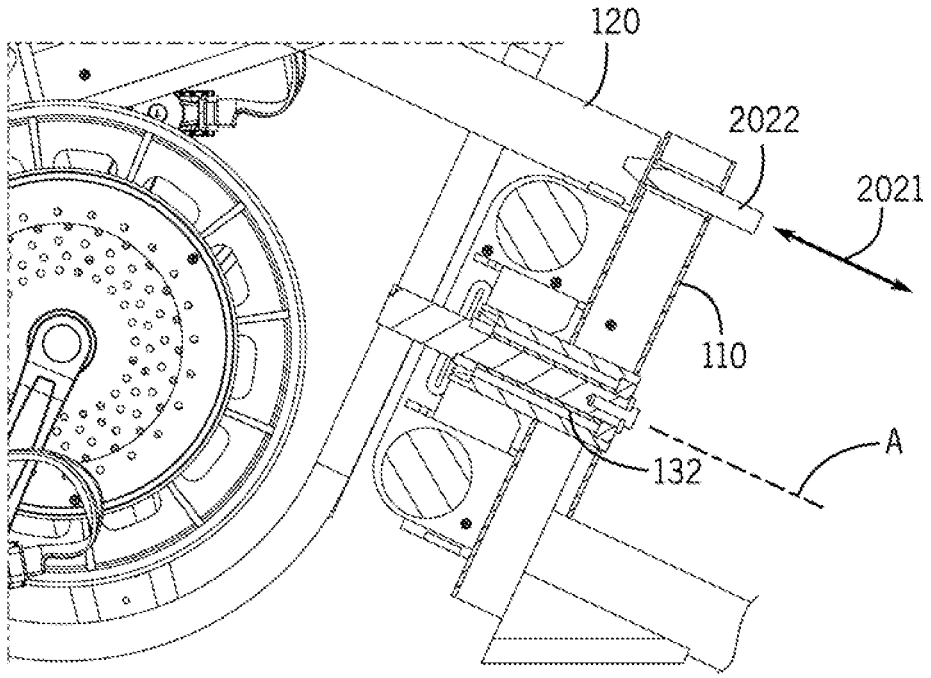
FIGS. 19A and 19B show further examples of pin-in-hole tilt-disabling mechanisms for a tilt-enabled bike according to the present disclosure.

Another example of a pin-and-hole locking mechanism is show in FIG. 19A. In this example, a pin 2022 is coupled to the fixed frame 110, with the length of the pin 2022 extending in a plane parallel to the fixed plane S. The pin 2022 is movably coupled to the frame 110 such that it can be selectively actuated in the direction 2021, which is shown here as substantially parallel to the axis of the front pivot shaft 132, and is thus also parallel to pivot axis A. The pin 2022 may be slidably coupled to a slot in the fixed frame (e.g., a slot in the upward extension 109). A receiving feature or hole is provided on the moving frame 120 to receive the pin 2022. The hole is aligned to receive the pin when the bike 10 is in the neutral (untilted) position. For example, the pin 2022 and its cooperating hole may lie in the fixed plane S and mid-plane M, respectively and may thus align with one another to lock the bike 10 in the neutral position. In other examples, the pin and hole may lie in a different plane which may be parallel to the fixed plane S. Also, the pin 2022 need not be actuated along the direction of the pivot axis A.

Figure 19B:
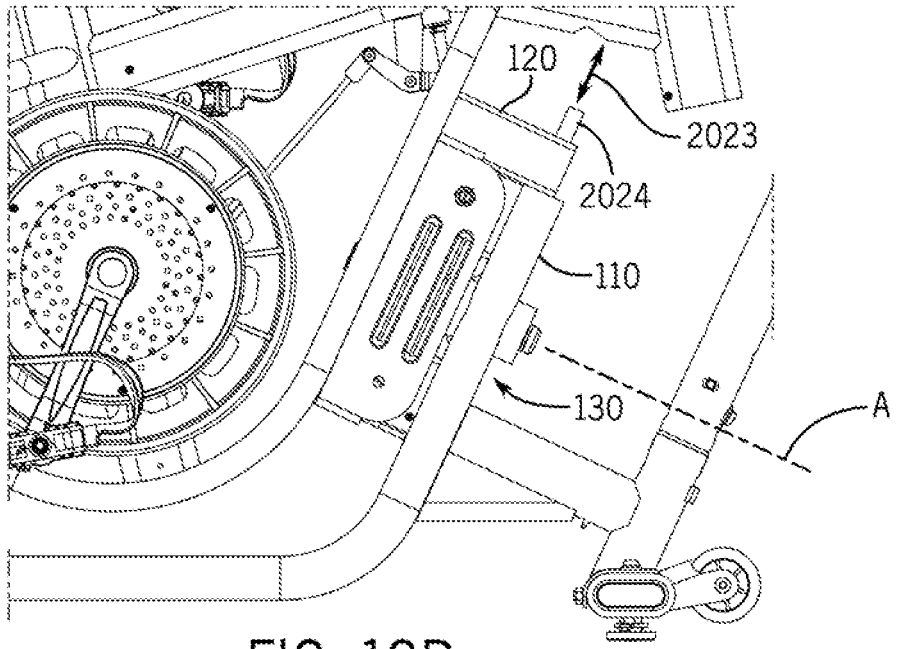
Figure 20D:
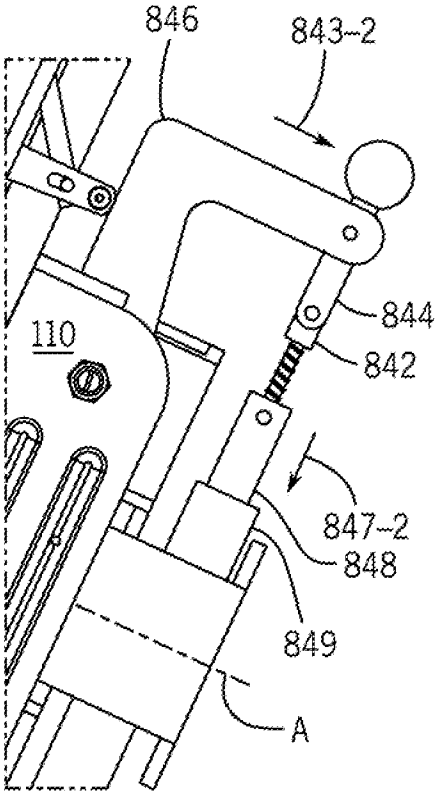
FIG. 20D is a side view of the tilt-disabling mechanism of FIG. 20A, shown in the engaged position.
Figure 20C:
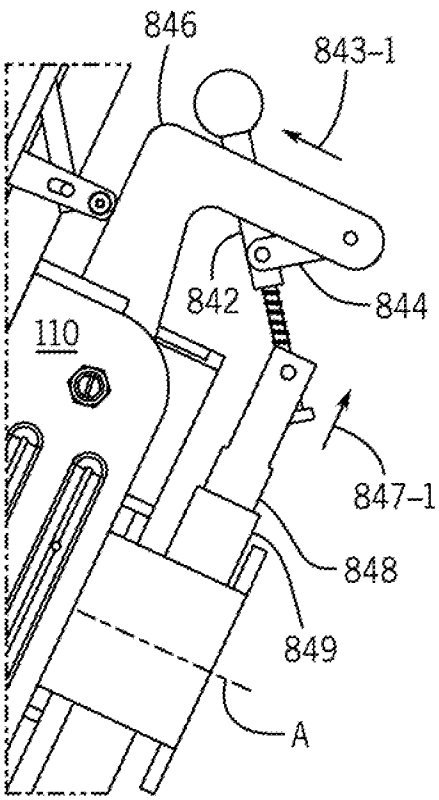
FIG. 20C is a side view of the tilt-disabling mechanism of FIG. 20B in the disengaged position.
Figure 20B:
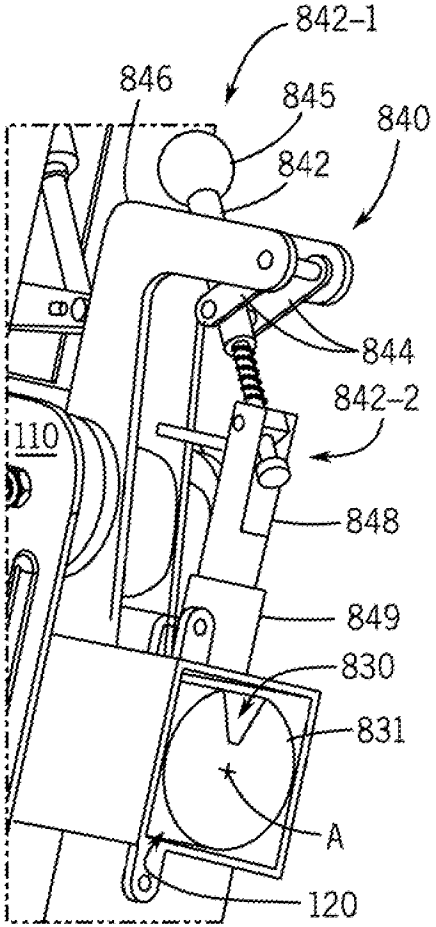
FIG. 20B is an isometric view of the tilt-disabling mechanism of FIG. 20A, shown in the disengaged position.
Figure 20A:
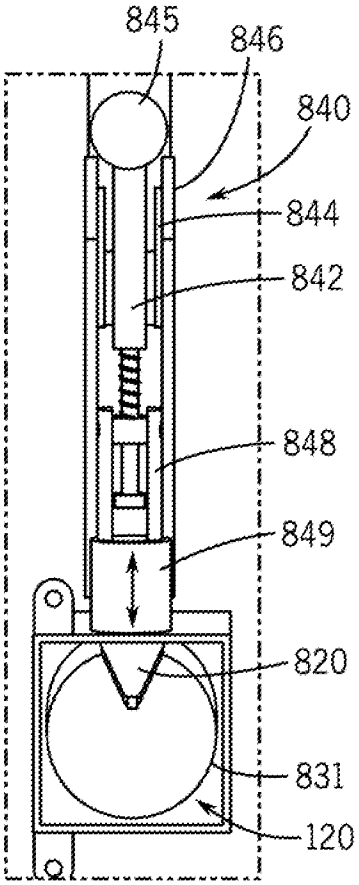
FIG. 20A is a front view of yet another example of a tilt-disabling mechanism, shown in the engaged position, for a tilt-enabled bike according to the present disclosure.

Referring to the example in FIG. 19B, the pin may be actuated in a direction angled (e.g., a perpendicular direction 2023) to the pivot axis A. The pin 2024 in this example is movably (e.g., slidably) coupled to the moving frame 120 and is configured for engagement with a hole provided on the fixed frame 110. While the pin-and-hole locking mechanisms of these examples are shown as associated with the front pivot joint 130, in other examples, similar pin-and-hole locking mechanisms may be provided elsewhere between the moving and fixed frames, such as proximate to the rear pivot joint of the bike 10.

FIGS. 20A-D show yet another example of a pin-and-hole locking mechanism. In this example, the receiving end (e.g., hole 830) of the locking mechanism is provided in block 831 attached to one of the pivot shafts, in this case the front pivot shaft 132. As such, the hole 830 in this example is on the moving frame 120. The hole 830 is shown here as a groove extending along the top side of the block 831. However, in other embodiments, the hole 830 may be differently configured or positioned with respect to the moving frame. The insertable end (e.g., the pin 820) is provided on the fixed frame 110 and is configured to be actuated toward and away from the receiving end (e.g. the hole 830). The pin 820 is movable toward and away from the pivot shaft, and in this example, moving substantially perpendicularly to the pivot axis A.

The pin 820 is actuatable towards and away from the hole 830 by a linkage 840. In the illustrated example in FIGS. 20A-D, the linkage 840 includes an actuation link 842, a fixed link 846, and a connecting link 844 pivotally coupling the actuation link 842 to the fixed link 846. The actuation link 842 has an actuation end 842-1, which may be configured for manual actuation such as by including a handle 845 (e.g., a round or differently shaped knob). The opposite end 842-2 of the actuation link 842 is operatively coupled to the pin 820 via a slider link 848. The slider link 848 is constrained to translate or slide in a direction toward the tilt axis A such as by being slidably received within a cylinder 849 that extends in a direction substantially perpendicular to the tilt axis A. The pin 820 is fixed to the free end of the slider link 848. To operate the locking mechanism, the user applies a force on the actuation link 842, e.g., in the direction shown by arrow 843-1, which causes the slider link 848 to move away from the tilt axis A, out of cylinder 849 in the direction show by arrow 847-1, thereby causing the pin 820 to move away from the hole 830 disengaging the locking mechanism. Conversely, to lock out the tilting or pivoting movement of the bike, the user actuates the actuation link 842 in the opposite direction, as shown by arrow 843-2, which causes the link 842 to return to center, pushing the slider link 848 into the cylinder 849 and toward the tilt axis A (as shown by arrow 847-2), thereby causing the pin 820 to engage the hole 830, when the bike is in the centered (un-tilted) position. The linkage 840 may be an over-center linkage in that it may be configured to be actuated in either direction, e.g., by pulling the handle 845 from the center position shown in FIG. 20D toward the bike (in the direction of arrow 843-1) or by pushing the handle 845 from the center position in FIG. 20D away from the bike (in the direction of arrow 843-2). The linkage may be bi-stable, e.g., on either side of the center position in FIG. 20D, to maintain the locking mechanism in the disengaged position (of either FIG. 20C or in the opposite direction) until further actuated by the user.

Figure 22B:
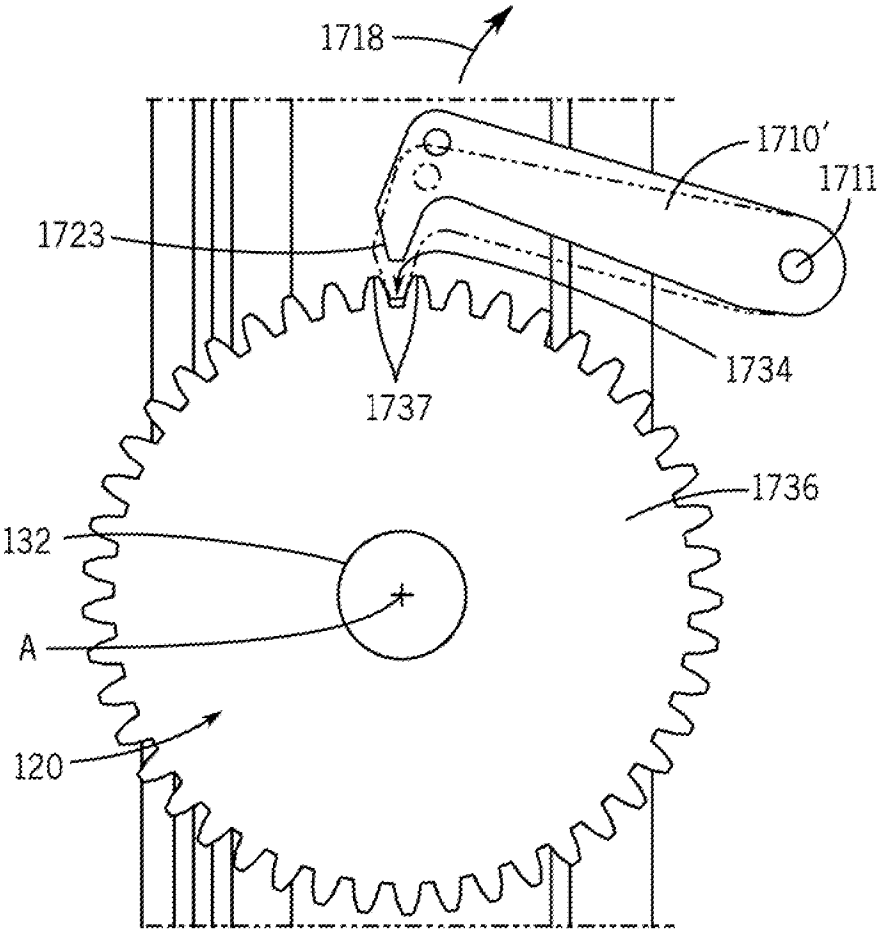
FIGS. 22A and 22B show simplified illustrations of further examples of a tilt-disabling mechanism.
Figure 22A:
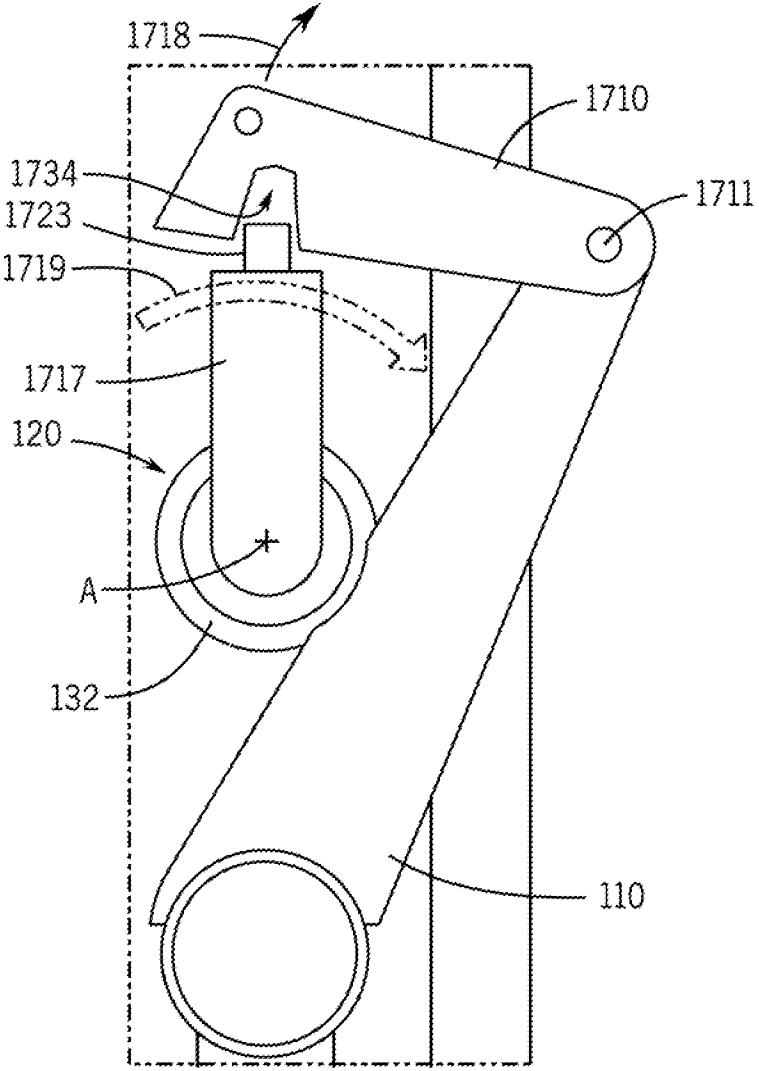

FIGS. 21A and B and FIGS. 22A and B show examples of tilt-disabling (or locking) mechanisms which use one or more pawls operatively positioned between the fixed and the moving frames. Such locking mechanisms may include a first engagement member and a second engagement member that are operable to interlock with one another. For example, one of the first and second engagement members may include at least one protrusion, and the other one of the first and second engagement members (e.g., one or more pawls) may define an engagement recess that receives the protrusion thereby interlocking the two engagement members.

FIGS. 21A and B illustrate an example of a tilt-disabling or locking mechanism that can be used for locking out the tilting or leaning movement of the bike 10. The locking mechanism 1700 includes a first engagement member 1720, which may be provided on one of the fixed frame 110 or the moving frame 120. The first engagement member 1720 includes a protrusion 723, which may extend in a direction that is generally parallel to the fixed plane S. The locking mechanism 1700 further includes a second engagement member 1712, which may be provided on the other one of the fixed frame 110 or the moving frame 120. As such, when the locking mechanism 1700 is disengaged, the first engagement member 1720 moves relative to the second engagement member 1712 whenever the moving frame 120 of the bike pivots or tilts about axis A. The second engagement member 1712 may include one or more rigid links, in this example including a pair of rigid links 1710, referred to here as pawl links 1710. Each of the pawl links 1710 has one end pivotally coupled, at pivot point 1711, to the moving or fixed frame. The pivot points 1711 of the pawl links 1710 of the present example are located on opposite sides of the first engagement member 1720. A step or ledge is defined along the length of each link 1710. The two links 1710 may be operatively coupled to one another (e.g., via a sliding pin joint 1713) at the location of the ledges such that together, the two pawl links 1710 define an engagement recess 1734 sized to receive the protrusion 1723 of the first engagement member 1720. The links 1710 may be actuated at the opposite end from the pivot point 1711, referred to here as actuation end 1702. As shown, when a force is applied to the actuation ends 1702 of the links, as indicated by arrow 1731, which in some embodiments occurs in unison, the two link 1710 pivot, in opposite directions, about the pivot point 1711, causing the engagement recess 1734 to lift away from the protrusion 1723. Conversely, when the links 1710 are actuated toward the first engagement member 1702 and are thus pivoted in their respective opposite directions, the engagement recess 1734 is brought into engagement to receive the protrusion 1723. A single actuator may be used to actuate the ends 1072 of both links, or more than one actuator (e.g., a pair of actuators) may be operatively engaged with a respective one of the actuation ends 1072 to move that actuation end 1702, typically in unison with the other. In other embodiments, an actuator may actuate the two one or more links 1710 by applying a force at an intermediate position along the length of the link 1710, such as near the recess 1734. For example, in the case of two links 1710, the two links may be actuated at once by applying a force at the pin joint 1713 (e.g., in the direction shown by arrow 1715). The one or more actuators may be coupled to the links 1710 compliantly, such as via a respective spring, which may provide certain advantages as described herein.

In other examples, the actuation may be via one or more additional rigid links pivotally connected at the actuation ends 1702 of the pawl links.

Other arrangements of locking mechanisms including one or more pawls may be used in other examples. FIGS. 22A and 22B show embodiments using a single pawl link each of which is coupled to the fixed frame 110 and which cooperate with a protrusion 1723 on the moving frame 120 to lock out the tilting movement of the hike. The mounting locations of the pawl and protrusion may be reversed in other embodiments. In the embodiment in FIG. 22A, the protrusion 1723 is provided at a free end of a bar 1717 which is fixed to one of the pivot shafts (e.g., front pivot shaft 132) of the bike 10. Here, the bar 1717 extends radially from the pivot shaft 132 and thus in a direction substantially perpendicular to the pivot axis A. The bar 1717 is arranged such that its longitudinal direction is substantially aligned with the mid-plane of the moving frame (e.g., plane M). The pal link 1710 defines the engagement recess 1734, which is configured to receive the protrusion 1723 at least therein whereby engagement between the pawl link 1710 and the protrusion 1723 (by the positioning of the protrusion 1723 within the recess 1734) interferes with the rotation of the pivot shaft substantially locking the moving frame 120 in a position in which the mid-planes M and S of the moving and fixed frame, respectively, are substantially aligned. In the example in FIG. 22B, the location of the protrusion 1723 and the recess 1734 are reversed, with the recess 1734 being provided by a trough defined between a pair of teeth on a toothed disk 1736 (e.g., a gear) and the protrusion 1723 being provided by the pawl end of the pawl link 1710'. In the example in FIG. 22B, the toothed disk 1736 is rigidly mounted to the moving frame 120, coaxially arranged and fixed to the forward end of the front pivot shaft 132 such that as the moving frame 120 tilts from side to side (i.e., pivots about axis A), the disk 1736 pivots about axis A in synchrony with the pivoting of the moving frame 120, and more specifically in synchrony with the pivoting of the shaft 132 about axis A. Like the prior examples, the pawl link 1710' is pivotally coupled at pivot point 1711 and actuatable away from the disk 1736 (as shown in FIG. 22B, by arrow 1718) to disengage the tilt-locking mechanism, and toward the disk 1736 to engage the tilt-locking mechanism (as shown in phantom line in FIG. 22B). The disk 1736 may include a plurality of teeth as shown in FIG. 22B, which may enable the moving frame to be lockable in a plurality of different positions, including the nominal (un-tilted) position, and one or more positions in which the moving frame is tilted relative to the fixed frame. In some embodiments, the disk 1736 may be provided with only a subset of the teeth shown in the example in FIG. 22B, so as to define only a subset of possible tilt-disabled positions. In some embodiments, the disk 1736 may include only a pair of teeth (e.g., the adjacent teeth 1737) that define a recess 1734 for locking the bike only in the nominal (un-tilted) position.

Figure 24:
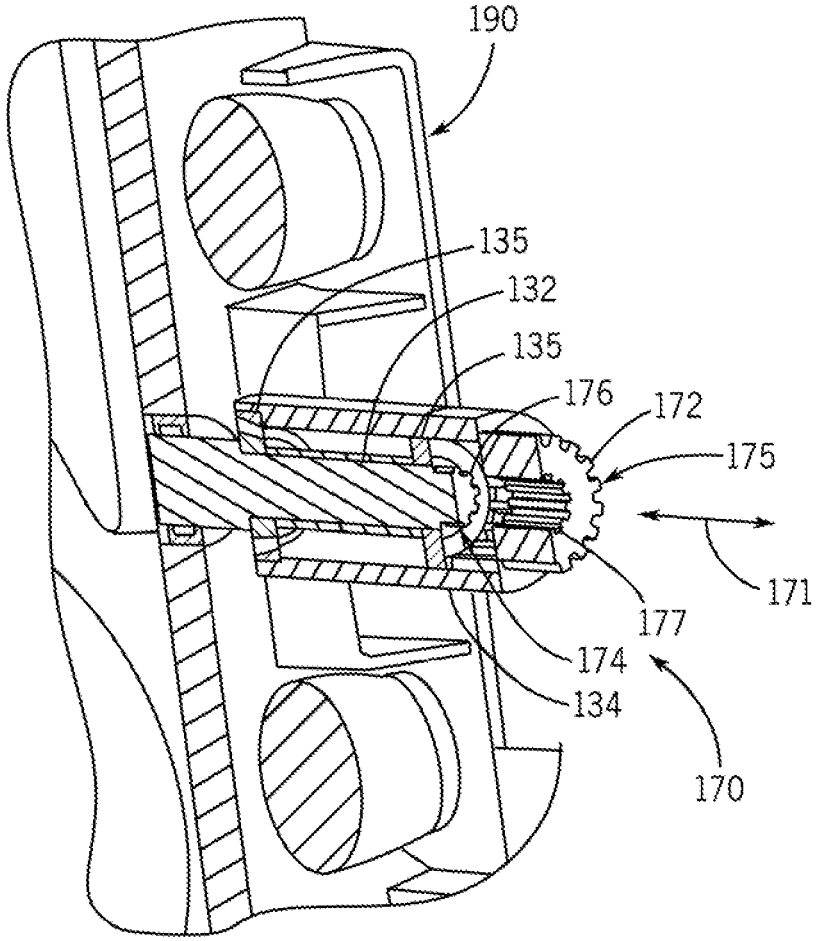
FIG. 24 shows a simplified cross-sectional view of a tilt-disabling mechanism according to further examples herein.
Figure 25:
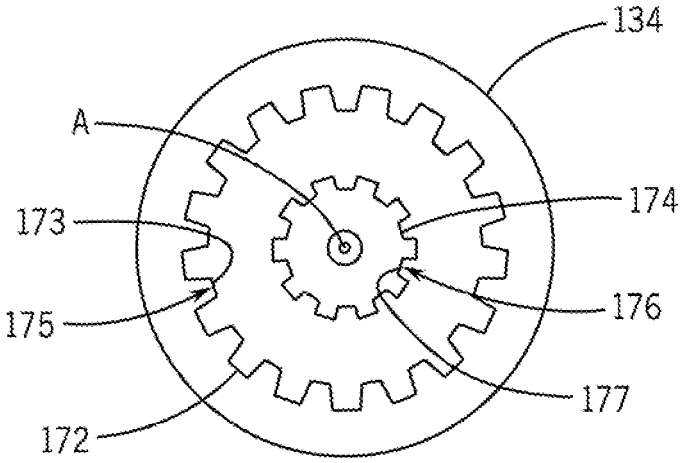
FIG. 25 is a view of the tilt-disabling mechanism of FIG. 24 viewed along the axial direction.

FIGS. 24 and 25 show yet another example of a tilt-disabling or locking mechanism which is operatively associated with a pivot shaft (e.g., the front pivot shaft 132 or the rear pivot shaft 162) that pivotally couples the moving frame 120 to the fixed frame 110. The tilt-disabling mechanism 170 in the example in FIGS. 24 and 25 uses coaxially arranged interlocking shaft components to substantially lock-out the rotation of the shaft, in this case the front pivot shaft 132, although in other examples, this type of locking mechanism may be associated with another pivot shaft (e.g., the rear pivot shaft) if one is used. The looking mechanism 170 may include a locking member 172 movably (e.g., slidably) received within the housing 134 that also houses the pivot shaft, in this case the front pivot shaft 132. The locking member 172 is positioned coaxially with respect to the pivot shaft 132 and is configured to move longitudinally, along direction 171 which coincides with the axis of the shaft 132 and thus the tilt axis A, within the housing 134 between an engaged position and a disengaged position. In the engaged position, the locking member 172, which is shown here as an annular ring with inner and outer shaped surfaces referred to as inner and outer interfaces 177 and 175, respectively, is positioned to at least partially overlap a free end of the shaft 132.

With continued reference to FIGS. 24 and 25, the pivot shaft 132 is fixed, at one end, to the moving frame 120, has a free end which includes an engagement interface 176, implemented here a splined (e.g., toothed) outer surface. The inner interface 177 of the locking member 172 is shaped for a cooperating fit with the engagement interface 176 of the shaft 132. In the present examples, the inner interface 177 of the locking member 172 is shaped essentially as a negative image to the engagement interface 176 such that when the locking member 172 is positioned over the shaped end of the pivot shaft 132 to overlap the shaped end, the engagement interface 176 and the inner interface 177 interlock (or mesh) with one another. This interlocking interferes with the rotation of the pivot shaft 132. While the interlocking faces of the pivot shall 132 and the locking member 172 are shown as splined (e.g., toothed) surfaces, the interface may be differently implemented in other examples, such as using a key and keyway, a differently shaped spline, one or more wedges as in the example in FIGS. 16A and B, meshed gears, angular contact faces, etc. The locking member 172, when in the engaged position in which the its inner interface is interlocked with the engagement interface of the shaft, may be restrained from rotation about axis A by a similar engagement between its outer interface 175 and the inner surface of the housing 134. For example, the outer surface of the locking member 172 and the inner surface of the housing 134 may be similarly shaped for a cooperating (in this case interlocking) engagement between correspondingly shaped angular contact faces. The interlocking may be achieved through meshing of gears, key-keyway interlocking, splined, tapered, or other angular contact surfaces that restrict relative rotational movement between the locking member 172 and the fixed housing 134.

Figure 26A:
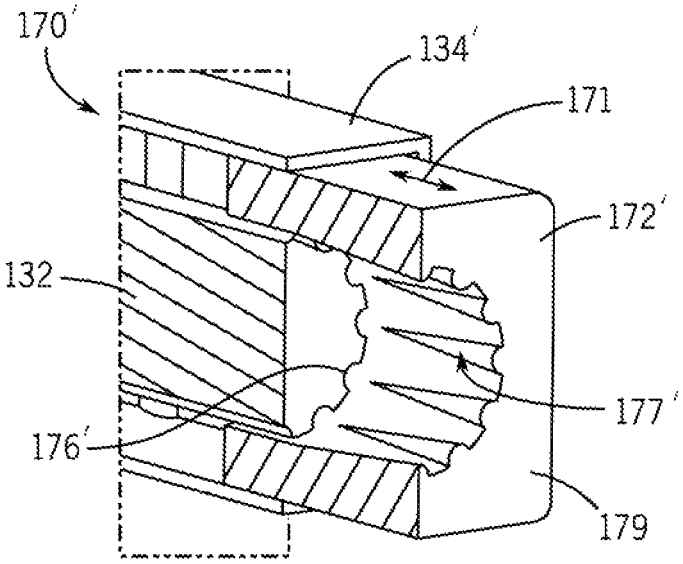
FIGS. 26A and 26B show a tilt-disabling mechanism according to further examples herein.
Figure 26B:
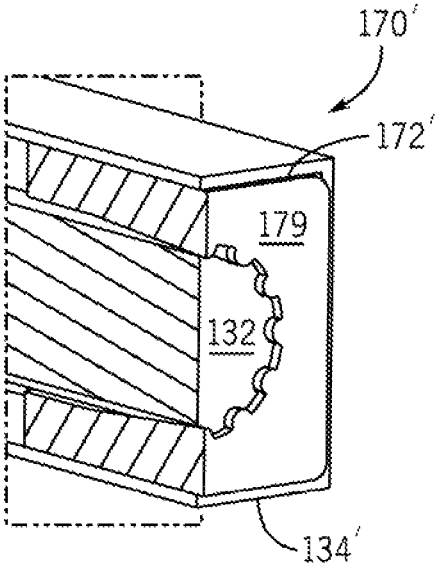
Figure 27A:
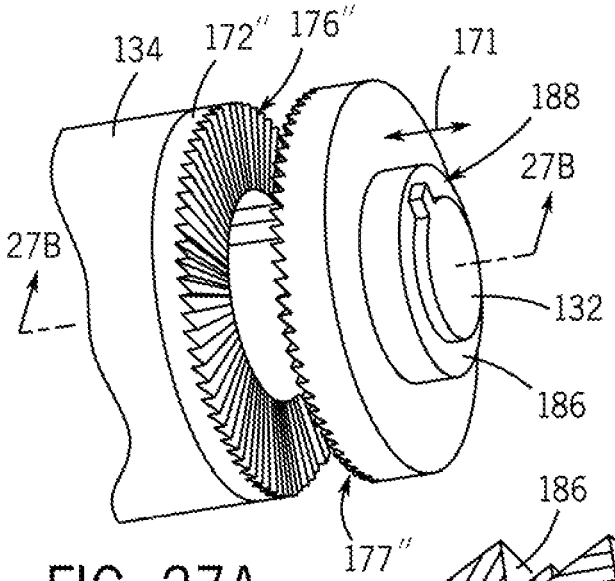
FIGS. 27A-27C show a tilt-disabling mechanism according to yet further examples of the present disclosure.
Figure 27C:
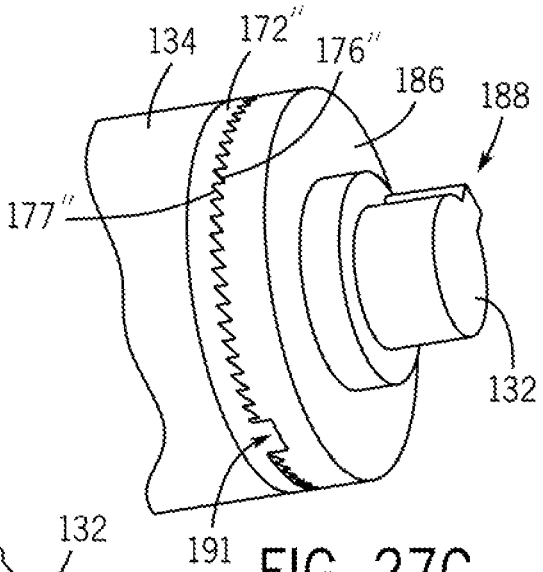
Figure 27B:
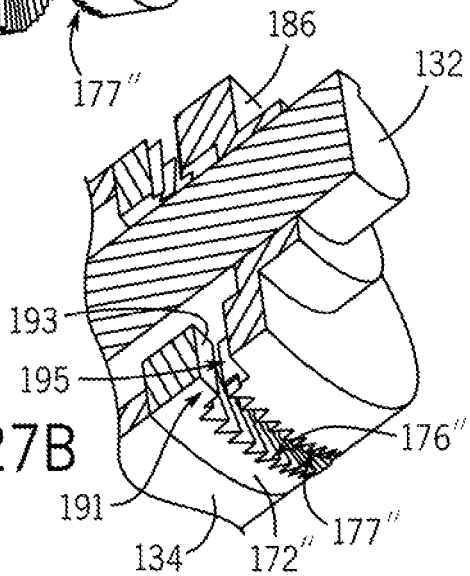

Other examples of interlocking shaft type locking mechanisms are shown in FIGS. 26A and 26B, as well as FIGS. 27A through C, in the example in FIGS. 26A and 26B, a pivot shaft of the bike (e.g., front pivot shaft 132) has an engagement interface 176', shown here as a tapered spline surface. The engagement interface 176' is defined by a portion of the outer surface of the pivot shaft 132 at a free end of the pivot shaft 132. Unlike the example in FIG. 24, the shaped portion of the surface that provides the engagement interface 176' tapers to the nominal shape of the shaft (e.g., cylindrical) along the length of the shaft (from the free end towards the pivotal joint that pivotally suspends the moving frame 120). The engagement interface 176' cooperates with a locking member 172'. The locking member 172', which may be a block 179, is movable along the axial direction of the shaft (indicated by arrow 171) but is otherwise keyed to the housing 134' so as to be non-rotatably received in the housing 134'. In the illustrated example, both the housing 134' and the block 179 have a generally rectangular shape, which prevents rotation of the block 179 relative to the housing 134'. In other examples, the block 179 may be differently keyed to the housing 134' so as to movably (e.g., slidably) but non-rotatably couple the locking member 172' to the housing. The locking member 172' (e.g., block 179) may be moved along the axial, direction toward and away from the shaped end of the shaft 132 to respectively engage (see FIG. 26B) and disengage (see FIG. 26A) the tilt-locking mechanism 170'. To operate the locking mechanism 170', the locking member 172' (e.g., block 179 is moved (e.g., pushed) toward the shaft 132 to a position in which the shaped surface of the locking interface 177' of the locking member 172' with the engagement interface 176', as shown in FIG. 26B, thereby interfering with the rotation of the shaft 132. To disengage the locking mechanism 170', the locking member 172' is moved in the opposite direction (e.g., pulled away from the shaft along the axial direction). Referring to FIGS. 27A-C, the interlocking of the shafts may be achieved through interlocking of surfaces arranged at a different orientation with respect to the axial direction of the shaft. For example, a first engagement surface 176" may be provided on a first locking member 172", which in this example is mounted to the fixed frame 110, and more specifically fixed to the housing 134. The first locking member 172" may be implemented as an annular ring which is arranged to position the first engagement surface 176" transversely to the axial direction 171 of the shaft. A second engagement surface 177" is operatively associated with the shaft 132. The engagement surface 177" is also oriented transversely to the axial direction 171 and is arranged to face the first engagement surface 176". The second engagement surface 177" is provided on a second locking member 186, which is movably (e.g., slidably) but nor-rotatably mounted to the shaft 132. The second engagement surface 177" may be keyed to the shaft 132 via key feature 188 to ensure that the second locking member 186 does not rotate relative to the shaft 132. The second locking member 186 may be operatively associated with an actuator for moving the second locking member 186, and thus the second engagement surface 177", along the axial direction 171 between an engaged position (see FIG. 27C) and a disengaged position (see FIGS. 27A and 27B). The first and second engagement surfaces 176" and 177", respectively, have cooperating surface features that mesh or interlock with one another when the surfaces 176" and 177' are brought into contact with one another. The meshing or interlocking of the surfaces 176" and 177" of the locking mechanism 170" substantially prevents any relative movement of the two surfaces and thus of the moving frame 120 relative to the fixed frame 110. The locking mechanism 170" may include an alignment or centering feature 191 that prevents engaging the locking mechanism 170" unless the moving frame 120 (e.g., shaft 132) is in a predetermined position with respect to the fixed frame (e.g., housing 134), for example in the nominal (un-tilted) position. The centering feature 191 may be implemented using a protrusion (or male feature) 193 located on one of the two engagement surfaces, shown here on the first engagement surface 176", and a recess (or female features) 195 configured to receive the protrusion 193 and located on the other one of the two engagement surfaces. The location of the male and female features may be reversed in other examples. In other embodiments, multiple alignment features may be provided at a plurality of radial positions along the two surfaces 176" and 177" to enable locking or engaging the tilt-lock mechanism 170" in more than one position (e.g., in the un-tilted and at least one tilted position).

Figure 28:
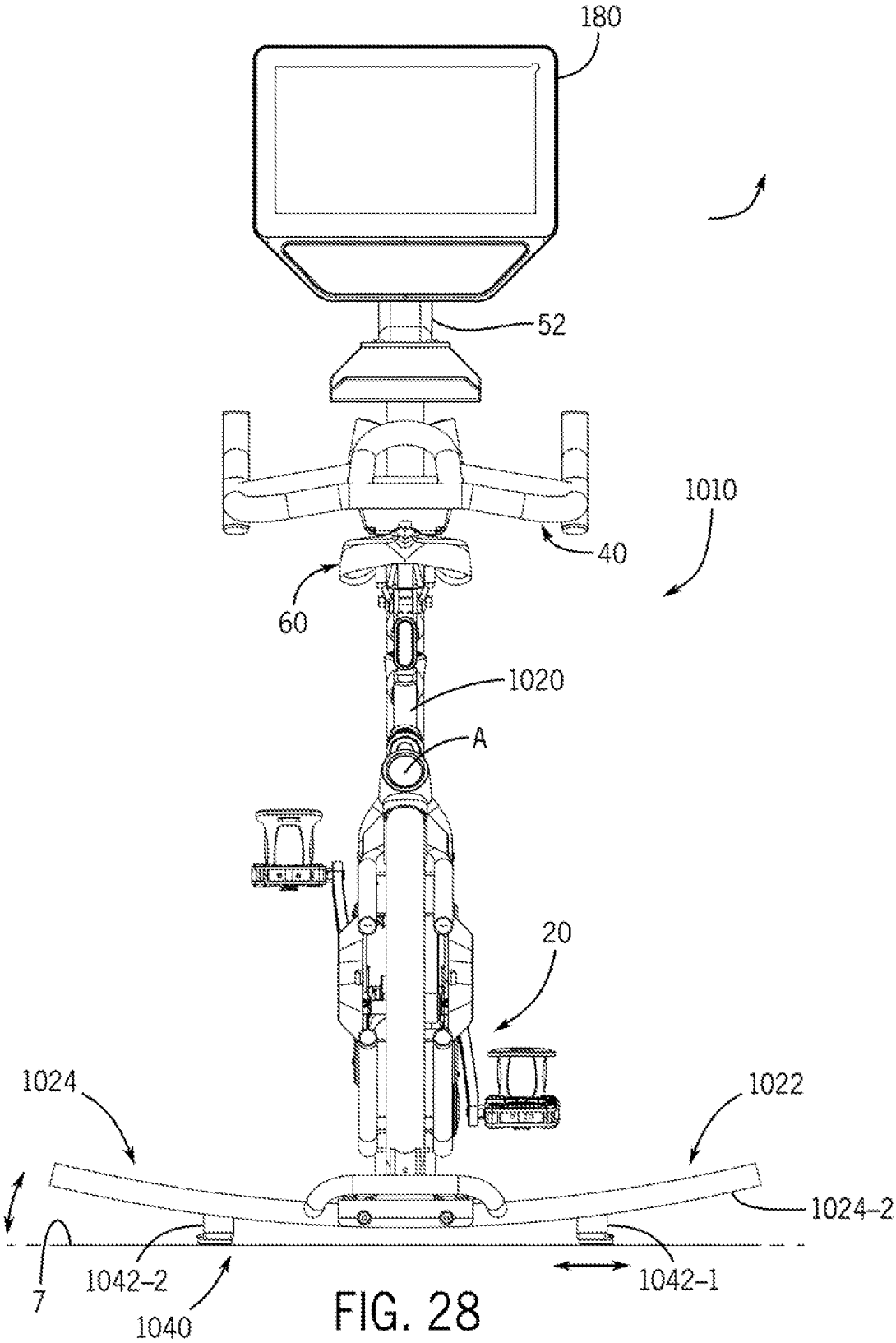
FIG. 28 shows a tilt-enabled bike with a rocking base according to embodiments of the present disclosure.

FIG. 28 illustrates another example of a bike 1010 which is selectively configurable as a tilt-enabled bike. The bike 1010 may include some or all of the components of bike 10 that enable the user to perform exercise simulating cycling. For example, the bike 1010 may include a seat assembly 60, a handle bar assembly 40, and a drive assembly 20, all operatively coupled to a bike frame 1020. The drive assembly 20 may include a crankshaft and a pair of pedals, each of which is coupled to an opposite side of the crankshaft, whereby the user rotates the crankshaft, in use, to perform exercise that simulates cycling. However, in this example, substantially the entire bike frame 1020 tilts (e.g., pivot about axis A'), e.g., in response to user force such as when the user is using the exercise bike 1010. Here, instead of a base that supports a portion of the bike stationary with respect to a support surface, the bike includes a rocking base 1022 enabling substantially the full bike 1010 to pivot or lean. The base may include one or more transverse members (e.g., one or more beams oriented transversely to the frame such that they extend away from opposite sides of the mid-plane of the bike) with first and second lateral ends on opposite sides of the base. The opposite lateral ends of the base are thus disposed on and spaced apart from opposite sides of the frame. The lateral ends of the base are configured to move relative to the support surface during use of the bike thereby causing the frame to tilt or rock from side to side. For example, the lateral ends of the base may be spaced apart from the contact surface when the bike is supported on the contact surface by the base. The base may be operatively associated with a tilt-disabling mechanism that disables the movement of the first and second lateral ends relative to the support surface.

The rocking base 1022 may be implemented using one or more curved members 1024. In some examples, the rocking base 1022 may include a first or front curved beam (not shown in this view) that supports a front portion of the uptight bike frame, and a second or rear curved beam 1024-2. Each of the curved beams may define an arc (or portion of the circumference of a circle), the radius of which may be selected to position the pivot axis A' at a desired elevational location. In some embodiments, the front and rear curved beams may define arcs having slightly different radii so as to tailor the incline angle of the pivot axis A' with respect to the ground. At least a portion of the one or more curved members 1024 (e.g., a mid-portion of curved member 1024' in FIG. 29A) may contact the support surface (e.g., the ground 7) to support the bike onto the support surface. The one or more curved members 1024 may contact the support surface with the convex side of the curved member such that each of the opposite lateral ends of the curved member 1024 are spaced from the support surface.

The bike 1010 may be equipped with tilt-disabling mechanism 1040 operatively associated with the rocking base 1022 (e.g., with the one or more curved members 1024). The tilt-disabling mechanism 1040 may include at least one adjustable member (e.g., an adjustable or leveling foot, a spring member, or combinations thereof) configured to selective reduce or disable the movement of the opposite lateral ends of the base relative to the support surface. For example, the tilt-disabling mechanism 1040 may include a first leveling foot 1042-1 coupled to the curved member 1024 (e.g., rear curved beam 1024-2) on one side of the longitudinal mid-plane of the bike 1010 and a second leveling foot 1042-2 fixed to the curved member 1024 (e.g., rear curved beam 1024-2) on the opposite side of the longitudinal mid-plane of the bike 1010. The leveling feet 1042-1 and 1042-2 may be spaced an equal distance from the longitudinal mid-plane of the bike 1010. In some embodiments, that distance may be adjustable (e.g., by coupling the leveling feet 1042-1 and 1042-2 to the curved member 1024 such that they are movable along the length of the curved member 1024), which may facilitate adjusting (e.g., increasing or decreasing) the maximum tilt angle of the bike and thus a difficulty level of the exercise.

The leveling feet 1042-1 and 1042-2 may be adjustable to a first configuration or length, in which the rocking base is able to rock, and thereby lean the bike, substantially unimpeded. This configuration may be referred to as the tilt-enabled configuration, in which the tilt-disabling mechanism 1040 is substantially disengaged. In this configuration, the leveling feet may be substantially retracted above the devotional level of the bottom surface of the curved member 1024. The leveling feet 1042-1 and 1042-2 may be adjustable to a second configuration or length, substantially equal to the distance between the ground 7 and the bottom surface of the curved member 1024 at the locations where the leveling feet 1042-1 and 1042-2 are attached to the curved member 1024. As such, in this configuration, the left and right upwardly curved portions of the rocking base 1022 may be supported into a fixed position by the leveling feet, which constrains the rocking or tilting movement of the frame 1020. In some embodiments, the leveling feet, alternatively or additionally to being length-adjustable, may be reversibly compressible (e.g., resilient or compliant). For example, each of the leveling feet may be implemented by or in combination with a resilient member, such as a spring (e.g., an elastomeric member or coil spring), which is able to reversibly and temporarily deform when the bike leans. In some such embodiments, the tilt lock-out may be achieved by increasing the stiffness of the spring to a level that would effectively render the spring substantially incompressible under normal user forces and/or by adjusting the location of the spring (e.g., by sliding the springs closer to the longitudinal mid-plane (e.g., to the center of the curved member 1024. In some embodiments a combination of a spring and a retractable member may be used, such that the spring may act as a damper to the tilting or leaning of the bike, while the retractable rigid member may be used to fully disable or lock out the tilting movement of the bike. In various embodiments, a fixed height foot, a wedge, or a spring element may be movably associated with the rocking base 1022 and positionable between the elevated end of the rocking base and the ground to substantially fill the space between the elevated end of the rocking base and the ground thereby interfere with the movement of the rocking base.

Figure 29A:
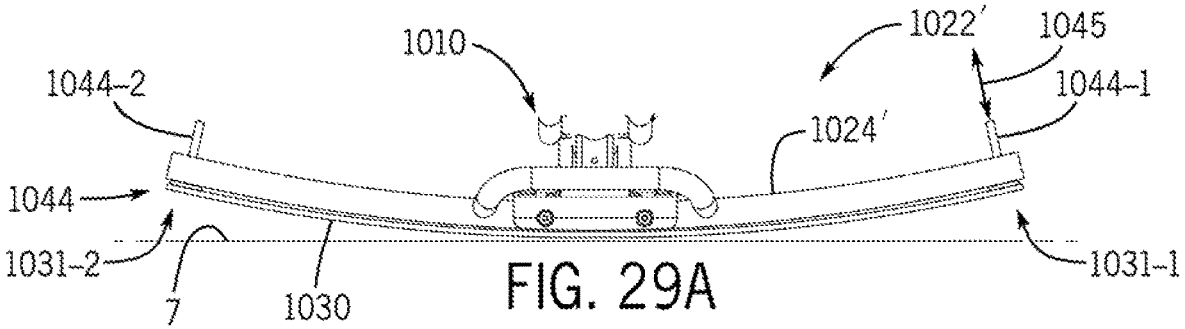
FIGS. 29A and 29B show views of a rocking base for a tilt-enabled bike according to further examples herein.
Figure 29B:
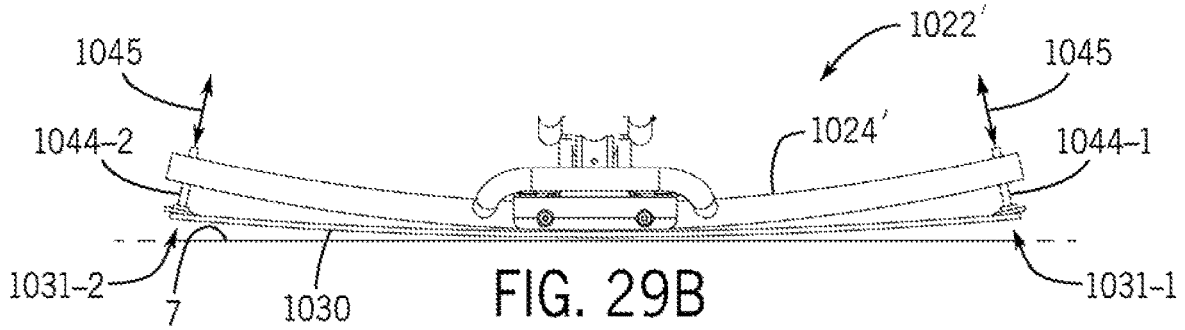

In some embodiments, the rocking base may have an interface side (e.g., the side facing the ground) which has adjustable curvature (see FIGS. 29A and 29B). An elongate spring element 1030, such as a strip or sheet spring may be attached to the underside of the rocking base 1022' (e.g., to one or each of the curved members 1024') and be selectively adjustable to vary the curvature of the spring element 1030 and thus of the underside of the rocking base 1022'. The spring element 1030 may be implemented using any suitable generally flattened arc-shaped piece of metal (e.g., a sheet or strip of spring steel), and may have a curvature substantially corresponding to the curvature of the rocking base 1022' in its nominal or unloaded state, and a length substantially corresponding to the length of the curved member 1024. The spring element 1030 may be fixed to one or each curved members 1024 of the rocking base 1022' at least at one location along the lengths of the spring and curved member (e.g., about midway between the elevated ends of a curved member 1024).

An adjustment mechanism 1044 (e.g., a pop-pin, a rotating cam, or a threaded or sliding rod) may be operatively, arranged to deflect each of the opposite ends 1031-1 and 1031-2 of the spring element 1030 away from the curved member 1024' (in this illustration downward toward the ground) to vary the curvature of the spring element 1030. For example, a first adjustment mechanism 1044-1, for example a first threaded rod, is fixed to one end 1031-1 of the spring element 1030 and threadedly engaged with the curved member 1024' to selectively push or pull the end 1031-1 of the spring element 1030 away from and toward the respective end of the curved member 1024'. Similarly, a second adjustment mechanism 1044-2, for example a second threaded rod, is fixed to the other end 1031-2 of the spring element 1030 and threadedly engaged with the curved member 1024' to push and pull the end 1031-2 of the spring element 1030 away from and toward the other end of the curved member 1024'. As the two ends 1011-1 and 1031-2 of the spring are deflected away from the curved member 1024' the curvature of the spring 1030 is reduced. As the curvature of the spring element 1030 is reduced (i.e., the curved spring is flattened by operation of an adjustment mechanism), the amount by which the rocking base 1022 is able to tilt or rock from side to side is reduced, the spring element 1030 and one or more actuators (e.g., the adjustment mechanism 104-4-1 and 1044-2) operate to disable the tilt-or lean-capability of the bike 1010.

The spring element 1030 may be adjustable up to a state in which the spring substantially flat and thus resting against the ground 7, thereby substantially preventing any rocking motion of the base 1022'. In some examples, the adjustability of the underside curvature of the rocking base 1022 may be binary (e.g., between a curved and thus rocking state and a generally flat and thus rocking or tilt-disabled state). In other examples, the curvature of the underside of the rocking base may variably adjustable such as to enable adjustments to curvatures between the unloaded (nominal curvature) and flattened (minimum curvature) of the spring 1030. In some such examples, the one or more adjustment mechanisms 1044 may be compliant (e.g., compressible) along the adjustment direction indicated by arrow 1045. The compliance of the one or more adjustment mechanisms 1044 may provide resistance to the tilting or leaning of the bike 1010 when the bike is in an intermediate tilt-enabled configuration (see, e.g., FIG. 29B). A compliant adjustment mechanism 1044 may thus enable adjustments to the resistance to leaning as well as adjustments to and ultimately locking (or disabling) the leaning function of the bike 1010.

Figure 30A:
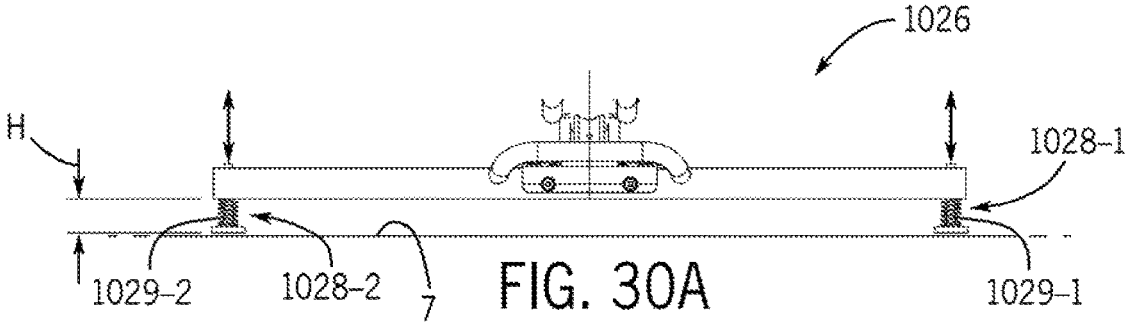
FIGS. 30A and 30B show view of a support base for a tilt-enabled bike with according to embodiments of the present disclosure.
Figure 30B:
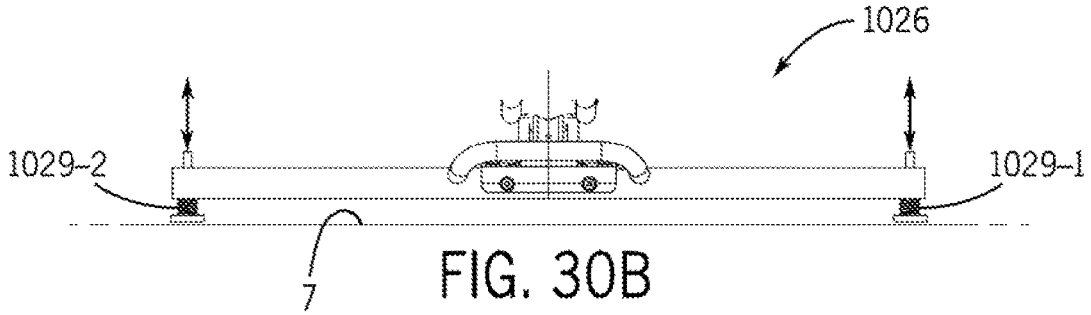

With reference to FIGS. 30A and 30B, a tilt-enabled or leaning bike according to another example may have a supporting base 1026 which allows the bike (e.g., bike 1010) to rock (or tilt or lean) from side to side, responsive to the compression of spring elements supporting the opposite lateral ends of the base, as shown in FIGS. 30A and 30B. The base 1026 may be configured to support the bike (e.g., bike 1010) onto a support surface (e.g., ground 7) at a distance H above the support surface. For example, the base 1026 may include a first lateral support 1028-1 (e.g., first adjustable foot 1029-1) and a second lateral support 1028-2 (e.g., second adjustable foot 1029-2), each supporting an opposite side of the base 1026, e.g., relative to the mid-plane of the bike. Each of the first and second lateral supports may be compressible or compliant such that as the user applies an out of plane force on the bike frame, a respective one of the compliant lateral supports 1028-1 of 1028-2 compresses, reducing the distance H associated with the unloaded state of the bike, thereby causing the base 1026 and thus the upward extending portions of the frame to lean to the side of the compressed lateral support. In some embodiments, compliant first and second lateral supports 1028-1 and 1028-2 may be implemented using respective first and second adjustable feet biasingly coupled to the respective lateral end of the base. In some embodiments, the resistance to tilting or leaning of the frame, which depends upon the compliance (e.g., spring force) of the compliant lateral supports 1028-1 or 1028-1 may be variable allowing the user to increase or decrease the tilting or leaning range of the bike and/or to ultimately disable the tilting or leaning function of the bike (e.g., by increasing the resistance to a level which in effect cannot be overcome by user force). Variable resistance to the tilting or leaning of the bike may be achieved, for example by increasing the preload on the respective spring that biasingly couples each of the first and second adjustable feet 1029-1 and 1029-2 to the base, such as by compressing by an initial amount before the user begins using the bike up to a level in which the springs are sufficiently, preloaded or compressed to effectively eliminate any tilting or leaning of the bike under normal user forces.

An exercise bike system that allows the user to perform exercise simulation cycling is described. The exercise bike system may include a stationary bike (e.g., bike 10) which is capable of tilting from side to side, e.g., responsive to user forces, when the user is riding the stationary bike. In some embodiments, the exercise bike system includes a first bike frame that remains substantially stationary with respect to a support surface (e.g., fixed frame 110 of bike 10) and a second bike frame which is configured to support a user and which pivots relative to the first frame about a pivot axis in response to a force applied to the second frame by the user (e.g., moving frame 120 of bike 10). In some embodiments, the exercise bike system may include one or more electronic components, such as one or more sensors, a transceiver, one or more electronically controller actuators, or any combinations thereof. In some embodiments, the exercise bike system includes a display which is isolated from the pivoting movement of the bike. Movement of the display as the bike tilts (or leans) from side to side can be disorienting to the user. Thus, in some embodiments, a display of the exercise bike system, which is communicatively coupled to an electronic component on the bike, remains stationary while the second frame of the bike pivots relative to the first frame of the bike.

Figure 31A:
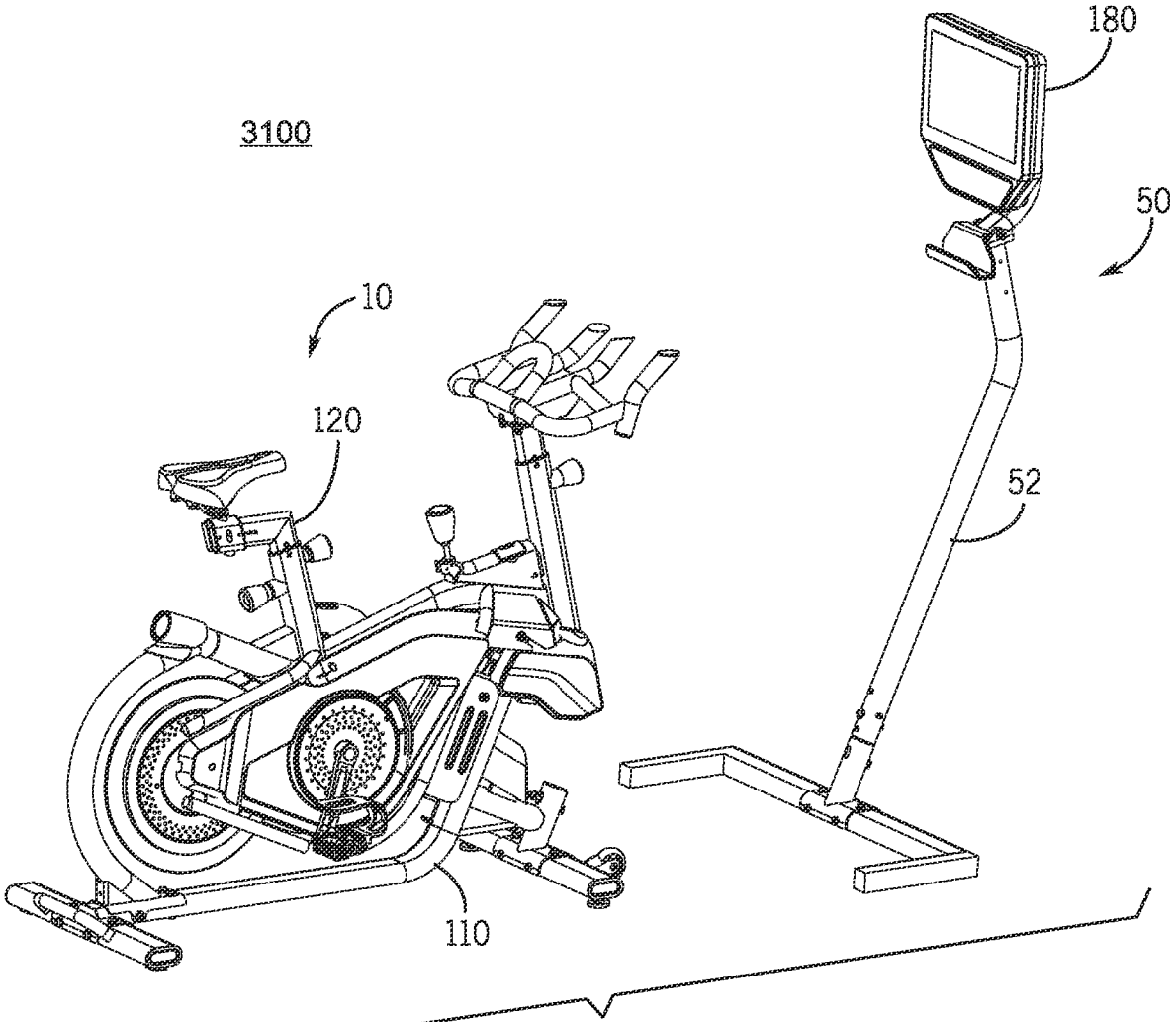
FIG. 31A shows an exercise system including a tilt-enabled bike and a display in accordance with the present disclosure.

For example, referring to FIG. 31A, the exercise bike system 3100 may include a tilt-enabled bike (e.g., bike 10, 1010), and a display 180 configured to remain stationary when the moving frame of the bike is pivoting. The display 180 may be part of a display assembly 50, which may be separate from the bike, as shown in FIG. 31A, or connected to the bike, as shown in FIG. 2, In the embodiment in FIG. 31A, the display 180 is mounted to a stand 52 that has a base, which similar to the base of the bike 10, is configured to be supported on a support surface (e.g., ground 7). In this manner, when the moving frame 120 of the bike tilts from side to side, the display 180 remains stationary, just as the stationary or fixed frame 110.

In other embodiments, the display 180 may be coupled to the fixed frame 110 of the bike 10 (see, e.g., FIG. 2). For example, the display 180 may be coupled, e.g., via display mast 182, to the from stabilizer 112-1, the front frame section 104, or another component of the fixed frame 110. As such, the display 180 may be configured to remain stationary while the moving frame 120 pivots about the pivot axis A. The display 180 may be pivotally mounted to its supporting structure (e.g., display mast 182 or stand 52) to enable the user to change the viewing angle of the display 180.

In some embodiments, the display 180 may be pivotally mounted to the mast 182 using a swing arm 184. The swing arm 184 may be a substantially rigid link, such as a curved tubular member, having a first end 183-1 pivotally connected to the mast 182 and a second end 183-2 supporting the display 180. In some embodiments, the connection between the swing arm 184 and the display 180 may be rigid such that adjustments to the viewing angle may be obtained via pivoting of the swing arm 184 about the pivot interface 187. In other embodiments, the display 180, which may have a rigid mount provided on the rear side of the display housing 181, may be pivotally coupled to the swing arm 184, which may provide a second location for adjustments to the viewing angle of the display 180. In some embodiments, a tray 185 may be provided near the display, shown here as coupled to the display assembly 50 at the location of the interface 187. The tray 185 may be configured to hold various item(s) such as a smart phone, tablet, book, or other media, within reach while using the bike 10.

In some embodiments, the pivot interface 187 may be configured as a sliding interface, which pivotally adjusts the viewing angle of the display 180 by moving the first end 183-1 of the swing arm 184 in the direction 189. Such sliding interface may be implemented using one or more transverse pins at the upper end of the mast 182 and which are operatively engaged with a slot located at the end 183-1 and extending lengthwise along a portion of the swing arm 184. By virtue of the curvature in the swing arm 184, as the first end 183-1 of the swing arm 184 is pulled in a first direction toward the bike, the display 180 pivots in a first direction (clockwise in the view in FIG. 2), and when the swing arm 184 is moved in the other direction away from the bike, the display 180 pivots in the opposite direction (counterclockwise in the view in FIG. 2). In some such embodiments, in which the first end 183-1 of the swing arm 184 moves in relation to the display mast 182, the tray 185 may be coupled to the swing arm 184, specifically to the first end 183-1 such that is also moves (toward or away from the bike) as adjustments are made to the viewing angle of the display via the sliding pivot interface 187. The pivot interface 187 may be implemented using any other suitable arrangement that effects a change in the angle of inclination of the display 180 with respect to a reference plane (e.g., the ground 7 or the base plane P passing through the front and rear stabilizers).

In some embodiments, the display 180 may be a touch display. The display 180 may be in communication (e.g., via a wired or wireless connection) with one or more electronic components on the bike, e.g., any one of at least one bike sensor, which may include but are not limited to a tilt sensor and one or more sensors arranged to measure cadence, heart rate, speed, temperature, power, or other performance metrics or biometrics. In some embodiments, at least one sensor may be a cadence sensor attached to the bike, which is operatively associated with the crankshaft, cranks, or crank wheel to measure their RPM and thus determine a cadence. In some embodiments, a sensor may be operatively associated with the resistance assembly to determine an amount of resistance applied, which may be used in combination with the RPM or cadence to determine power. Various types of sensors such as an infrared or other optical sensor, an accelerometer, a barometer, a gyroscope or gyrometer, a magnetometer, an EMF sensor, a potentiometer, a camera-based sensor, a fingerprint or other type of biometric sensor, or a force sensor may be used to record and/or compute exercise date (e.g., cadence or RPM, heart rate, power, calories, distance travelled, etc.) and other information about the operation of the bike (e.g., tilt angle, tilt-function status such as enabled or disabled, resistance level, etc.), which may be provided to the user, such as via the display 180.

Figure 31B:
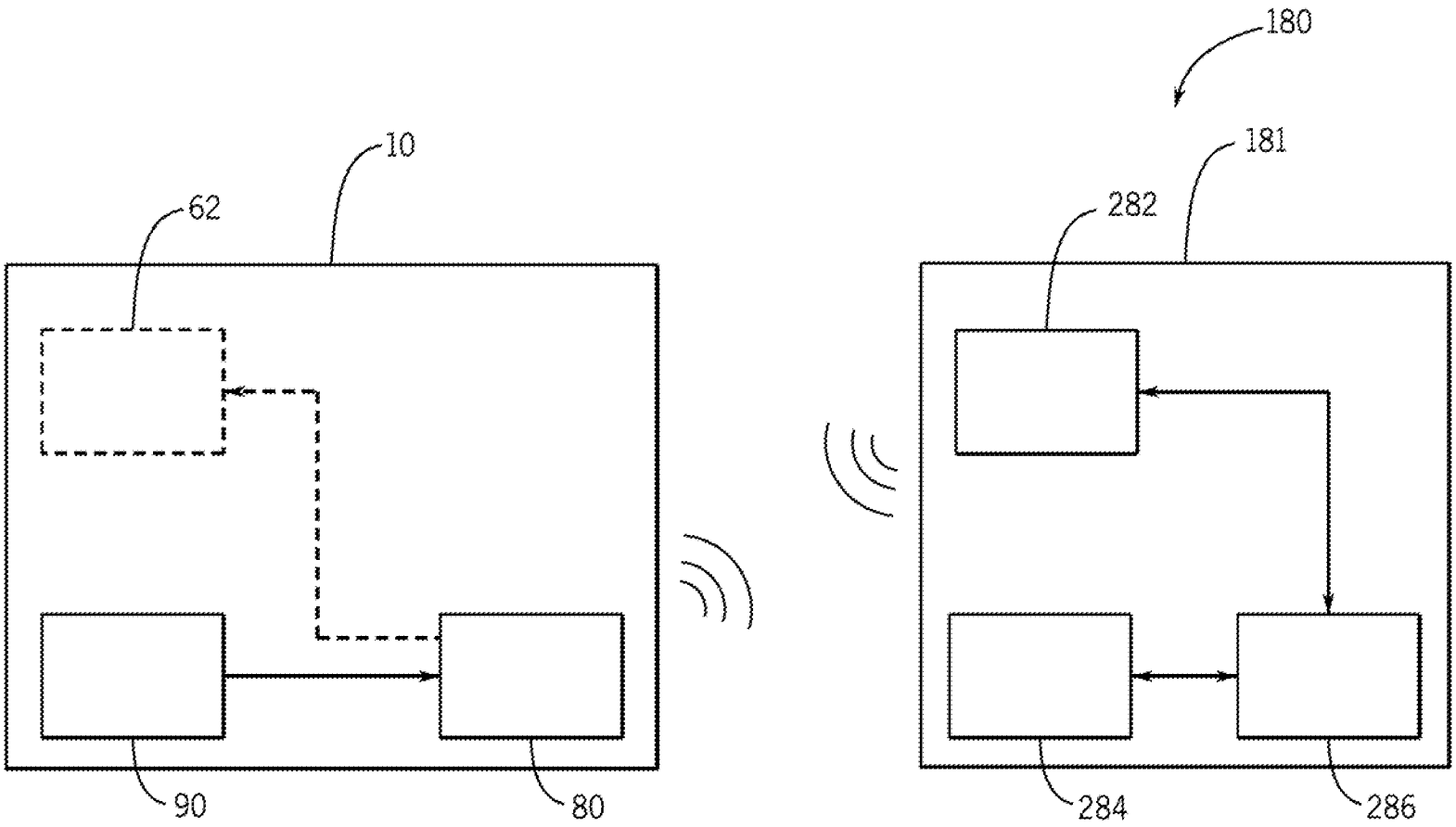
FIG. 31B shows a block diagram of electronic components of an exercise bike system according to the present disclosure.

FIG. 31B shows a block diagram of electronic components of the exercise bike system 800 according to some embodiments of the present disclosure. As shown in FIG. 31B, a sensor 90 is attached to the bike 10. The sensor 90 may be attached to any suitable component of the bike 10, such as to the first bike frame (e.g., the fixed frame 110) or the second bike frame (e.g., the moving frame 120). The sensor 90 communicates (e.g., via a wired connection) with a transceiver 80 also attached to the bike 10. Similar to the sensor 90, the transceiver 80 may be attached to any suitable component of the bike 10, such as to the first bike frame (e.g., the fixed frame) or the second bike frame (e.g., the moving frame). The transceiver 80 communicates with the display 180. To communicate with the bike's transceiver, the display 180 may include a display transceiver 282. The transceiver 80 on the bike 10 and the display transceiver 282 may be configured to wirelessly communicatively couple, e.g., via Bluetooth, ZigBee, radio frequency (RF), or any other suitable wireless communication protocol. The display transceiver 282 may be contained within a housing 181 of the display 180. In some embodiments, the display 180 may be touch sensitive and may function as a console (e.g., for controlling one or more operations of the bike, such as for adjusting a bike setting, selecting an exercise program or media content to be displayed). In some embodiments, the display 180 may be integrated with a console that includes and 110 interface having one or more user controls (e.g., buttons, knobs, sliders, touch sensors some of which may be operatively associated with the display, etc.) for controlling operation(s) of the bike.

The display 180 may further include, in its housing 281, a display processor 286, which may be implemented using a central processing unit (CPU), graphics processing unit (GPU), digital signal processor (DSP), a microprocessor, a microcontroller, a single board computer, or any other suitable processing unit. The processor 286 is in communication with the display transceiver 282 and a display screen 284. The processor 286 may receive signals from the display transceiver 282 and convert them into signals to be sent to the display screen 284 for displaying information on the display screen 284 related to the sensor 90, such as information obtained from measurements by the sensor (e.g., heart rate, cadence, speed, resistance, tilt angle, etc.). In other embodiments, the display 180 may not have a processing unit, which may instead be located on the bike 10 or be part of an external electronic device 72, such as the user's smart phone. In some such embodiments, the display 180 may receive signals (e.g., audio/video data and/or other information, such as sensor data) via the display transceiver 282 in a form ready for display by the display screen 284. The display screen 284 may be implemented using any suitable display technology such as LED, LCD, OLED, QLED. In some embodiments, at least a portion of the display screen 284 may be touch sensitive, implemented using any suitable touch screen technologies such as resistive, capacitive, surface acoustical wave, infrared grid or other.

Figure 32:
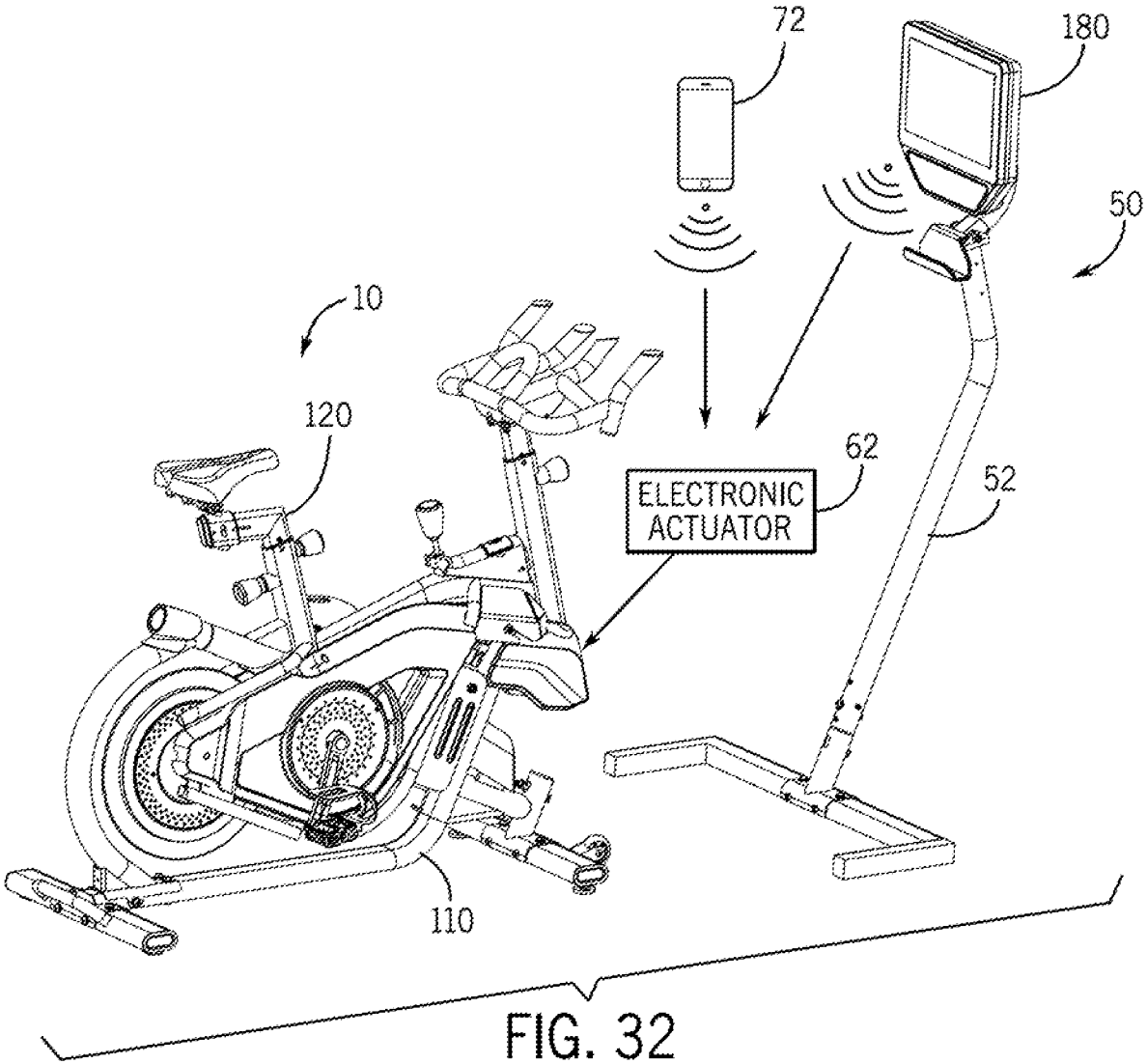
FIG. 32 shows an exercise system including a tilt-enabled bike configured for remote actuation of the tilt-disabling mechanism in accordance with the present disclosure.

In some embodiments, the tilt-disabling mechanism may be electronically controlled, for example responsive to sensor signals and/or sensor measurements. In some embodiments, the tilt-disabling mechanism may be controlled (e.g., actuated) locally, for example by a mechanical actuator as the one described above with reference to FIGS. 7A, 7B, and 8, which may be directly connected to the locking mechanism. In other embodiments, actuation may occur by pushing a button on the bike, which may communicate (e.g., via a wired or wireless connection) with an electronic actuator 62 (see FIG. 32), such as a solenoid, a servo or motor, or any other suitable electronic component, operatively associated with the locking mechanism to actuate the locking mechanism. In some embodiments, as shown in FIG. 32, the actuation may be initiated remotely such as via a wireless communication from an external electronic device (e.g., the user's smart phone 72), the console of the bike, which in some embodiments may be at least partially provided by a touch-enabled display 180), or other. In some such embodiments, as also shown in FIG. 31B, the display 180 may send a control signal via the display transceiver 282 and responsive to user inputs to the transceiver 80 on the bike. The transceiver 80 may communicate the control signal to the actuator 62 for remotely actuating (e.g., engaging or disengaging) the tilt-disabling mechanism of the bike 10. In some embodiments, the display 180 may be configured to communicate (e.g., wirelessly or via a wired connection) with an external electronic device 72, such as a smartphone, a portable music or video player, a tablet, a portable computer, a Wi-Fi router or any other electronic device enabled for wireless communication, as shown, for example, in FIG. 32.

An exercise bike according to any embodiments of the present disclosure may include a console 850 for controlling one or more operations of the exercise bike. In some embodiments, the console 850 may be operable to display content and/or facilitate interaction with the user while the user is exercising. The console 850 may be supported by the frame (e.g., the fixed frame or the moving frame), or it may be supported on a stanchion separate from the bike frame. The support structure supporting, the console 850 may position the console 850 in a convenient location, such as at a location whereby controls of the console are accessible to the user while exercising with the exercise bike and/or the display is visible to the user during use of the exercise bike. In some embodiments, at least a portion of the console 850, such as the display 180, may be removably mounted to its support structure (e.g., the bike frame or stanchion). In some embodiments, the console 850 and/or the console support structure may be configured to adjusting the vertical position, the horizontal position, and/or orientation of the console or a component thereof (e.g., the display) with respect to the rest of the frame (e.g., relative to the moving frame).

Figure 35:
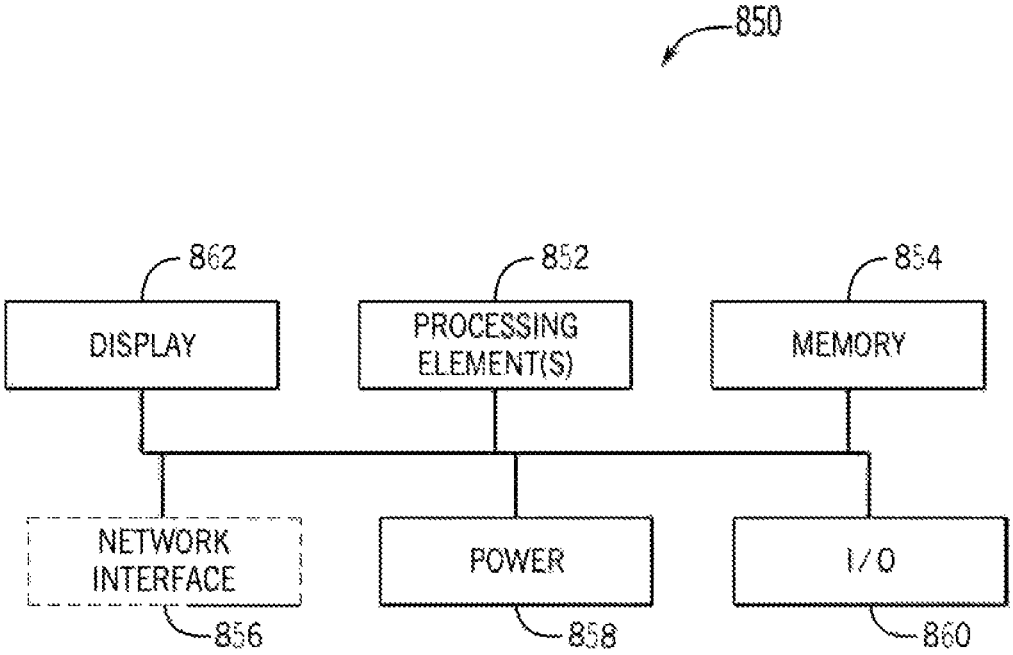
FIG. 35 shows a block diagram of a console in accordance with some embodiments of the exercise bike according to the present disclosure.

FIG. 35 illustrates a block diagram of a console 850. As shown, the console 850 may include one or more processing elements (or simply processor) 852, memory 854 an optional network/communication interface 856, a power source 858, and one or more input/output (I/O) devices 860. As discussed, the console 850 may also include a display 862, which may implement display 180, or which may be a separate, additional display. For example, the display 862 of the console 850 may be a touch-sensitive display that functions as an input/output device, while display 180 may be a passive display, which in some cases may have a larger screen size than that of display 862, for providing content to the user while exercising. In other embodiments, both of the displays 180 and 862 may be either passive displays, or both may be touch sensitive. In yet other embodiments, the functionality of display 862 associated with console 850 may be provided by display 180. The various components of console 850 may be in direct or indirect communication with one another, such as via one or more system buses or other electrical connections, which may be wired or wireless.

The processor(s) 852 may be implemented by any suitable combination of one or more electronic devices (e.g., one or more CPUs, GPUs, FPGAs, etc., or combinations thereof) capable of processing, receiving, and/or transmitting instructions. For example, the processor(s) 852 may be implemented by a microprocessor, microcomputer, graphics processing unit, or the like. The processor(s) 852 may include one or more processing elements or modules that may or may not be in communication with one another. For example, a first processing element may control a first set of components of the console 850 and a second processing element may control a second set of components of the console 850 where the first and second processing elements may or may not be in communication with each other. The processor(s) 852 may be configured to execute one or more instructions in parallel and or across a network, such as through cloud computing resources or other networked electronic devices. The processor 852 may control various elements of the exercise bike, including but not limited to the display (e.g., display(s) 862 and/or 180).

The display 662 provides an output mechanism for the console 850, such as to display visual information (e.g., images, videos and other multi-media, graphical user interfaces, notifications, exercise performance data, exercise programs and instructions, and the like) to a user, and in certain instances may also act to receive user input (e.g., via a touch screen or the like), thus also functioning as an input device of the console. The display 862 may be an LCD screen, plasma screen, LED screen, an organic LED screen, or the like. In some examples, more than one display screens may be used. The display 862 may include or be otherwise associated with an audio playback device (e.g., a speaker or an audio output connector) for providing audio data associated with any visual information provided on the display 862. In some embodiments, the audio data may instead be output via a Bluetooth or other suitable wireless connection.

The memory 854 stores electronic data that ma be utilized by the console 850, such as audio files, video files, document files, programming instructions, media, buffered data such as for executing programs and/or streaming content, and the like. The memory 854 may be, for example, non-volatile storage, a magnetic storage medium (e.g., a hard disk), optical storage medium, magneto-optical storage medium, read only memory, random access memory, erasable programmable memory, flash memory, or a combination of one or more types of memory components. In some embodiments, memory 854 may store one or more programs, modules and data structures, or a subset or superset thereof. The program and modules of the memory 854 may include firmware and/or software, such as, but are not limited to, an operating system, a network communication module, a system initialization module, and/or a media player. The operating system may include procedures for handling various basic system services and for performing hardware dependent tasks. Further, a system initialization module may initialize other modules and data structures stored in the memory 854 for the appropriate operation of the console. In some embodiments, the memory 854 may store, responsive to the processor 852, exercise performance data (e.g., resistance level, bike tilt data, cadence, power, user heart rate, etc.) obtained or derived from measurements by one or more sensors on the exercise bike. The memory 854 may store one or more exercise programs and instructions, which cause the processor 852 to adapt one or more of the exercise programs based on the exercise performance data. The memory 854 may store the adapted exercise program(s) and may subsequently cause the processor 852 to control an operation of the exercise bike in accordance with the adapted exercise program(s). For example, the processor 852 may provide instructions the user, e.g., via the display or other component of the console, for adjusting the configuration of the bike (e.g., the resistance level, enabling or disabling tilt, etc.) or the user's performance (e.g., increasing or decreasing cadence) in accordance with the adapted exercise program. In some embodiments, the processor 852 may automatically, concurrently with or alternatively to providing instructions, adjust the configuration of the bike in accordance with the adapted exercise program.

The network/communication interface 856, when provided, enables the console 850 to transmit and receive data, to other electronic devices directly and/or via a network. The network/communication interface 856 may include one or more wireless communication devices (e.g., Wi-Fi, Bluetooth or other wireless transmitters/receivers, also referred to as transceivers). In some embodiments, the network/communication interface may include a network communication module stored in the memory 854, such as an application program interface (API) that interfaces and translates requests across the network between the network interface 856 and other devices on the network. The network communication module may be used for connecting the console 850, via the network interface 856, to other devices (such as personal computers, laptops, smartphones, and the like) in communication with one or more communication networks (wired or wireless), such as the Internet, other wide area networks, local area networks, metropolitan area networks, personal area networks, and so on.

The console 850 may also include and/or be operatively associated a power supply 858. The power supply 858 provides power to the console 850. The power supply 858 may include one or more rechargeable batteries, power management circuit(s) and/or other circuitry (e.g., AC/DC inverter, DC/DC converter, or the like) for connecting the console 850 to an external power source. Additionally, the power supply 856 may include one or more types of connectors or components that provide different types of power to the console 650. In some embodiments, the power supply 858 may include a connector (such as a universal serial bus) that provides power to the an external device such as a smart phone, tablet or other user device.

The one or more input/output (I/O) devices 860 allow the console 850 to receive input and provide output (e.g., rom and to the user). For example, the input/output devices 860 may include a capacitive touch screen (e.g., a touch screen associated with display 862), various buttons, knobs, dials, keyboard, stylus, or any other suitable user controls. In some embodiments, inputs may be provided to the console (e.g., to processor 852) also via one or more biometric sensors (e.g., a heart rate sensor, a fingerprint sensor), which may be suitably arranged on the exercise bike, such as by placing them at one or more locations likely to be touched by the user during exercise (e.g., on a handlebar of the bike). The input/output devices 860 may include an audio input (e.g., a microphone or a microphone jack). In some embodiments, the processor 858 may be configured to receive user inputs (e.g., a voice commend) via the audio input. One or more of the input/output devices 860 may be integrated with or otherwise co-located on the console. For example, certain buttons, knobs and/or dials, may be co-located with the display 862, which may be a passive or touch sensitive display, and enclosed by a console housing. In some examples, one or more of the input devices (e.g., button for controlling volume or other functions of the console) may be located elsewhere on the exercise machine, e.g., separately from the display 862. For example, one or more buttons may be located on the handlebar and/or a portion of the frame. One or more input devices (e.g., a button, knob, dial, etc.) may be configured for directly controlling a setting of the exercise bike such as the resistance (or braking) setting, damper level or an adjustable tilt damper, etc. In some embodiments, one or more of the input devices may indirectly control bike settings, such as via the processor. For example, an input device 860 may be communication, directly or via the processor 852, with a controller that actuates the resistance mechanism or other mechanism on the bike.

In some embodiments, one or more settings of the bike may be adjusted by the processing element 852 based on an exercise sequence or program stored in memory 854. In some examples, the exercise program may define a sequence of time intervals at various resistance levels anther with or without the tilting function of the bike engaged. In some embodiments, the console 850 may additionally or alternatively communicate the exercise sequence to the user, such as in the form of instructions (e.g. audio and or visual) on the timing of and settings to which a user should adjust the configuration of the bike to correspond to the exercise program. In some embodiments the exercise program may be adapted (e.g., by processor 852) over time based on the user's prior performance of an exercise program or portion(s) thereof. The console 850 may be configured to enable the user to interact with the exercise program, such as to manually adjust it and/or override it (e.g., for exercising in manual mode).

In some embodiments, the console may be configured to present, independent of or concurrently with an exercise program, stored or streaming video content (e.g., scenery which may be recorded and/or computer generated), the playback of which may be dynamically adapted, in some embodiments, based on the user's driving of the moveable components of the exercise bike. For example, when the user's rotating the crank shaft faster the playback may speed up so as to give the impression of the user advancing through the scenery, and conversely, when the user's cadence decreases, the playback may slow down correspondingly to mimic the slower pace or cadence of the user. The scenery may be presented from the vantage point of the user or from a different vantage point, such as a vantage point behind or above (i.e., a bird's-eye view) an avatar of the user. In some embodiments, an exercise program an/or automatic control of the bike may be effected in synchrony with displayed video. For example, a video may display scenery that includes flat and hilted terrain, and the resistance level of the bike may be automatically adjusted, or instructed to be adjusted by the user, to mimic the user's perception that they are navigating similar terrain as that displayed in the video. The display may enable providing an interactive experience for the user, such as by providing an interactive environment according to any of the examples herein, in some embodiments, the interactive environment may be implemented in accordance with any of the examples described in U.S. Pat. No. 10,810,798, titled "Systems and Methods For Generating 360 Degree Mixed Reality Environments," which is incorporated herein by reference for any purpose.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An exercise bike comprising:

a first frame that remains substantially stationary with respect to a support surface;

a second frame pivotally joined to the first frame and configured to support a user, wherein the second frame pivots relative to the first frame about a pivot axis in response to a force applied to the second frame by the user during exercise;

a locking mechanism comprising a block pivotally coupled to the second frame and a wedge fixed to the first frame; and an actuator accessible to the user while riding the bike and operatively coupled to the block to cause the block to pivot toward and engage the wedge, in response to manipulation of the actuator, in at least one position of the second frame relative to the first frame.

2. The exercise bike of claim 1, wherein the actuator comprises a spring connecting the actuator to the block for transmitting an actuation force to the block.

3. The exercise bike of claim 2, wherein the spring is compressed when the locking mechanism is in an engaged state in which the block is engaged with the wedge.

4. The exercise bike of claim 3, wherein the actuator comprises:

a first elongated element coupled to a housing of the actuator and engaging one end of the spring, and a second elongated element coupled to the block and engaging an opposite end of the spring, the first and second elongated elements compressing the spring when the block is pivoted toward the wedge.

5. The exercise bike of claim 1, further comprising a display that remains stationary with respect to the first frame while the second frame pivots relative to the first frame.

6. The exercise bike of claim 5, wherein the display mounts on a mast fixed to and extending from the first frame.

7. The exercise bike of claim 5, wherein the display is mounted on a stand separate from the first frame.

8. The exercise bike of claim 1, wherein the second frame is pivotally supported on the first frame by at least one pivot shaft that defines the pivot axis.

9. The exercise bike of claim 8, wherein the second frame is pivotally supported on the first frame via a front pivot shaft and a rear pivot shaft axially aligned to define the pivot axis.

10. The exercise bike of claim 1, wherein the actuator comprises a rod movably coupled to the second frame and connected to the block such that pushing or pulling on the rod pivots the block into engagement with the wedge.

11. The exercise bike of claim 1, wherein the block is comprises a groove and the wedge is received at least partially in the groove when the wedge is engaged with the block.

12. The exercise bike of claim 1, wherein the actuator is movably coupled to the second frame and configured to pivot the block toward and away from the wedge.

13. The exercise bike of claim 1, further comprising a drive assembly including a crankshaft operatively associated with a pair of pedals configured to be driven by the user, and wherein the second frame is pivotally coupled to the first frame at a first pivot joint located forward of the crankshaft and a second pivot joint located aft of the crankshaft.

14. The exercise bike of claim 1, wherein the first frame comprises a base including a front stabilizer and a rear stabilizer, and wherein the pivot axis is inclined at an angle no greater than 45 degrees relative to a base plane passing through the front and rear stabilizers.

15. The exercise bike of claim 1, further comprising a damper resisting the pivotal movement of the second frame relative to the first frame.

16. The exercise bike of claim 1, wherein the actuator comprises an electronic actuator.

* * * * *